US009400480B2

(12) United States Patent
Itabashi

(10) Patent No.: US 9,400,480 B2
(45) Date of Patent: Jul. 26, 2016

(54) IMAGE FORMING APPARATUS HAVING BELT UNIT AND SUPPORTING MEMBER

(71) Applicant: Brother Kogyo Kabushiki Kaisha, Nagoya-shi, Aichi-ken (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/740,632

(22) Filed: Jun. 16, 2015

(65) Prior Publication Data

US 2015/0362888 A1 Dec. 17, 2015

(30) Foreign Application Priority Data

Jun. 16, 2014 (JP) ..... 2014-123290
Jun. 16, 2014 (JP) ..... 2014-123291
Jun. 16, 2014 (JP) ..... 2014-123292

(51) Int. Cl.
*G03G 21/16* (2006.01)

(52) U.S. Cl.
CPC ..... *G03G 21/1647* (2013.01); *G03G 21/1676* (2013.01); *G03G 2221/1654* (2013.01); *G03G 2221/1846* (2013.01)

(58) Field of Classification Search
CPC ..... G03G 15/161; G03G 15/2053; G03G 15/0808; G03G 15/2032; G03G 15/2039; G03G 15/206; G03G 15/6529; G03G 15/6576
See application file for complete search history.

(56) References Cited

U.S. PATENT DOCUMENTS

| | | | | |
|---|---|---|---|---|
| 7,647,004 | B2 | 1/2010 | Mori | |
| 8,712,285 | B2 | 4/2014 | Kato | |
| 8,744,311 | B2 | 6/2014 | Sato et al. | |
| 8,768,206 | B2 | 7/2014 | Sato | |
| 8,929,770 | B2 | 1/2015 | Sato | |
| 9,031,460 | B2 | 5/2015 | Sato et al. | |
| 2006/0171738 | A1 | 8/2006 | Mori | |
| 2007/0160383 | A1* | 7/2007 | Matsumoto | G03G 15/751 399/110 |
| 2012/0195628 | A1 | 8/2012 | Kato | |
| 2012/0328325 | A1 | 12/2012 | Sato | |
| 2012/0328329 | A1 | 12/2012 | Sato et al. | |
| 2014/0270848 | A1 | 9/2014 | Sato et al. | |
| 2014/0314446 | A1 | 10/2014 | Sato | |
| 2015/0110523 | A1 | 4/2015 | Sato | |

FOREIGN PATENT DOCUMENTS

| | | | |
|---|---|---|---|
| JP | H04-009075 | U | 1/1992 |
| JP | H07-36294 | A | 2/1995 |
| JP | H07-261493 | A | 10/1995 |

(Continued)

*Primary Examiner* — Roy Y Yi
(74) *Attorney, Agent, or Firm* — Banner & Witcoff, Ltd.

(57) ABSTRACT

In an image forming apparatus, both a drum cartridge and a developer cartridge are detachably supported by a supporting member. The drum cartridge has an abutment portion. The developer cartridge includes a developer gripping portion. The developer gripping portion has a moving portion. The moving portion moves between a protruding position and an accommodated position. When the drum cartridge is mounted to the supporting member the abutment portion abuts against the moving portion to cause the moving portion to move to the accommodated position. When the drum cartridge is removed from the supporting member, abutment of the abutment portion against the moving portion is released to cause the moving portion to move to the protruding position.

44 Claims, 23 Drawing Sheets

(56) References Cited

FOREIGN PATENT DOCUMENTS

| | | | |
|---|---|---|---|
| JP | 2000-047450 | A | 2/2000 |
| JP | 2006-208838 | A | 8/2006 |
| JP | 2008-090121 | A | 4/2008 |
| JP | 2011-033924 | A | 2/2011 |
| JP | 2012-103485 | A | 5/2012 |
| JP | 2012-155266 | A | 8/2012 |
| JP | 2013-007945 | A | 1/2013 |
| JP | 2013-007948 | A | 1/2013 |

* cited by examiner

IMAGE FORMING APPARATUS HAVING BELT UNIT AND SUPPORTING MEMBER

CROSS REFERENCE TO RELATED APPLICATION

This application claims priorities from Japanese Patent Application Nos. 2014-123291, 2014-123290, and 2014-123292 those filed Jun. 16, 2014. The entire contents of these priority applications are incorporated herein by reference.

TECHNICAL FIELD

The present disclosure relates to an electro-photographic type image forming apparatus.

BACKGROUND

An intermediate transfer type color printer is known in the art in which provided are a main casing, a plurality of photosensitive drums, and an intermediate transfer belt on which a toner image is transferred from the plurality of photosensitive drums. The plurality of photosensitive drums is positioned below the intermediate transfer belt.

U.S. Patent Application publication US2012/195628A1 discloses a printer in which a plurality of process cartridges each including a photosensitive drum and a toner chamber is attachable to and detachable from a cartridge holder. Each process cartridge has a hand grip portion. When a user grips the hand grip portion and pulls up the process cartridge, the process cartridge can be detached from the cartridge holder.

U.S. Patent Application publication US2012/328325A1 discloses such printer in which a process unit is movable between an inside position inside the main casing and an outside position outside the main casing. The process unit supports a plurality of process cartridges each supporting each photosensitive drum. In the inside position, the plurality of photosensitive drums is urged upward so as to contact the intermediate transfer belt from below. The main casing has an inner casing at which positioning grooves are formed so as to position the plurality of photosensitive drums at given positions. Thus, the plurality of photosensitive drums is subjected to positioning with respect to the main casing.

U.S. Patent Application publication US2012/328329A1 discloses a printer in which a plurality of photosensitive drums is supported by a single drum unit, and the plurality of photosensitive drums is in contact with the intermediate transfer belt from below.

SUMMARY

The present inventor has found disadvantages in the disclosed printer. For example, in the printer disclosed in U.S. Patent Application publication US2012/195628A1, a user wishes to take out the photosensitive drum at a timing different from the timing of exchanging toner, because exchange timing of the photosensitive drum is different from that of toner. To attain this demand, it is conceivable that a process cartridge is divided into a drum cartridge provided with the photosensitive drum, and a toner cartridge provided with the toner chamber, and the drum cartridge and the toner cartridge can be attached to and detached from the cartridge holder independent of each other. However, in an attempt to detach the toner cartridge from the cartridge holder, the drum cartridge positioned above the toner cartridge may also be detached, and the drum cartridge may fall down and undergo breakdown.

In the printer disclosed in U.S. Patent Application publication US2012/328325A1, improvement on positioning of the plurality of photosensitive drums with respect to the intermediate transfer belt cannot be made, since the plurality of photosensitive drums is subjected to positioning with respect to the main casing.

In the printer disclosed in U.S. Patent Application publication US2012/328329A1, upper portions of the photosensitive drums are exposed to an outside when the drum unit is pulled outside from the main casing for exchange and maintenance to the photosensitive drums. By such exposure, a user may inadvertently touch the photosensitive drums to cause degradation of image formation.

In view of the foregoing, it is an object of the present disclosure to provide an image forming apparatus capable of ensuring detachment of the developing cartridge from the cartridge holder after stable detachment of the drum cartridge from the cartridge holder.

Another object of the present disclosure is to provide an image forming apparatus capable of performing accurate positioning of the photosensitive drums with respect to the belt.

Still another object of the present disclosure is to provide an image forming apparatus capable of facilitating removable of the drum cartridge from the cartridge holder while restraining user's touching to the photosensitive drum.

In order to attain the above and other objects, the disclosure provides an image forming apparatus. The image forming apparatus includes a main casing, a belt unit, a supporting member and a drum cartridge. the belt unit is accommodated in the main casing and includes the belt. The supporting member is configured to move in a supporting-member-moving direction between an internal position inside the main casing and an external position outside the main casing. The drum cartridge is detachably supported by the supporting member and includes a photosensitive drum and a drum frame supporting the photosensitive drum. The photosensitive drum is disposed below the belt when the supporting member is at the internal position. The photosensitive drum extends in a drum-extending direction orthogonal to the supporting-member-moving direction. The drum cartridge further has an abutment portion. The developer cartridge is detachably supported by the supporting member such that the developer cartridge is disposed below the drum cartridge when both the drum cartridge and the developer cartridge are mounted to the supporting member. The developer cartridge includes a developer frame configured to store developer therein and a developer gripping portion. The developer gripping portion has a moving portion configured to move between a protruding position and an accommodated position. The protruding position is such a position that the moving portion protrudes with its distal end portion being relatively apart from the developer frame. The accommodated position is such a position that a distance between the distal end portion of the moving portion and the developer frame when the moving portion is at the accommodated position is shorter than a distance therebetween when the moving portion is at the protruding position. The abutment portion is configured such that when the drum cartridge is mounted to the supporting member, the abutment portion abuts against the moving portion to cause the moving portion to move to the accommodated position and such that when the drum cartridge is removed from the supporting member, abutment of the abutment portion against the moving portion is released to cause the moving portion to move to the protruding position.

According to another aspect, the present disclosure provides an image forming apparatus. The image forming apparatus includes a main casing, a belt unit, a supporting member and a plurality of drum units. The belt unit is accommodated in the main casing and includes a belt and a belt frame supporting the belt. The supporting member is configured to move between an internal position inside the main casing and an external position outside the main casing. The plurality of drum units is supported by the supporting member such that the drum units are arrayed side by side in a drum-unit-arrayed direction. Each of the plurality of drum units includes a photosensitive drum extending in a drum-extending direction orthogonal to the drum-unit-arrayed direction, and a drum frame supporting the photosensitive drum. The drum frame of each drum unit has an engagement portion. The belt frame has positioning portions, each positioning portion being configured to be engaged with a corresponding one of a plurality of engagement portions of the plurality of drum frames, thereby fixing the plurality of drum frames in positions relative to the belt frame.

According to still another aspect, the present disclosure provides an image forming apparatus. The image forming apparatus includes a main casing, a belt unit including a belt, a drum cartridge, a developer cartridge and a supporting member. The drum cartridge includes a photosensitive drum having an axis extending in a drum-extending direction and a drum frame supporting the photosensitive drum. The developer cartridge is configured to store developer therein. The supporting member is configured to move in a supporting-member-moving direction between an internal position inside the main casing and an external position outside the main casing. The supporting-member-moving direction is orthogonal to the drum-extending direction. The supporting member is configured to support the drum cartridge and the developer cartridge such that the drum cartridge and the developer cartridge are attachable to and detachable from the supporting member. The drum cartridge is disposed below the belt unit and the developer cartridge is disposed below the drum cartridge when the supporting member is at the internal position in a state that the supporting member supports the drum cartridge and the developer cartridge. The drum frame has a drum gripping portion at one end portion of the drum frame in the drum-extending direction.

BRIEF DESCRIPTION OF THE DRAWINGS

The particular features and advantages of the embodiments as well as other objects will become apparent from the following description taken in connection with the accompanying drawings, in which.

DETAILED DESCRIPTION

An image forming apparatus according to a first embodiment will be described with reference to FIGS. 1 to 20.

1. Overall Structure of Printer

Figure 1:
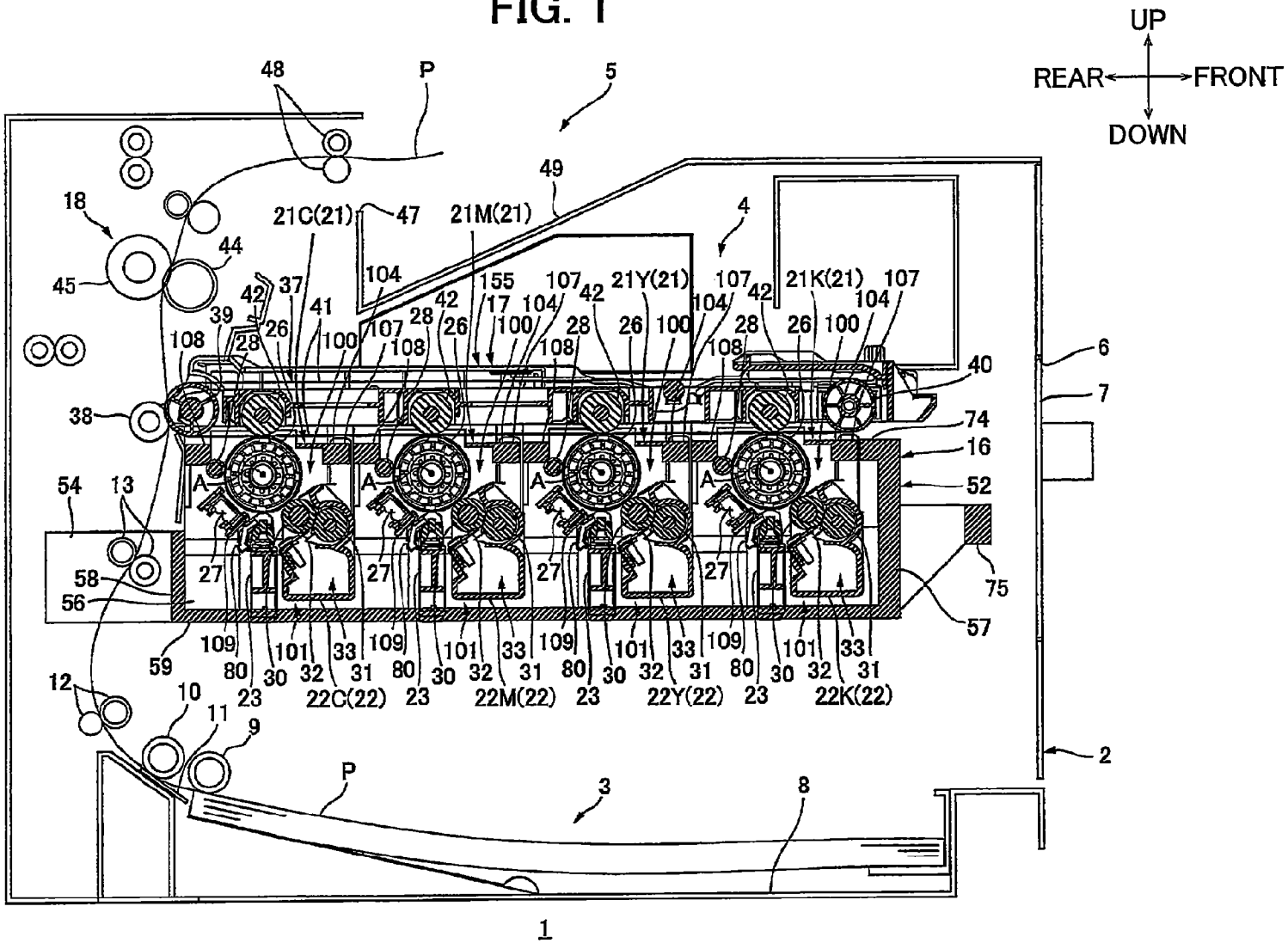
FIG. 1 is a cross-sectional view of a printer as an example of an image forming apparatus according to a first embodiment, taken along the imaginary vertical plane extending in the frontward/rearward and passing through the center of the printer in the leftward/rightward direction.

As illustrated in FIG. 1, the image forming apparatus according to the first embodiment is a horizontal intermediate transfer type color printer 1.

The printer 1 is provided with a main casing 2 as an example of a main casing. Within the main casing 2, the printer 1 is further provided with a sheet supply unit 3, an image forming unit 4 and a sheet discharge unit 5. The sheet supply unit 3 is configured to supply a sheet of paper P to the image forming unit 4. The image forming unit 4 is configured to form an image on the sheet of paper P supplied from the sheet supply unit 3. The sheet discharge unit 5 is configured to discharge the sheet of paper P on which the image has been formed.

Directions used with respect to the printer 1 in the following description will be given on the basis of a state where the printer 1 is resting on a level surface, where the top side of the printer 1 in FIG. 1 will be called the "top," and the bottom side of the printer 1 will be called the "bottom," the right side of the printer 1 will be "front," and the left side of the printer 1 will be "rear." Left and right sides of the printer 1 will be defined on the basis of the perspective of a user facing the front side of the printer 1, so that the near side of the printer 1 in FIG. 1 is the "left side," and the far side is the "right side." Note that leftward/rightward direction is an example of a drum-extending direction, the frontward/rearward direction is an example of a supporting-member-moving direction and is also an example of a drum-unit-arrayed direction.

(1) Main Casing

The main casing 2 is generally box shaped. The main casing 2 has a front wall formed with an opening 6, and is provided with a front cover 7.

The opening 6 penetrates the front wall of the main casing 2 in frontward/rearward direction.

Figure 12:
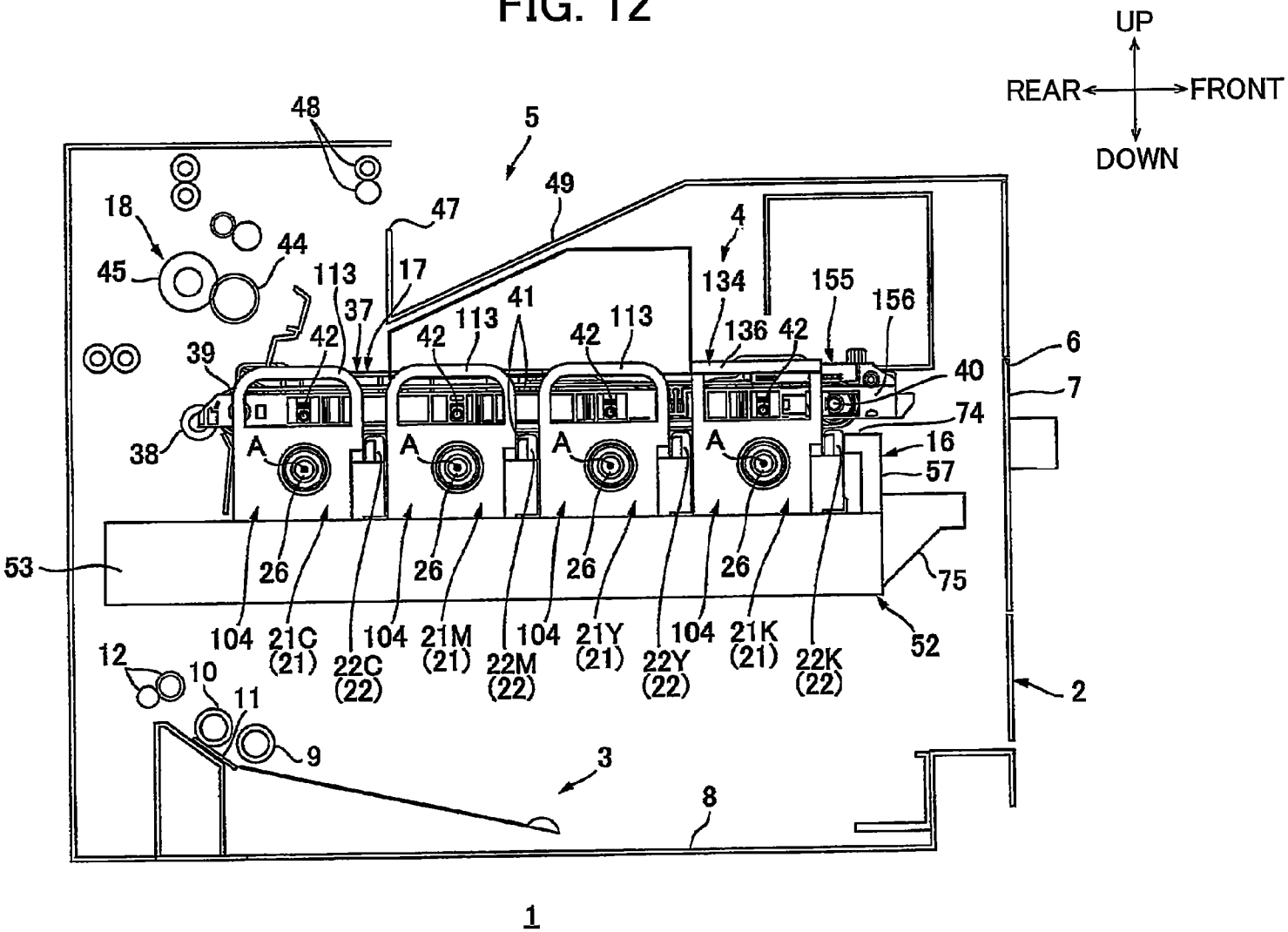
FIG. 12 is a cross-sectional view of the printer depicted in FIG. 1 taken along an imaginary vertical plane positioned leftward of the process unit and in a state where the front cover is at the closed position and the process frame is at an internal position.
Figure 14:
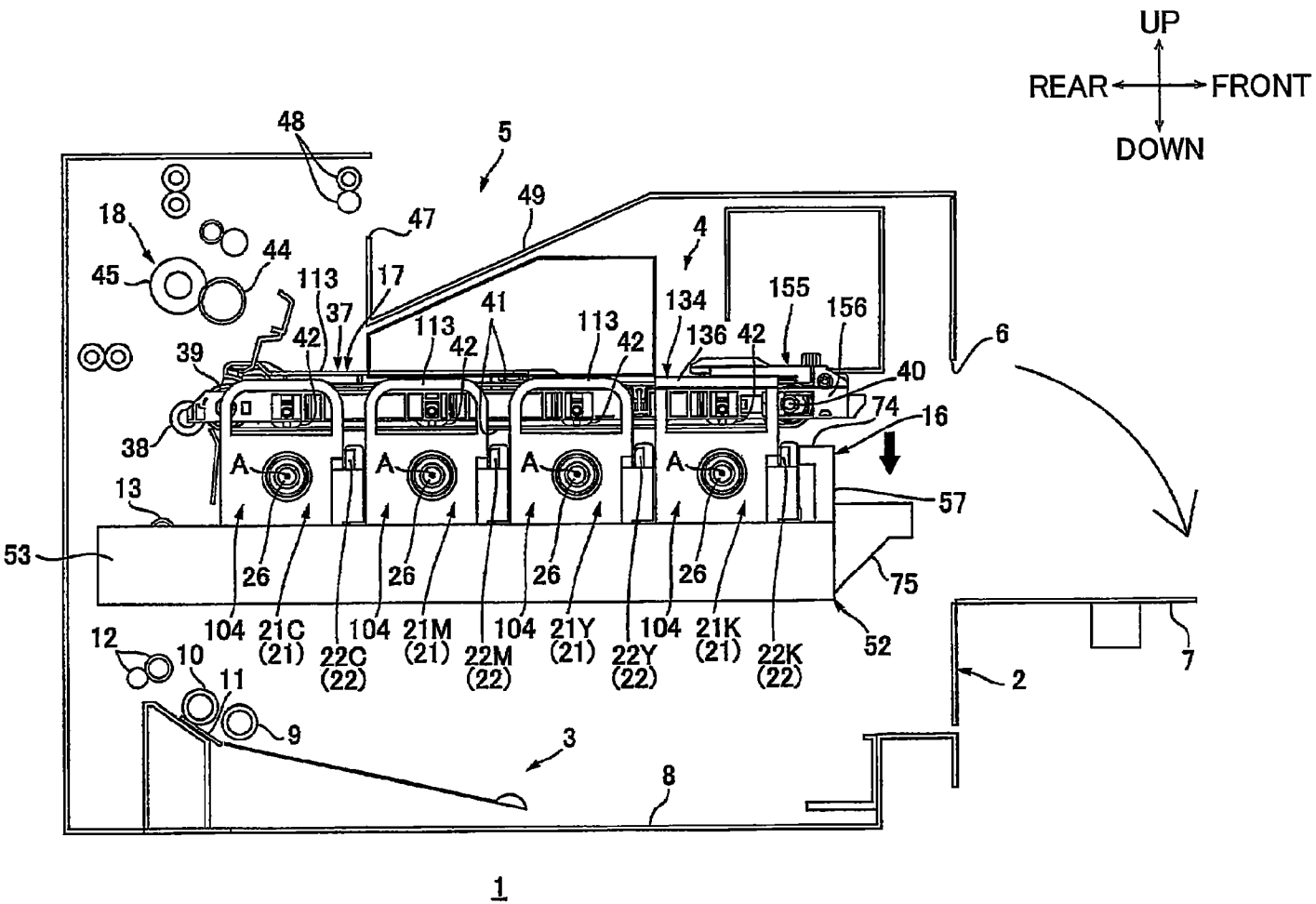
FIG. 14 is a cross-sectional view of the printer depicted in FIG. 1 taken along an imaginary vertical plane positioned leftward of the process unit and in a state where the front cover is at an open position and the process frame is at the internal position.
Figure 15:
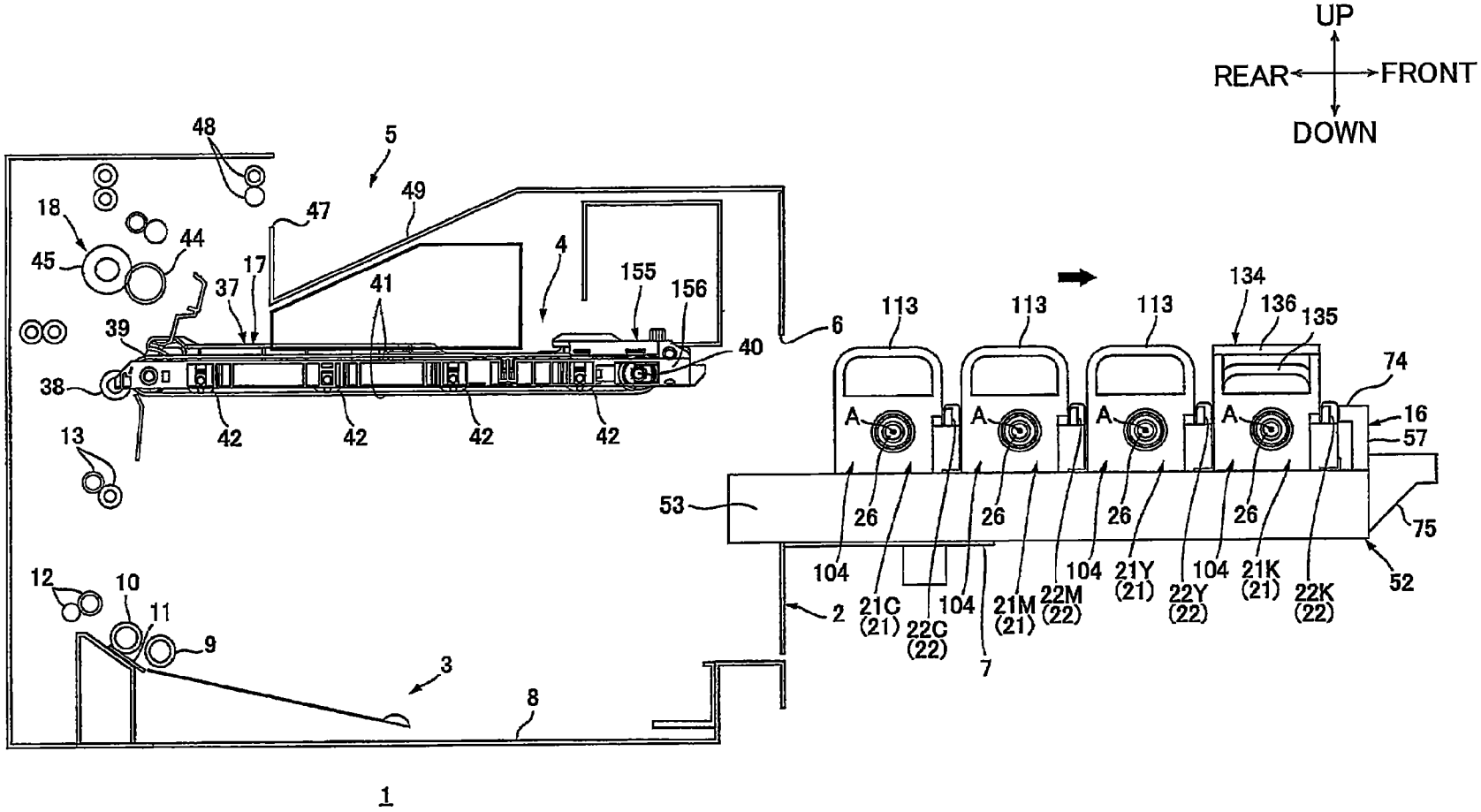
FIG. 15 is a cross-sectional view of the printer depicted in FIG. 1 taken along the imaginary vertical plane positioned leftward of the process unit and in a state where the front cover is at the open position and the process frame is at an external position.

The front cover 7 is pivotally movable about a lower end thereof between a closed position as illustrated in FIGS. 1 and 12 for closing the opening 6 and an open position as illustrated in FIGS. 14 and 15 for opening the opening 6. This pivot motion of the front cover 7 causes a sliding movement of a process frame 52 (described later) between an interior and an exterior of the main casing 2.

(2) Sheet Supply Unit

As illustrated in FIG. 1, the sheet supply unit 3 is provided with a sheet supply tray 8, a pick-up roller 9, a sheet supply roller 10, a sheet supply pad 11, a pair of pinch rollers 12, and a pair of registration rollers 13. The pick-up roller 9 is configured to convey each sheet P accommodated in sheet supply tray 8 to a position between the sheet supply roller 10 and the sheet supply pad 11 by the rotation of the pick-up roller 9. The sheet supply roller 10 is configured to separate a sheet from remaining sheet stack and to convey the separated sheet toward the pair of registration rollers 13 disposed above the sheet supply roller 10 while passing between the pair of pinch rollers 12 by the rotation of the sheet supply roller 10. The pair of registration rollers 13 is configured to convey each sheet P to a position between an intermediate transfer belt 41 and a secondary transfer roller 38, both described later, at a prescribed timing by the rotation of the pair of registration rollers 13.

(3) Image Forming Unit

The image forming unit 4 is provided with a process unit 16, a transfer unit 17 and a fixing unit 18.

(3-1) Process Unit

The process unit 16 is disposed in the main casing 2 at an approximately vertical center portion thereof. The process unit 16 is provided with four drum cartridges 21 as an example of a plurality of drum units, four developing cartridges 22 as examples of a developer cartridge, and four LED units 23 as an example of a plurality of a exposure member.

The four drum cartridges 21 are arrayed side by side in frontward/rearward direction and are positioned at an upper portion of the process unit 16. More specifically, the drum cartridges 21 include a black drum cartridge 21K, an yellow drum cartridge 21Y, a magenta drum cartridge 21M, and a cyan drum cartridge 21C that are arranged at intervals from the front side toward the rear side in this order.

Each of the four drum cartridges 21 supports a photosensitive drum 26, a Scorotron charger 27, and a drum cleaning roller 28.

The photosensitive drum 26 is a generally cylindrical shaped and extends in leftward/rightward direction. The photosensitive drum 26 is rotatable about an axis A extending in the leftward/rightward direction.

The Scorotron charger 27 is disposed diagonally below and rearward of the corresponding photosensitive drum 26, and is spaced away from the corresponding photosensitive drum 26.

The drum cleaning roller 28 is disposed rearward of the corresponding photosensitive drum 26 and contacts a rear end portion of the corresponding photosensitive drum 26. The drum cleaning roller 28 is configured to clean a surface of the corresponding photosensitive drum 26.

Four developing cartridges 22 are disposed at a lower portion of the process unit 16 and diagonally below and frontward of the corresponding photosensitive drum 26. Four developing cartridges 22 are juxtaposed with one another and are arranged at intervals in the frontward/rearward direction. More specifically, the developing cartridges 22 include a black developing cartridge 22K, an yellow developing cartridge 22Y, a magenta developing cartridge 22M, and a cyan developing cartridge 22C that are arranged at intervals from the front side toward the rear side in this order.

Each of the four 22*s* is provided with a developing roller 30, a supply roller 31, a thickness regulation blade 32 and a toner accommodating portion 33.

Each developing roller 30 is rotatably supported at a rear upper portion of the corresponding developing cartridge 22 and contacts a lower front portion of the corresponding photosensitive drum 26. The developing roller 30 has a generally cylindrical shape and extends in the leftward/rightward direction.

Each supply roller 31 is rotatably supported to the corresponding developing cartridge 22 at a position diagonally below and frontward of the corresponding developing roller 30. The supply roller 31 has a generally cylindrical shape and extends in leftward/rightward direction. The supply roller 31 contacts a lower front portion of the corresponding developing roller 30.

Each thickness regulation blade 32 is disposed below the corresponding developing roller 30 and contacts a lower end portion thereof.

Each toner accommodating portion 33 is disposed below the supply roller 31 and the thickness regulation blade 32. The toner accommodating portion 33 is configured to accommodate toner therein. The toner is an example of a developer.

Four LED units 23 are disposed at a lower portion of the process unit 16 and below the corresponding photosensitive drum 26. The LED units 23 are juxtaposed with one another and are arranged at intervals in the frontward/rearward direction. The LED units 23 is configured to expose a surface of the corresponding photosensitive drum 26 to light on the basis of prescribed image data.

(3-2) Transfer Unit

The transfer unit 17 is disposed in the upper portion of the main casing 2 and above the process unit 16. The transfer unit 17 is provided with a belt unit 37 and a secondary transfer roller 38.

The belt unit 37 is disposed above all the photosensitive drum 26 and oriented in the frontward/rearward direction. The belt unit 37 includes a drive roller 39, a follower roller 40, the intermediate transfer belt 41 as an example of a belt, and a plurality of primary transfer rollers 42, that is, four primary transfer rollers 42.

The drive roller 39 is rotatably supported at a rear end portion of the transfer unit 17.

The follower roller 40 is rotatably supported at a front end portion of the transfer unit 17.

The intermediate transfer belt 41 is stretched around the drive roller 39 and the follower roller 40 with a lower portion of the intermediate transfer belt 41 contacting each of an upper end portion of the photosensitive drums 26. The intermediate transfer belt 41 is circulatingly driven by the driving motion of the drive roller 39 and following motion of the follower roller 40 so that the lower portion of the intermediate transfer belt 41 moves rearward.

Four primary transfer rollers 42 are juxtaposed with one another between the drive roller 39 and the follower roller 40 and are arranged at intervals in frontward/rearward direction such that each primary transfer roller 42 is disposed above the corresponding photosensitive drum 26 via the intermediate transfer belt 41. Each primary transfer roller 42 contacts the lower portion of the intermediate transfer belt 41 from above.

The secondary transfer roller 38 is disposed rearward of the drive roller 39 of the belt unit 37 such that the intermediate transfer belt 41 is held between the secondary transfer roller 38 and the drive roller 39.

(3-3) Fixing Unit

The fixing unit 18 is disposed diagonally above and frontward of the secondary transfer roller 38. The fixing unit 18 includes a heat roller 44 and a pressure roller 45 in pressure contact with an upper rear portion of the heat roller 44.

(3-4) Image Forming Operations (3-4-1) Developing Operation

In the image forming operation, the supply roller 31 supplies the toner accommodated in the toner accommodating portion 33 to the developing roller 30 by the rotation of the supply roller 31 while the toner is subjected to triboelectric charging at a position between the developing roller 30 and the supply roller 31.

The thickness regulation blade 32 regulates the thickness of a layer of toner supplied to the developing roller 30 to a prescribed thickness in association with rotation of the developing roller 30. Consequently, the developing roller 30 carries a thin toner layer having a uniform thickness over its peripheral surface.

In the meantime, the Scorotron charger 27 the surface of the photosensitive drum 26 is applied with positive polarity by the Scorotron charger 27 as the photosensitive drum 26 rotates. Subsequently, the surface is exposed to light by the LED unit 23 on the basis of prescribed image data. Thus an electrostatic latent image based on the image data can be formed on the surface of the photosensitive drum 26. Then, the toner carried on the surface of the developing roller 30 is supplied to the electrostatic latent image formed on the surface of the photosensitive drum 26. Consequently, the surface of the photosensitive drum 26 carries a toner image.

(3-4-2) Transfer and Fixing Operations

Then, each toner image formed on each surface of the photosensitive drums 26 is transferred in succession onto the lower portion of the intermediate transfer belt 41 as a primary image transfer. Thus, four photosensitive drums 26 form a color image on the surface of the intermediate transfer belt 41.

Then, the color image on the intermediate transfer belt 41 is transferred onto the sheet P supplied from the sheet supply unit 3 as a secondary image transfer when the sheet P is moved past between the intermediate transfer belt 41 and the secondary transfer roller 38.

Then, in the fixing unit 18, the sheet P onto which the color image transferred, is heated and pressed as the sheet P passes between the heat roller 44 and the pressure roller 45. Consequently, the color image is thermally fixed to the sheet P.

(4) Sheet Discharge Unit

The sheet discharge unit 5 is provided at the upper portion of the main casing 2, and has a dent portion dented downward. The dent portion is V-shaped in side cross-section with the opening of the V-shape facing upward. The sheet discharge unit 5 is formed with a discharge opening 47 and has a pair of sheet discharge rollers 48.

The discharge opening 47 is formed in the rear end portion of the sheet discharge unit 5, and is open frontward to communicate the interior with the exterior of the main casing 2.

The pair of sheet discharge rollers 48 is configured to nip the sheet P therebetween for guiding the sheet P to be discharged through the discharge opening 47 to the exterior of the main casing 2.

The main casing 2 has an upper surface portion positioned frontward of the sheet discharge unit 5. The upper surface portion functions as a discharge tray 49.

The sheet discharge roller 48 discharges the sheet P on which the color image has been thermally fixed at the fixing unit 18 onto the discharge tray 49 via the discharge opening 47.

2. Detailed Description of Process Unit

Figure 2:
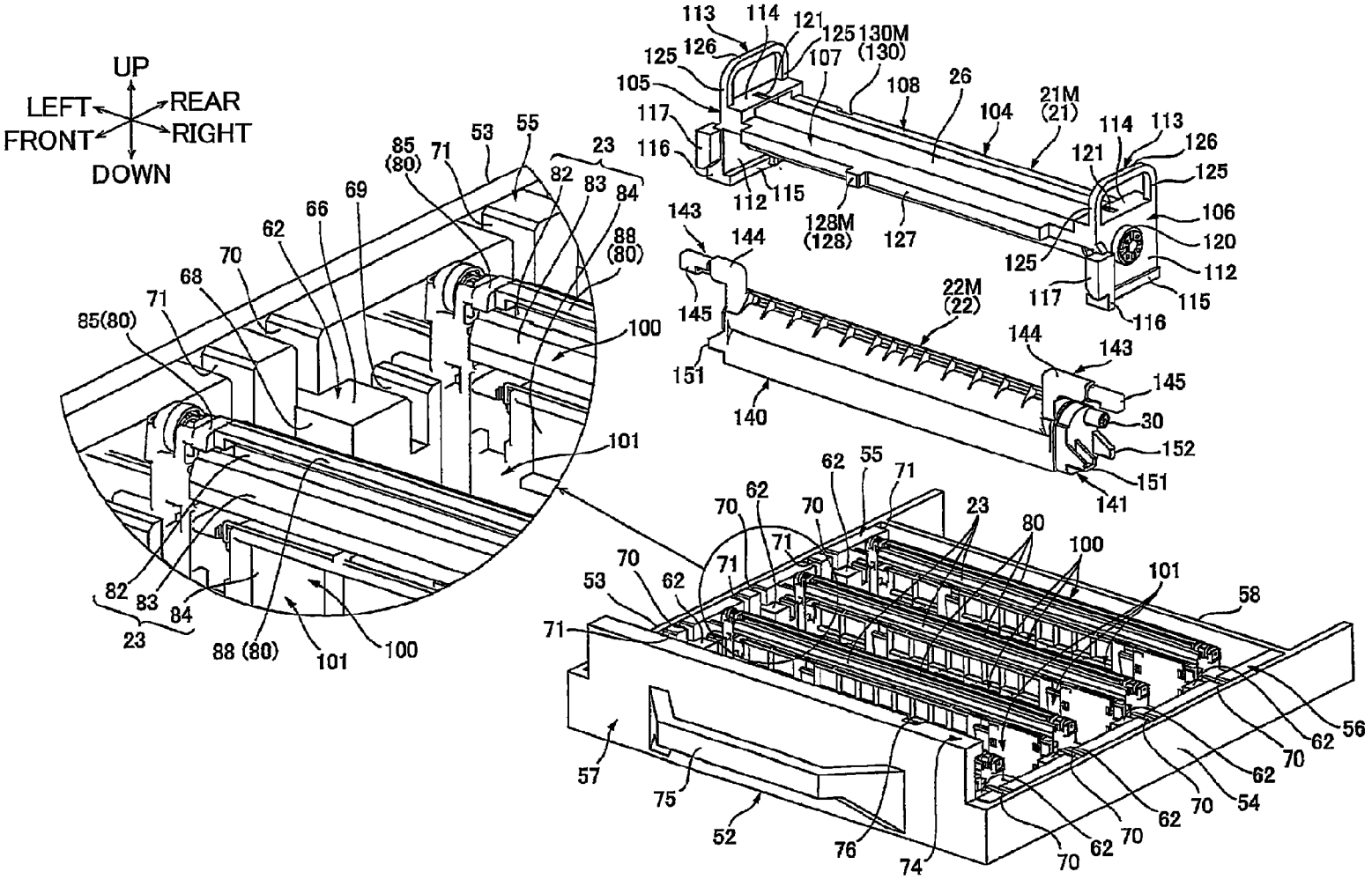
FIG. 2 is a perspective view of a process frame, a developing cartridge, and a drum cartridge those being components of the printer illustrated in FIG. 1 and as viewed from front and right side.

As illustrated in FIGS. 1 and 2, the process unit 16 is provided with a process frame 52 as an example of a supporting member.

The process frame 52 is configured so as to be movable relative to the main casing 2 in the frontward/rearward direction between an internal position where the process unit 16 is positioned inside the main casing 2 as illustrated in FIGS. 1 and 12, and an external position where the process unit 16 is positioned outside the main casing 2 as illustrated in FIG. 15. As described later in detail, the process frame 52 is configured such that when the process frame 52 is positioned in the internal position, the process frame 52 is also movable relative to the main casing 2 between a contact position where four photosensitive drums 26 are each in contact with the intermediate transfer belt 41 as illustrated in FIG. 12, and a separation position where the four photosensitive drums 26 are each apart from the intermediate transfer belt 41 as illustrated in FIG. 14. As illustrated in FIGS. 1 and 2, the process frame 52 has a general frame shape and is generally rectangular in a plan view. The process frame 52 has a process left wall 53 as an example of a side plate, a process right wall 54 as an example of the side plate, a left support wall 55, a right support wall 56, a process front wall 57, a process rear wall 58 and a process bottom wall 59.

Figure 3:
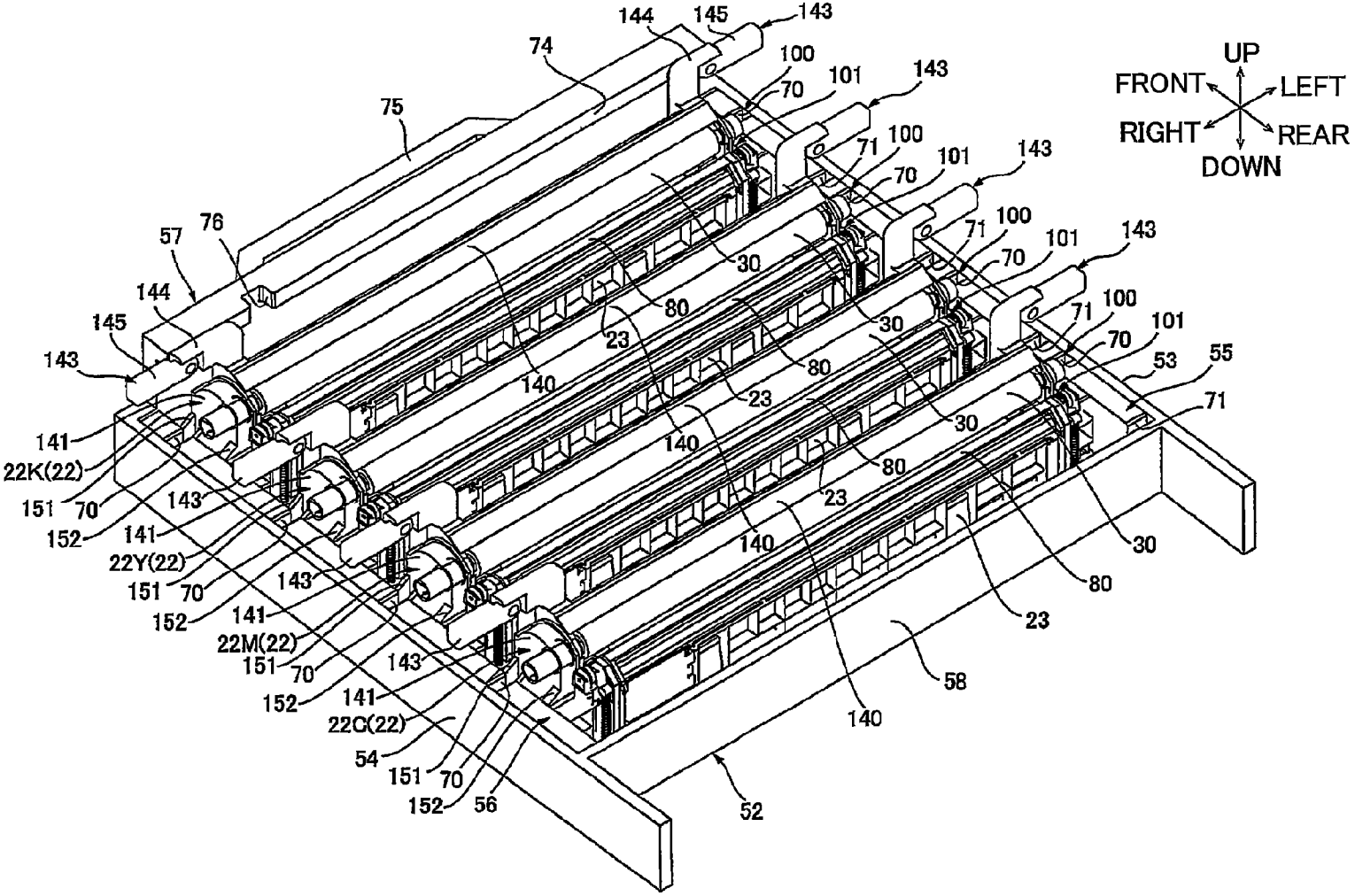
FIG. 3 is a perspective view illustrating a state where four developing cartridges are assembled to the process frame illustrated in FIG. 1.

As illustrated in FIGS. 2 and 3, the process left wall 53 and the process right wall 54 are arranged apart from each other in the leftward/rightward direction. Each of the process left wall 53 and the process right wall 54 has a general plate shape that is generally rectangular in a side view and that extends in the frontward/rearward direction.

The left support wall 55 is arranged adjacent to and inward of the process left wall 53 in the leftward/rightward direction. The right support wall 56 is arranged adjacent to and inward of the process right wall 54 in the leftward/rightward direction. Each of the left support wall 55 and the right support wall 56 has a general plate shape that is generally rectangular in a side view and that extends in the frontward/rearward direction.

The left support wall 55 has: a plurality of, i.e., four, bulged portions 62; a plurality of, i.e., four, first drum engagement grooves 70; and a plurality of, i.e., four, second drum engagement grooves 71.

In contrast with the left support wall 55, the right support wall 56 does not have the second drum engagement grooves 71. That is, the right support wall 56 has: the plurality of, i.e., four, bulged portions 62; and the plurality of, i.e., four, first drum engagement grooves 70.

The four bulged portions 62 are arranged at intervals in the frontward/rearward direction with gaps formed therebetween. Each bulged portion 62 has a general plate shape that is generally rectangular in a side view and that protrudes inwardly in the leftward/rightward direction from the inner surface in the leftward/rightward direction of each of the left support wall 55 and right support wall 56 at its lower portion. Each bulged portion 62 has an upper surface that is positioned at a vertical level lower than the upper surface of each of the left support wall 55 and the right support wall 56 and that is defined as a drum cartridge seat surface 66 on which the drum cartridge 21 is placed. Each bulged portion 62 is formed with a first developing engagement groove 68 and a second developing engagement groove 69.

The first developing engagement groove 68 is formed by cutting the bulged portion 62 from the front end portion of the drum cartridge seat surface 66 toward downward so as to form a general rectangular shape in a side view.

The second developing engagement groove 69 is a groove having a general U-shape in a side view that is depressed downward from the drum cartridge seat surface 66 of the bulged portion 62 at its the rear portion. The second developing engagement groove 69 has a vertical dimension generally equivalent to that of the first developing engagement groove 68.

The four first drum engagement grooves 70 are arranged at intervals in the frontward/rearward direction with gaps formed therebetween such that each of the four first drum engagement grooves 70 is positioned above a corresponding one of the four bulged portions 62. Each first drum engagement groove 70 is a groove having a general U-shape in a side view that is depressed downward from the upper surface of each of the left support wall 55 and the right support wall 56. Each first drum engagement groove 70 has a front end aligned with the rear end of the first developing engagement groove 68 of the corresponding bulged portion 62 in the frontward/rearward direction. Each first drum engagement groove 70 has a bottom end generally in flush with the drum cartridge seat surface 66 of the corresponding bulged portion 62.

The four second drum engagement grooves 71 are arranged at intervals in the frontward/rearward direction with gaps formed therebetween such that each of the four second drum engagement grooves 71 is positioned rearward of both of a corresponding one of the four bulged portions 62 and a corresponding one of the four first drum engagement grooves 70. Each second drum engagement groove 71 is a groove having a general U-shape in a side view that is depressed downward from the upper surface of the left support wall 55. The second drum engagement grooves 71 have vertical dimensions generally equivalent to those of the first drum engagement grooves 70.

Figure 8:
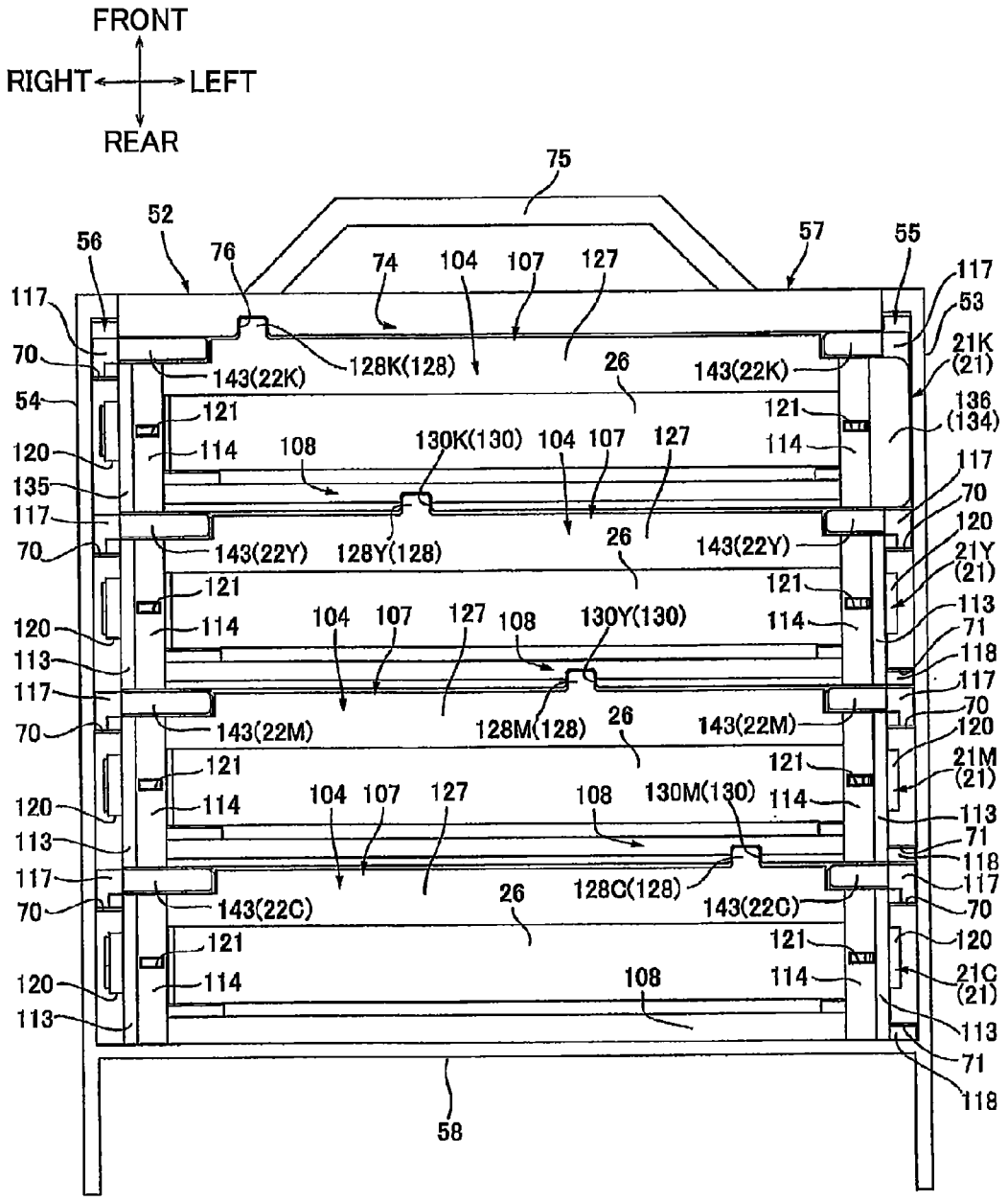
FIG. 8 is a plan view of a process unit in the printer depicted in FIG. 1.

As illustrated in FIGS. 2 and 8, the process front wall 57 spans between the front end portions of the process left wall 53 and the process right wall 54. The process front wall 57 has a general plate shape that is generally rectangular in a front view and that extends in the leftward/rightward direction. The process front wall 57 extends vertically so that the upper end portion of the process front wall 57 is at a vertical level higher than the upper end portions of the process left wall 53 and the process right wall 54. The process front wall 57 includes a process bending portion 74 and a process gripping portion 75.

The process bending portion 74 has a general plate shape that is generally rectangular in a plan view and that extends rearward from the upper edge of the process front wall 57. The process bending portion 74 is formed with a process recessed portion 76.

The process recessed portion 76 is formed at a right portion of the process bending portion 74. The process recessed portion 76 has a concave shape that is generally U-shaped in a plan view and that is depressed forward from the rear edge of the process recessed portion 76.

The process gripping portion 75 has a generally rectangular columnar shape that is generally U-shaped in a plan view with the opening of the U-shape oriented rearward. The process gripping portion 75 has left and right free end portions that are fixed to left and right portions of the process front wall 57, respectively.

As illustrated in FIGS. 3 and 8, the process rear wall 58 spans between the rear portions of the process left wall 53 and the process right wall 54. The process rear wall 58 has a general plate shape that is generally rectangular in a front view and that extends in the leftward/rightward direction.

As illustrated in FIGS. 1 and 3, the process bottom wall 59 spans between the lower end portions of the process left wall 53 and the process right wall 54. The process bottom wall 59 has a front end portion that is continuous with the lower end portion of the process front wall 57 and a rear end portion that is continuous with the lower end portion of the process rear wall 58. The process bottom wall 59 is provided with four LED units 23 and four cover units 80.

Figure 4A:
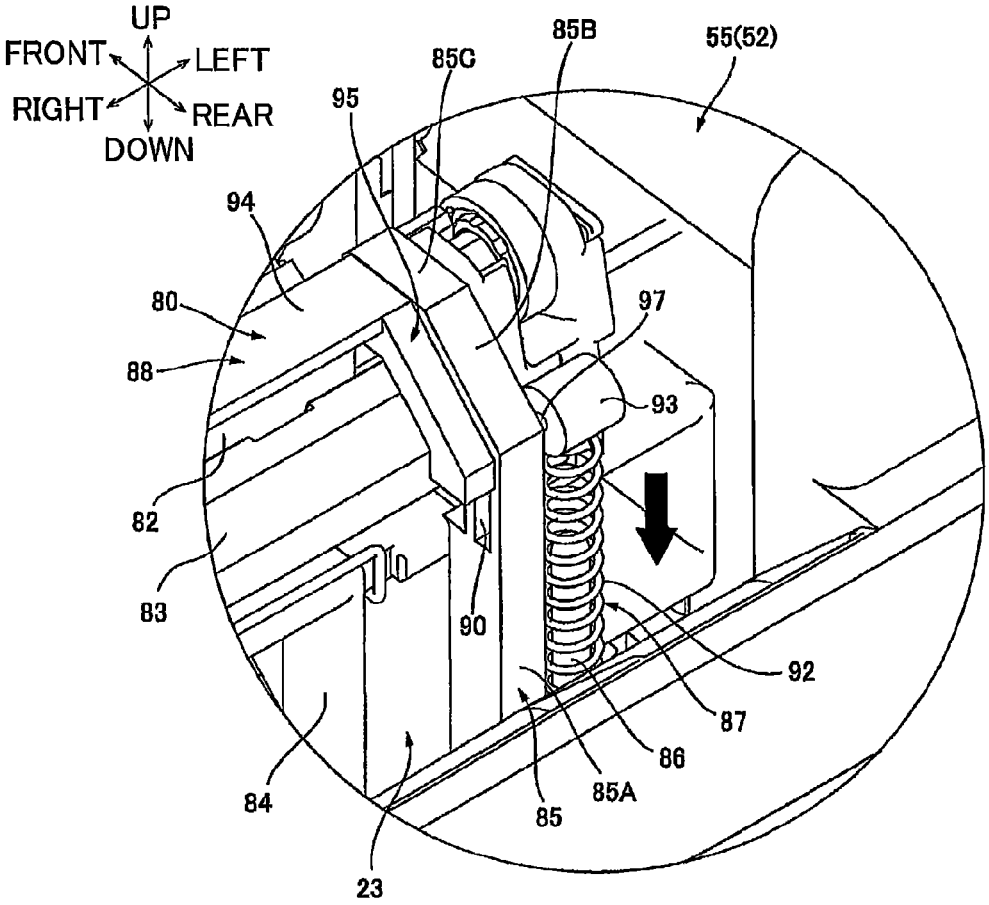
FIG. 4A is a partial enlarged view of an LED unit and a cover unit those depicted in FIG. 3, and illustrating a state where a cover portion is at a covering position.
Figure 4B:
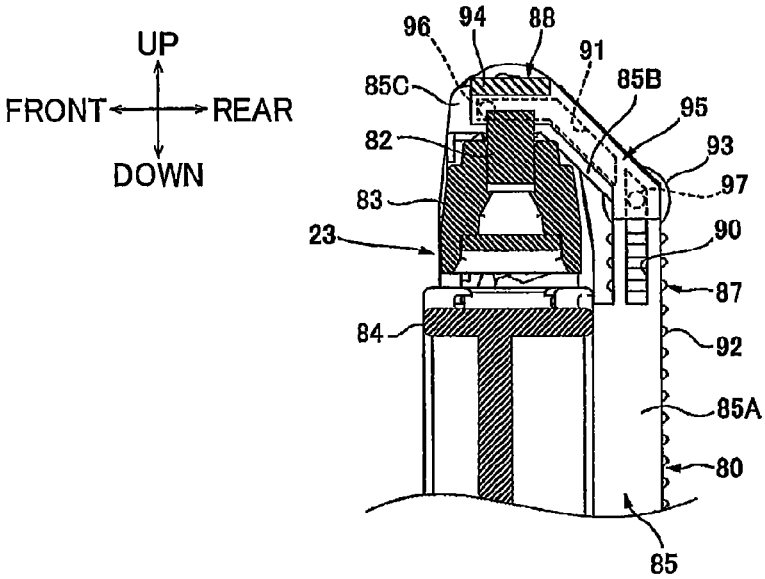
FIG. 4B is a side cross-sectional view of the LED unit and the cover unit those depicted in FIG. 4A.

As illustrated in FIGS. 1 and 2, each of the four LED units 23 is disposed between the left support wall 55 and the right support wall 56 and rearward of a corresponding one of the four bulged portions 62. As illustrated in FIGS. 4A and 4B, each LED unit 23 includes an LED array 82, an LED support portion 83, and a body portion 84.

The LED array 82 has a general rod shape extending in the leftward/rightward direction. The LED array 82 maintains, as an integral unit, a plurality of LEDs that are arranged in the leftward/rightward direction.

The LED support portion 83 has a rectangular frame shape extending in the leftward/rightward direction and having a closed bottom and an open top. The LED support portion 83 receives the LED array 82 in the inside of the LED support portion 83 such that the upper portion of the LED array 82 is exposed.

The body portion 84 is disposed below the LED support portion 83. The body portion 84 has a general plate shape that is generally rectangular in a front view and that extends in the leftward/rightward direction. The body portion 84 has an upper end portion continuous with the lower end portion of the LED support portion 83 and a lower end portion buried in the process bottom wall 59 as illustrated in FIG. 1.

As illustrated in FIGS. 3 and 4A, the four cover units 80 are arranged at intervals in the frontward/rearward direction with gaps formed therebetween. Each of the four cover units 80 is configured to cover the LED array 82 of a corresponding one of the four LED units 23. As illustrated in FIGS. 4A and 4B, the cover unit 80 includes: a pair of columnar support portions 85; a pair of column portions 86; a pair of urging portions 87; and a cover portion 88 as an example of a cover member.

The columnar support portions 85 are each disposed at each left-right end portion of the LED unit 23. Each columnar support portion 85 has a generally rectangular columnar shape that extends upwardly from the upper surface of the process bottom wall 59 along the rear surface of the body portion 84, and then bends forward so as to confront the upper surface of the LED support portion 83. Specifically, the columnar support portion 85 is configured of: a vertical portion 85A extending in the vertical direction; a sloped portion 85B extending from the upper end portion of the vertical portion 85A toward diagonally upward and forward; and a horizontal portion 85C extending from the upper front end portion of the sloped portion 85B toward the front. The columnar support portion 85 is formed with a first guide groove 90 and a second guide groove 91.

The first guide groove 90 is formed through the columnar support portion 85 in the leftward/rightward direction at the upper portion of the vertical portion 85A constituting the columnar support portion 85. The first guide groove 90 has a generally rectangular shape in a side view that is elongated in the vertical direction.

The second guide groove 91 is formed through the columnar support portion 85 in the leftward/rightward direction at a region extending from the sloped portion 85B to the horizontal portion 85C of the columnar support portion 85. The second guide groove 91 has a general V shape in a side view so as to be bent following the shapes of the sloped portion 85B and the horizontal portion 85C.

The column portions 86 are arranged adjacent to and outward of the columnar support portions 85 in the leftward/rightward direction. Each column portion 86 has a generally circular columnar shape extending upward from the upper surface of the process bottom wall 59. The column portion 86 has an upper end portion positioned at a vertical level slightly lower than the bottom end portion of the second guide groove Each urging portions 87 includes a compression spring 92 and a roller 93.

The compression spring 92 has a coil shape formed by winding a wiring member in a helical manner in the vertical direction. The urging portion 87 has a natural length greater than the vertical dimension of the column portion 86.

The roller 93 is connected to the upper end portion of the compression spring 92. The compression spring 92 has a generally circular cylindrical shape extending in the vertical direction.

The urging portion 87 is assembled to the column portion 86 such that the column portion 86 is inserted in the compression spring 92.

The cover portion 88 has a general U shape in a plan view. Specifically, the cover portion 88 integrally includes a cover body 94 and a pair of arm portions 95.

The cover body 94 has a general plate shape that is generally rectangular in a plan view and that extends in the leftward/rightward direction. The front-rear dimension of the cover body 94 is slightly greater than that of the LED array 82, and the left-right dimension of the cover body 94 is also slightly greater than that of the LED array 82.

The arm portions 95 are each provided at each left-right end portion of the cover body 94. The arm portions 95 are disposed inward of the columnar support portions 85 in the leftward/rightward direction. The arm portions 95 each have a generally rectangular columnar shape that has a first part extending in the frontward/rearward direction continuously from each left-right end portion of the cover body 94, a second part extending diagonally rearward and downward from a rear end portion of the first part, and a third part that is bent downward from a lower-rear end portion of the second part. Each arm portion 95 is provided with a first guide shaft 96 and a second guide shaft 97.

The first guide shaft 96 has a generally circular columnar shape extending outward in the leftward/rightward direction from the outer surface of the arm portion 95 in the leftward/rightward direction at the upper-front end thereof. The first guide shaft 96 has a left-right dimension smaller than that of the columnar support portion 85. The first guide shaft 96 is inserted into the second guide groove 91 of the columnar support portion 85.

The second guide shaft 97 has a generally circular columnar shape extending outward in the leftward/rightward direction from the outer surface of the arm portion 95 in the leftward/rightward direction at the lower-rear end thereof. The second guide shaft 97 has a left-right dimension greater than that of the columnar support portion 85. The second guide shaft 97 penetrates through the first guide groove 90 of the columnar support portion 85, and an outer end portion of the second guide shaft 97 in the leftward/rightward direction is inserted into the roller 93 of the urging portion 87.

In the cover unit 80 having the above-described configuration, the second guide shaft 97 of the cover portion 88 is urged upwardly by the urging force of the compression spring 92 of the urging portion 87.

Thus, the second guide shaft 97 is positioned at the upper end portion of the first guide groove 90, and the first guide shaft 96 is positioned at the upper front end portion of the second guide groove 91. At this time, the cover body 94 of the cover portion 88 is positioned at a covering position where the cover body 94 faces the LED array 82 from above.

Figure 5A:
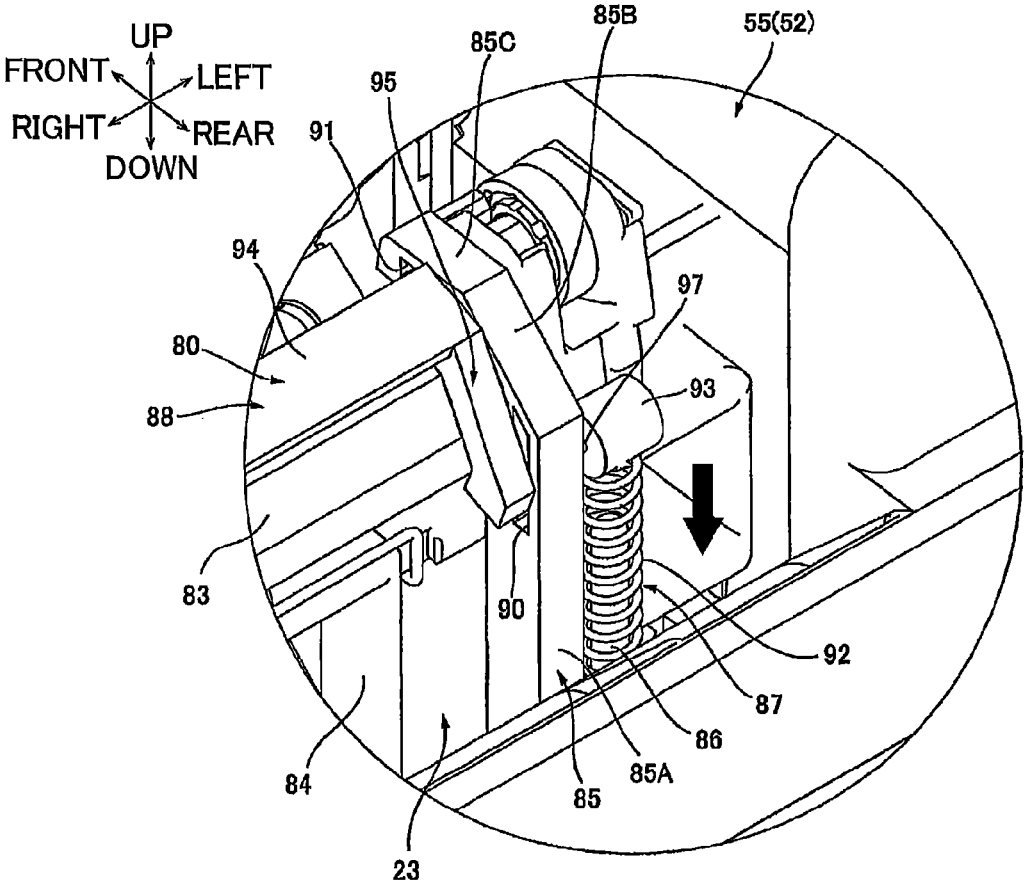
FIG. 5A is a partial enlarged view of the LED unit and the cover unit those depicted in FIG. 3, and illustrating a state where the cover portion is on its way between the covering position and an exposing position.
Figure 5B:
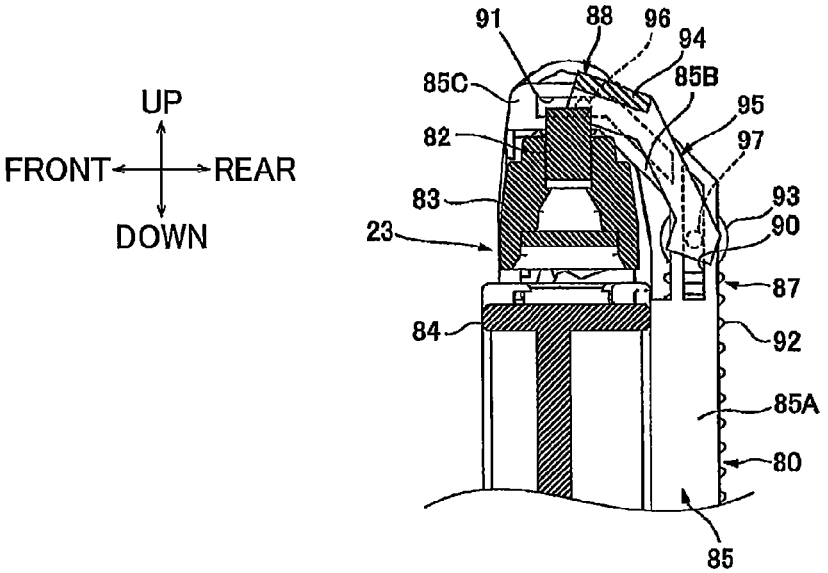
FIG. 5B is a side cross-sectional view of the LED unit and the cover unit those depicted in FIG. 5A.

As illustrated in FIGS. 5A and 5B, as the roller 93 moves downward against the urging force of the compression spring 92, the second guide shaft 97 moves to the approximate center of the second guide groove 91 in the vertical direction, and simultaneously the first guide shaft 96 moves rearward from the front end portion in the first guide groove 90. At this time, the cover body 94 of the cover portion 88 moves rearward and the front portion of the LED array 82 is exposed.

Figure 6A:
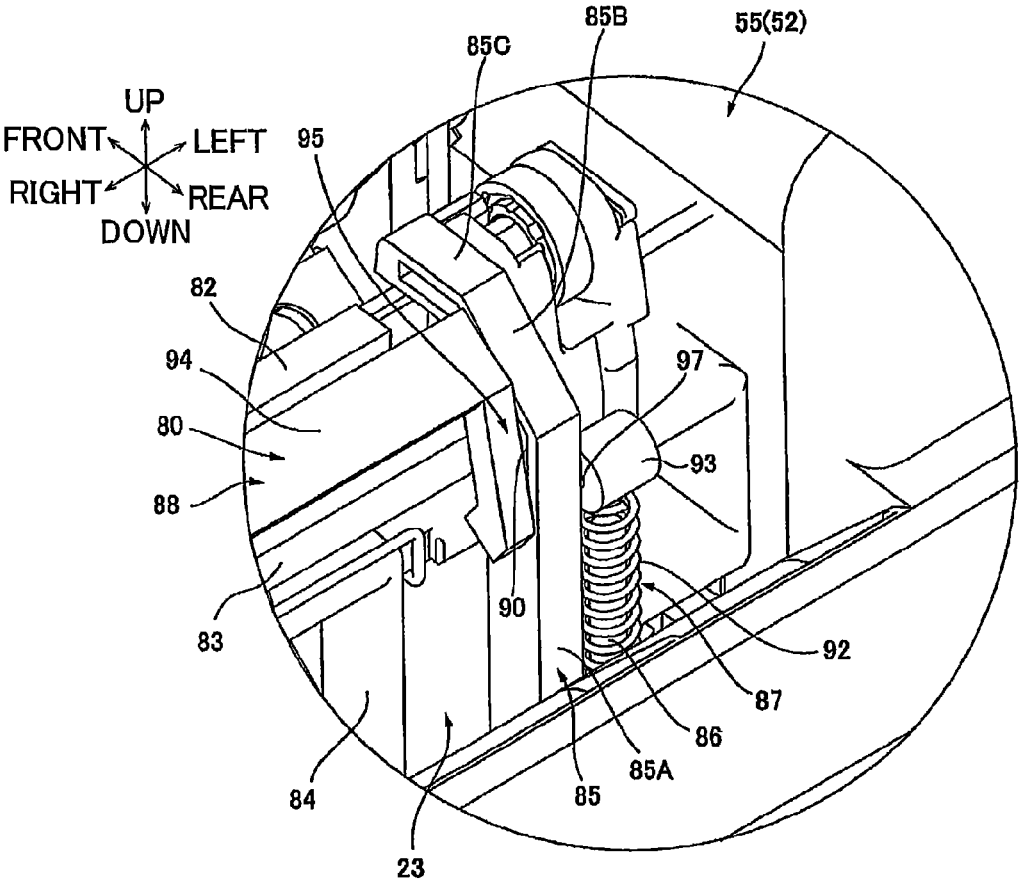
FIG. 6A is a partial enlarged view of the LED unit and the cover unit those depicted in FIG. 3, and illustrating a state where the cover portion is at the exposing position.
Figure 6B:
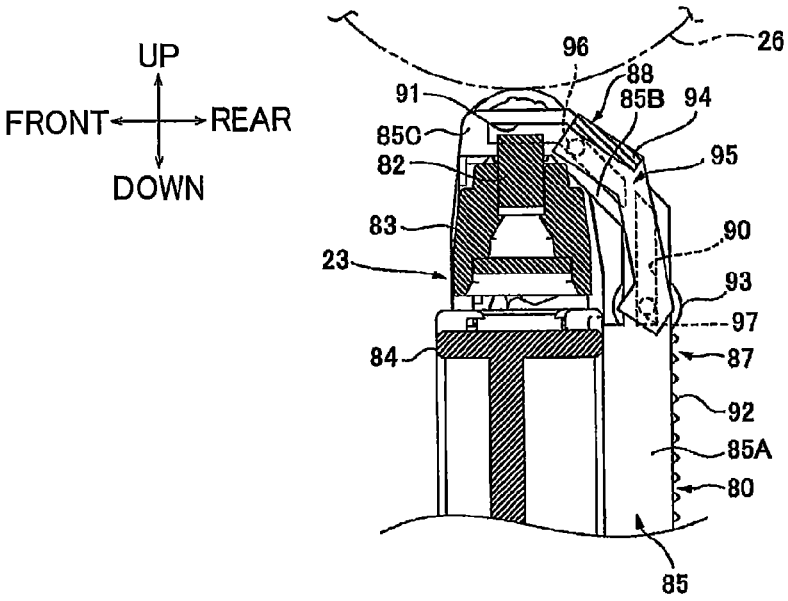
FIG. 6B is a side cross-sectional view of the LED unit and the cover unit those depicted in FIG. 6A.

Further, as illustrated in FIGS. 6A and 6B, when the roller 93 moves downward against the urging force of the compression spring 92, the second guide shaft 97 moves to the lower end portion of the first guide groove 90, and the first guide shaft 96 moves to the generally center portion of the second guide groove 91 in the frontward/rearward direction. At this time, the cover body 94 of the cover portion 88 moves further rearward to reach an exposing position at which the cover portion 88 exposes the LED array 82.

That is, in the cover unit 80, the cover portion 88 can move between the covering position and the exposing position. Here, the covering position is the position at which the cover portion 88 covers the LED array 82 as illustrated in FIGS. 4A and 4B. The exposing position is the position at which the cover portion 88 exposes the LED array 82 as illustrated in FIGS. 6*a* and 6B. Normally, the cover portion 88 is urged by a pair of urging portions 87 toward the covering position.

Incidentally, as illustrated in FIGS. 1 and 2, the process frame 52 defines four drum cartridge accommodating portions 100 and four developing cartridge accommodating portions 101.

Each of the four drum cartridge accommodating portions 100 is defined by each of the drum cartridge seat surfaces 66, each of the first drum engagement grooves 70, and each of the second drum engagement grooves 71. Namely, each drum cartridge accommodating portion 100 is formed above the drum cartridge seat surfaces 66 of the bulged portions 62, and in a side view, between one of the first drum engagement grooves 70 and a second drum engagement groove 71 that is positioned rearward of the one first drum engagement groove 70 on the left support wall 55.

That is, in each of the drum cartridge accommodating portions 100, a pair of first drum engagement grooves 70 is respectively disposed on the left and right sides of the drum cartridge accommodating portion 100, and one second drum engagement groove 71 on the left side. The pair of first drum engagement grooves 70 is an example of a pair of drum guide portions and is also an example of a guide portion. The second drum engagement groove 71 is an example of the guide portion.

Each of the four developing cartridge accommodating portions 101 is formed frontward of each of the four LED units 23, and between each of the four bulged portions 62 on the left support wall 55 and each of the four bulged portions 62 on the right support wall 56.

In each developing cartridge accommodating portion 101, a pair of bulged portions 62 is disposed respectively on the left and right sides of the developing cartridge accommodating portion 101. That is, a pair of first developing engagement grooves 68 are respectively disposed on the left and right sides of the developing cartridge accommodating portion 101, and a pair of second developing engagement grooves 69 are respectively disposed on the left and right sides of the developing cartridge accommodating portion 101. The pair of first developing engagement grooves 68 and the pair of second developing engagement grooves 69 are examples of a pair of developer guide portions.

The first drum engagement groove 70 is formed outward of the pair of first developing engagement grooves 68 and the pair of second developing engagement grooves 69 in the leftward/rightward direction.

3. Detail of Drum Cartridge (1) Configuration of Drum Cartridge

The drum cartridge 21 includes a drum frame 104 as illustrated in FIG. 1.

The drum cartridges 21 include four drums cartridges for four colors, i.e. black, yellow, magenta, and cyan. Each drum cartridge generally has the same configuration, and the difference is only in part. Thus, the common configuration in the four drum cartridges will be described hereinafter and the difference will be described occasionally.

Figure 7A:
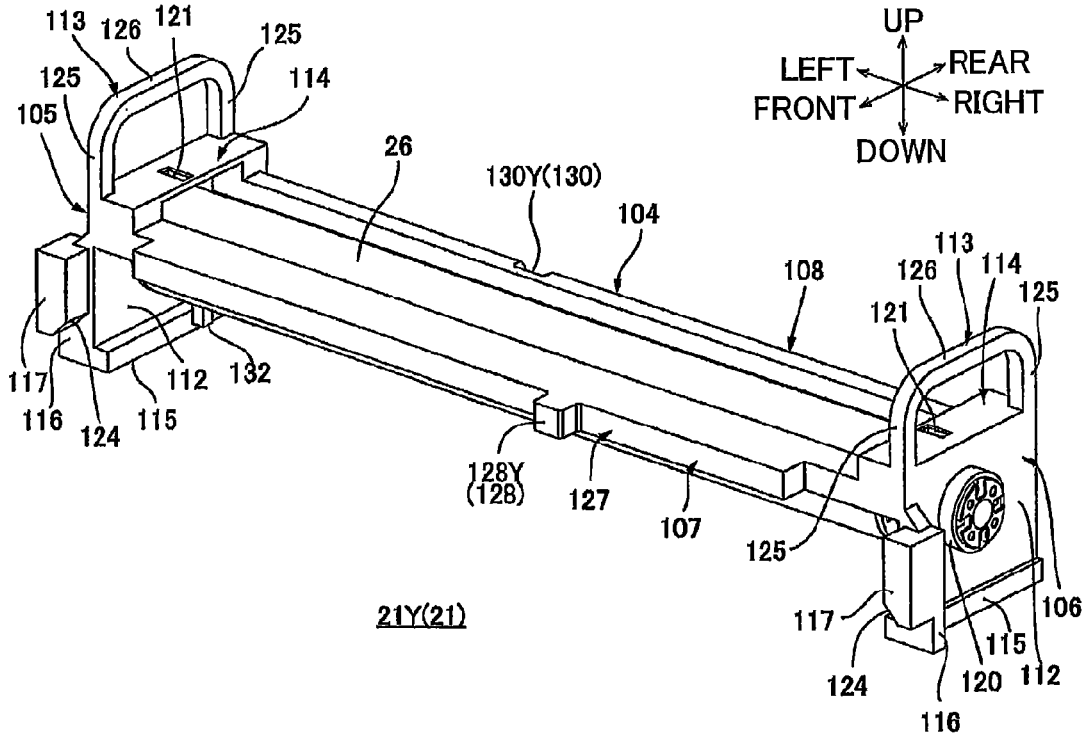
FIG. 7A is a perspective view of the drum cartridge depicted in FIG. 1 and as viewed from front upper side.
Figure 7B:
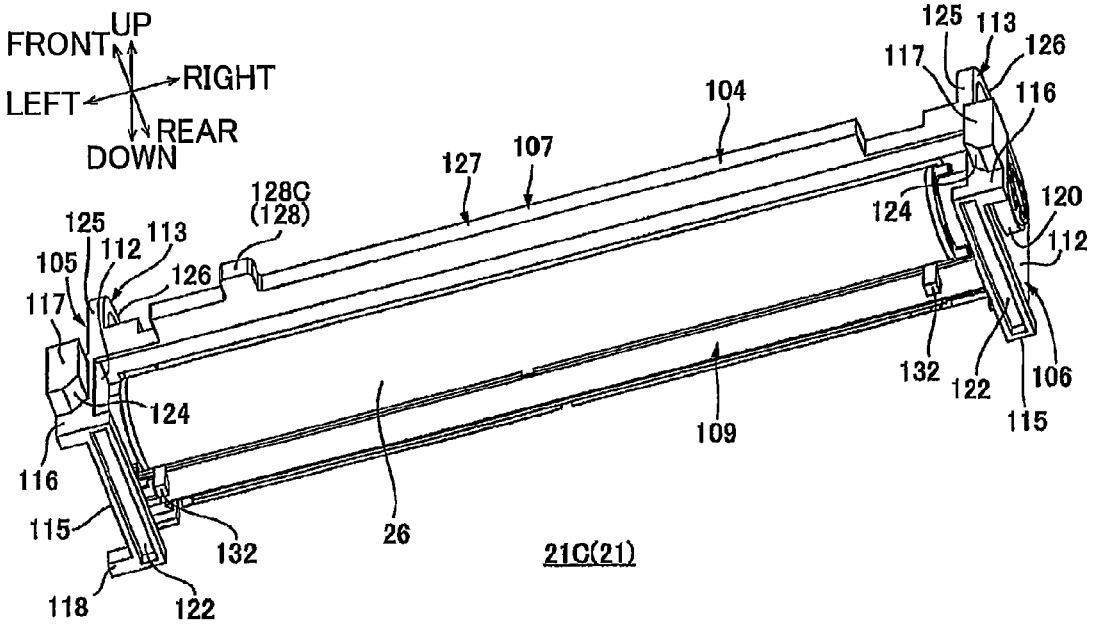
FIG. 7B is a perspective view of the drum cartridge depicted in FIG. 1 and as viewed from front lower side.

The drum frame 104 has a drum-frame left wall 105, a drum-frame right wall 106, a first connection wall 107, a second connection wall 108 and a charger support portion 109, as illustrated in FIGS. 7A and 7B.

The drum-frame left wall 105 and the drum-frame right wall 106 are disposed away from each other in the leftward/rightward direction.

The drum-frame left wall 105 has a drum side wall body 112, a drum bending portion 114, a mount portion 115, a first drum engagement portion 116, an abutment portion 117, and a second drum engagement portion 118.

The drum-frame right wall 106 has the drum side wall body 112, drum bending portion 114, mount portion 115, first drum engagement portion 116, and abutment portion 117. The drum-frame right wall 106 does not have the second drum engagement portion 118, and has a configuration different from that of the drum-frame left wall 105 in this respect.

The drum side wall body 112 has a generally plate shape extending in the vertical and frontward/rearward directions. The drum side wall body 112 has a drum support portion 120, and has a generally rectangular shape in side view.

The drum support portion 120 penetrates a generally center portion of the drum side wall body 112 in side view, and forms a generally circular shape in a side view. The drum support portion 120 has a generally cylindrical shape extending outward in the leftward/rightward direction from the peripheral portion of the penetrating part on the drum side wall body 112. The drum support portion 120 of the drum-frame left wall 105 and the drum support portion 120 of the drum-frame right wall 106 support left and right end portions of the photosensitive drum 26 that are inserted into the drum support portions 120. The photosensitive drum 26 has an upper end portion exposed between the first connection wall 107 and the second connection wall 108 and protruding higher than upper faces of the first connection wall 107 and the second connection wall 108. The first connection wall 107 and second connection wall 108 will be described later.

The drum bending portion 114 has a generally plate shape extending inward in the leftward/rightward direction from an upper end portion of the drum side wall body 112. The drum bending portion 114 is formed with the positioning hole 121 as an example of an engagement portion.

The positioning hole 121 is formed at a generally center portion in the frontward/rearward direction of the drum bending portion 114, and extends through a thickness of the drum bending portion 114 in the vertical direction. The positioning hole 121 is generally rectangular shaped in a cross-sectional view and extends the leftward/rightward direction. That is, the positioning hole 121 is in a concave shape recessed downward from an upper face of the drum bending portion 114.

The mount portion 115 is disposed at a lower end portion of the drum side wall body 112. The mount portion 115 has a generally rectangular column shape extending in the frontward/rearward direction. The mount portion 115 has a length in the leftward/rightward direction larger than that of the drum side wall body 112. Accordingly, the combination of the mount portion 115 and the drum side wall body 112 forms a generally T-shaped cross-section taken along a plane along the leftward/rightward and vertical directions. The mount portion 115 has a receiving groove 122.

The receiving groove 122 is a groove recessed upward from a lower face of the mount portion 115, and has a generally rectangular shape in a bottom view.

The first drum engagement portion 116 has a generally plate shape that extends from a front end portion of the drum side wall body 112 across the front end portion of the mount portion 115, and protrudes further outward in the leftward/rightward direction from the front end portions of the mount portion 115 and the drum side wall body 112. The first drum engagement portion 116 forms a generally rectangular shape in a front view.

The abutment portion 117 protrudes frontward from a front face of the first drum engagement portion 116, and has a generally rectangular column shape forming a generally rectangular shape in a front view. The abutment portion 117 has a chamfered portion 124.

The chamfered portion 124 is formed by cutting a part of the lower end portion of the abutment portion 117, the part being an inward part in the leftward/rightward direction.

The second drum engagement portion 118 has a generally rectangular column shape protruding leftward from a left face of the mount portion 115 of the drum-frame left wall 105 at its rear end portion.

Figure 19:
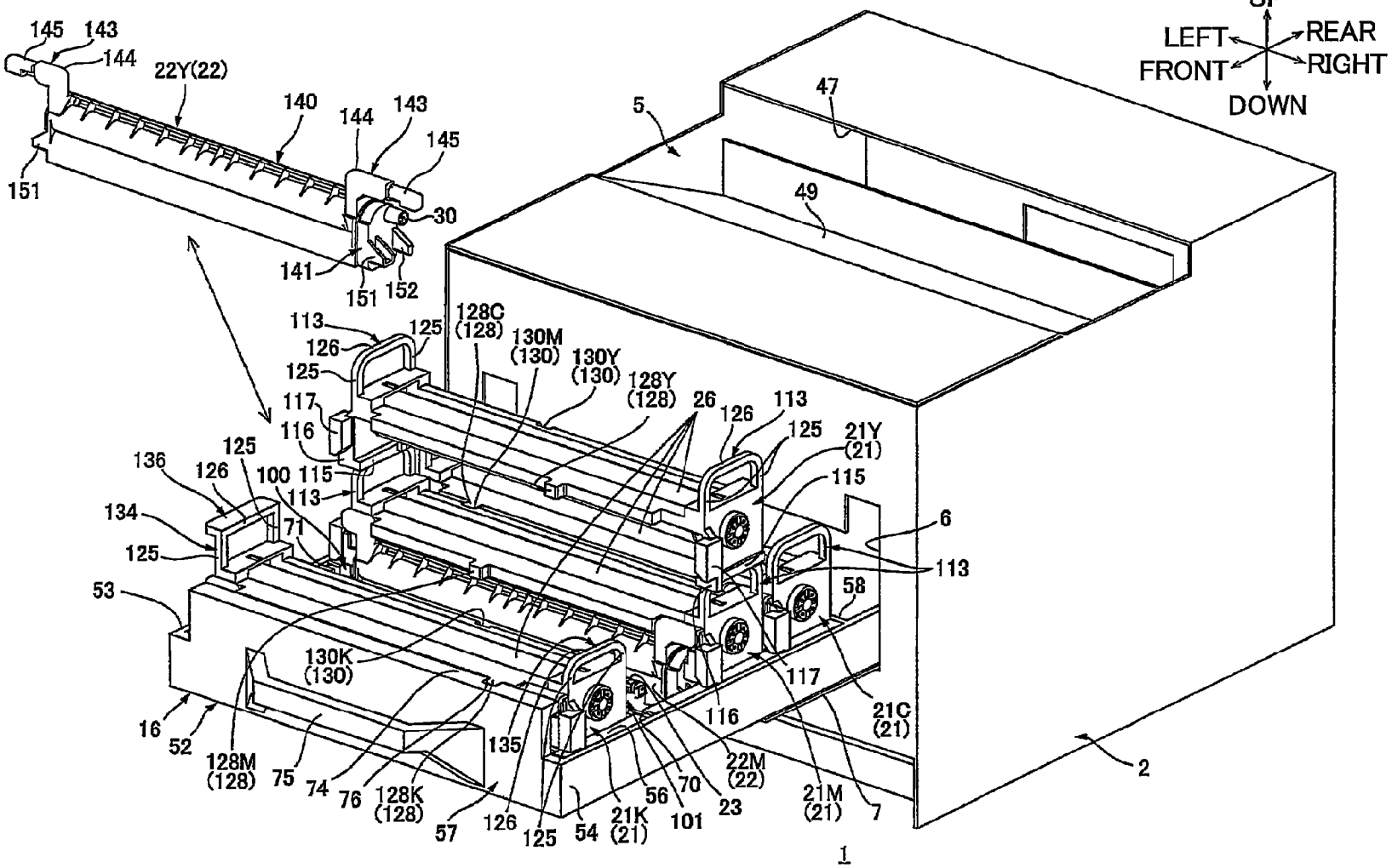
FIG. 19 is a view for description of attachment and detachment operation of the drum cartridge and the developing cartridge in the printer illustrated in FIG. 1.

Incidentally, each of the yellow drum cartridge 21Y, the magenta drum cartridge 21M, the cyan drum cartridge 21C, and the drum-frame right wall 106 has drum grip portions 113 on the drum-frame left wall 105 and the drum-frame right wall 106, respectively. The black drum cartridge 21K has a left black-drum grip portion 134 and a right black-drum grip portion 135 on the drum-frame left wall 105 and the drum-frame right wall 106, respectively, as illustrated in FIG. 19.

As illustrated in FIG. 7A, the drum grip portion 113 has a grip protruding portions 125 as an example of a protruding part, and has a grip connecting portion 126 as an example of a connecting part.

The pair of grip protruding portions 125 are disposed away from each other in the frontward/rearward direction. The grip protruding portion 125 has a generally rectangular column shape extending in the vertical direction. The pair of grip protruding portions 125 have lower end portions respectively fixed onto front and rear upper end portions of the drum side wall body 112. The pair of grip protruding portions 125 have upper end portions bending toward each other so that the distance therebetween is gradually smaller in the upward direction.

The grip connecting portion 126 has a generally rectangular column shape extending in the frontward/rearward direction, and connects the upper end portions of the pair of grip protruding portions 125.

Accordingly, the drum grip portion 113 has a generally U-shape having a lower open end in a side view. The drum grip portion 113 has a length in the leftward/rightward direction slightly smaller than that of the receiving groove 122 in the mount portion 115. The drum grip portion 113 is positioned outward in the leftward/rightward direction of the positioning hole 121.

Similarly to the drum grip portion 113, the left black-drum grip portion 134 has the pair of grip protruding portion 125 and the grip connecting portion 126, and has a generally rectangular column shape in a form of U-shape having a lower open end in side view as illustrated in FIG. 19. The left black-drum grip portion 134 has a flat plate portion 136.

The flat plate portion 136 has a generally plate shape in a plan view that protrudes leftward from the whole length in the frontward/rearward direction of the grip connecting portion 126 of the left black-drum grip portion 134.

Similarly to the drum grip portion 113, the right black-drum grip portion 135 has the pair of grip protruding portions 125 and the grip connecting portion 126, and has a generally rectangular column shape in a generally U-shape having a lower open end in a side view. The right black-drum grip portion 135 has a vertical length smaller than that of the drum grip portion 113.

As illustrated in FIGS. 7A and 7B, the first connection wall 107 spans between an upper end portion of the drum side wall body 112 of the drum-frame left wall 105 and an upper end portion of the drum side wall body 112 of the drum-frame right wall 106. The first connection wall 107 extends in the frontward/rearward direction. The first connection wall 107 has a generally plate shape having a front end portion bending downward to form a generally L-shape in a side cross-sectional view. The first connection wall 107 has an upper face positioned lower than an upper face of the drum bending portion 114. The first connection wall 107 and the drum side wall body 112 have front faces generally in flush with each other. The first connection wall 107 is provided with a projecting portion 127.

The projecting portion 127 protrudes frontward from the front face of the first connection wall 107 except leftmost and rightmost portions thereof. The projecting portion 127 has a generally ridge shape extending in the leftward/rightward direction. The projecting portion 127 has a drum convex portion 128.

The drum convex portion 128 has a convex shape having a generally rectangular cross-section and protruding frontward from the front face of the projecting portion 127.

As illustrated in FIG. 8, the drum convex portions 128 of the four drum cartridges 21 are disposed in different positions from each other in the leftward/rightward direction. Specifically, these drum convex portions 128 hereinafter will be referred to as black-drum convex portion 128K of the black drum cartridge 21K, yellow-drum convex portion 128Y of the yellow drum cartridge 21Y, magenta-drum convex portion 128M of the magenta drum cartridge 21M, and cyan-drum convex portion 128C of the cyan drum cartridge 21C.

The black-drum convex portion 128K is positioned on a right portion of the projecting portion 127.

The yellow-drum convex portion 128Y is positioned slightly rightward of a generally left-right center portion of the projecting portion 127. The yellow-drum convex portion 128Y is positioned leftward of the 128Y.

The magenta-drum convex portion 128M is positioned slightly leftward of a generally left-right center portion of the projecting portion 127. The magenta-drum convex portion 128M is positioned leftward of the yellow-drum convex portion 128Y.

The cyan-drum convex portion 128C is positioned on a left portion of the projecting portion 127. The x128*c* is positioned leftward of the magenta-drum convex portion 128M.

As illustrated in FIGS. 7A and 7B, the second connection wall 108 spans between the upper rear end portion of the drum side wall body 112 constituting the drum-frame left wall 105 and the upper rear end portion of the drum side wall body 112 constituting the drum-frame right wall 106. The second connection wall 108 has a generally rectangular column shape extending in the leftward/rightward direction. The second connection wall 108 is formed with a drum concave portion 130.

The drum concave portion 130 is recessed forward from the rear surface of the second connection wall 108, has a generally U-shape in a plan view.

As illustrated in FIG. 8, the drum concave portions 130 are formed on the four drum cartridges 21 at different positions in the leftward/rightward direction from one another, and have different configurations from one another. Specifically, as the drum concave portion 130, the black drum cartridge 21K is formed with a black-drum concave portion 130K, the yellow drum cartridge 21Y is formed with an yellow-drum concave portion 130Y, and the magenta drum cartridge 21M is formed with a magenta-drum concave portion 130M. The cyan drum cartridge 21C is formed with no drum concave portion 130.

The black-drum concave portion 130K is positioned slightly rightward from a generally left-right center portion of the second connection wall 108.

The yellow-drum concave portion 130Y is positioned slightly leftward from a generally left-right center portion of the second connection wall 108. The yellow-drum concave portion 130Y is positioned leftward of the black-drum concave portion 130K.

The magenta-drum concave portion 130M is positioned on a left portion of the second connection wall 108. The 130M is positioned leftward of the yellow-drum concave portion 130Y.

Figure 16B:
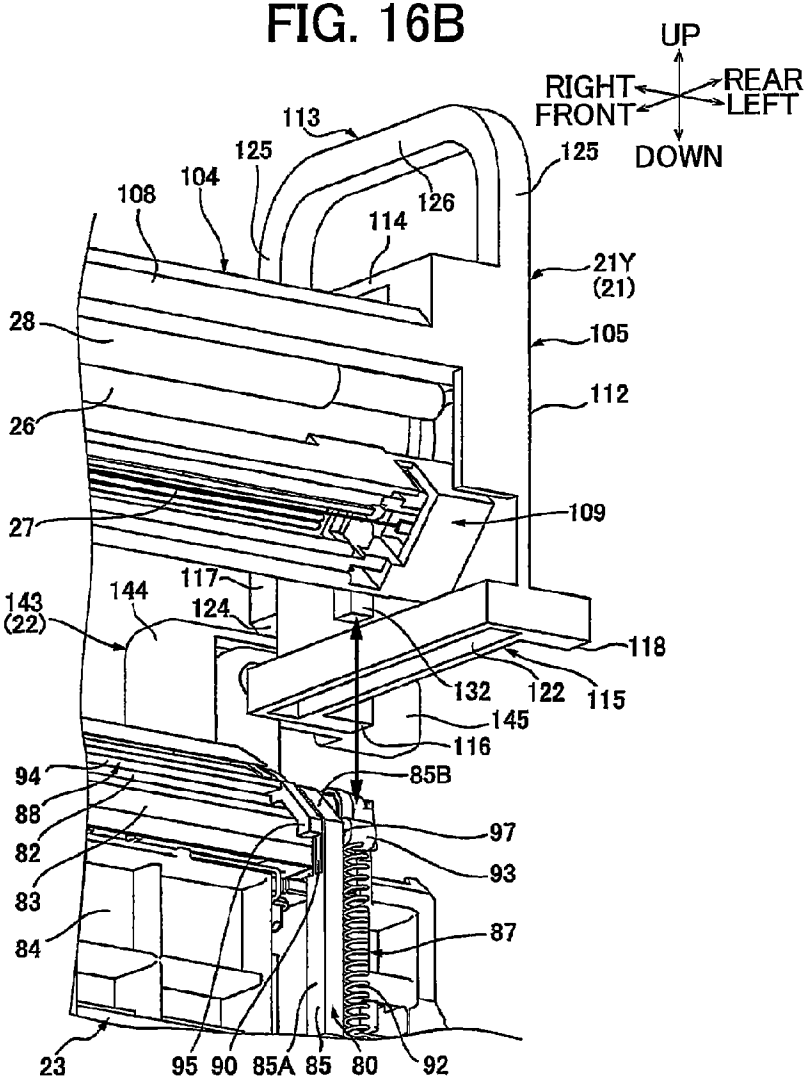
FIG. 16B is a view for description of operation of the cover unit depicted in FIG. 3, and illustrating a state subsequent to the state illustrated in FIG. 16A such that the cover portion of the cover unit is positioned at the covering position upon movement of the extending portion away from the urging portion.

As illustrated in FIGS. 7B and 16B, the charger support portion 109 is disposed below the second connection wall 108 and spans between the lower rear end portion of the drum side wall body 112 constituting the drum-frame left wall 105 and the lower rear end portion of the drum side wall body 112 constituting the drum-frame right wall 106. The charger support portion 109 has a general frame shape extending in the leftward/rightward direction. The charger support portion 109 has a generally U-shaped cross-section, with the opening of the U shape being directed frontward and upward. The charger support portion 109 includes the Scorotron charger 27 described above. The charger support portion 109 also includes a pair of extending portions 132.

The extending portions 132 are each provided at each left-right end portion of the charger support portion 109. Each extending portion 132 has a generally rectangular column shape protruding downward from the front lower surface of the charger support portion 109.

(2) State in which Drum Cartridges are Attached to the Process Frame and the Order in which the Drum Cartridges are Arranged in the Process Frame When each of four drum cartridges 21 is accommodated in the corresponding one of the drum cartridge accommodating portions 100 of the process frame 52, as illustrated in FIGS. 2 and 19, in the left side of the drum cartridge accommodating portion 100, the first drum engagement portion 116 is fitted from above into the first drum engagement groove 70 and the second drum engagement portion 118 is fitted from above into the second drum engagement groove 71, whereas in the right side, the first drum engagement portion 116 is fitted from above into the first drum engagement groove 70.

Accordingly, the drum cartridge 21 is accommodated in the drum cartridge accommodating portion 100 with the left mount portion 115 being placed on the drum cartridge seat surface 66 of the left bulged portion 62 and the right mount portion 115 being placed on the drum cartridge seat surface 66 of the right bulged portion 62.

Figure 16A:
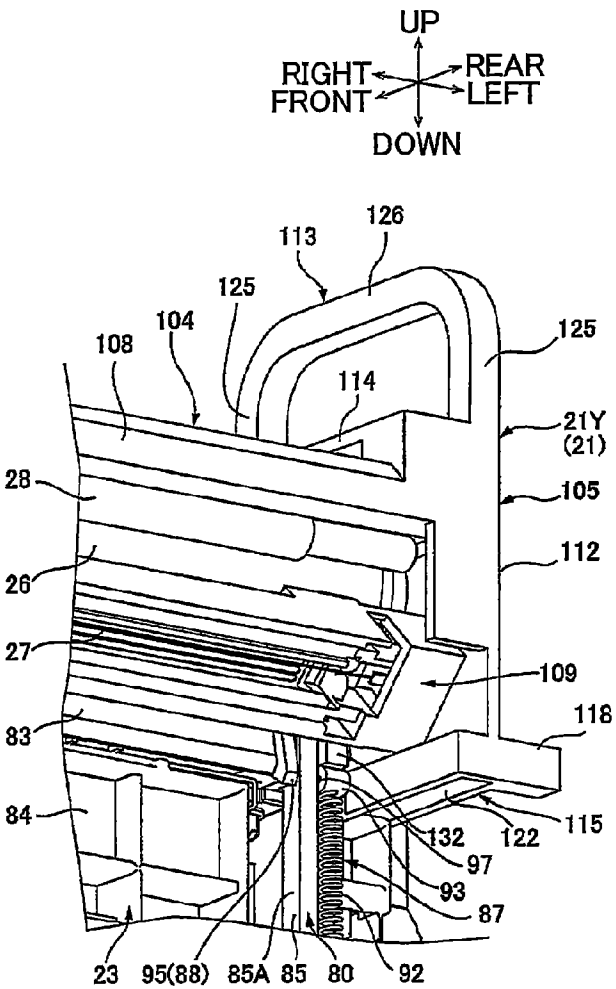
FIG. 16A is a view for description of operation of the cover unit depicted in FIG. 3, and illustrating a state where the cover portion of the cover unit is positioned at the exposing position upon abutment of an extending portion of the drum cartridge onto an urging portion.

At this time, as illustrated in FIG. 16A, the extending portions 132 of the drum cartridge 21 are in contact with the upper end portions of the rollers 93 of the corresponding cover units 80 and press the rollers 93 downward against the urging force of the compression springs 92.

With this arrangement, as illustrated in FIGS. 6A and 6B, the cover portions 88 are disposed at the exposing position and the LED units 23 and the photosensitive drums 26 are in confrontation with each other in the vertical direction.

As illustrated in FIG. 8, the four drum cartridges 21 are configured such that the order, in which the drum cartridges 21 are arranged in the drum cartridge accommodating portions 100 of the process frame 52 in the frontward/rearward direction, is fixed and cannot be unchanged.

Specifically, the process recessed portion 76 is provided on the process frame 52 and drum concave portions 130 are provided on the magenta drum cartridges 21M, 21Y, and 21K such that positions of the process recessed portion 76 and drum concave portions 130 are different from one another in the leftward/rightward direction. The drum convex portions 128 are provided on the four drum cartridges 21 such that the positions of the drum convex portions 128 are different from one another in the leftward/rightward direction.

The black drum cartridge 21K is accommodated in the forefront drum cartridge accommodating portion 100 such that the black-drum convex portion 128K is engaged with the process recessed portion 76 of the process frame 52.

The yellow drum cartridge 21Y is accommodated in the second drum cartridge accommodating portion 100, which is positioned next to the forefront drum cartridge accommodating portion 100, such that the yellow-drum convex portion 128Y is engaged with the 130K of the black drum cartridge 21K.

The magenta drum cartridge 21M is accommodated in the third drum cartridge accommodating portion 100, which is positioned next to the second drum cartridge accommodating portion 100 and rearward of the second drum cartridge accommodating portion 100, such that the magenta-drum convex portion 128M is engaged with the yellow-drum concave portion 130Y of the yellow drum cartridge 21Y.

The cyan drum cartridge 21C is accommodated in the rearmost drum cartridge accommodating portion 100 such that the cyan-drum convex portion 128C is engaged with the magenta-drum concave portion 130M of the magenta drum cartridge 21M.

With this arrangement, the four drum cartridges 21 are arrayed side by side in the frontward/rearward direction with no significant gaps between the drum cartridges 21. Specifically, the length of a gap between every two adjacent drum frames 104 in the frontward/rearward direction is, for example, larger than or equal to 0.5 mm and smaller than or equal to 8 mm, and preferably, larger than or equal to 2 mm and smaller than or equal to 5 mm.

In this state, the upper surface of the first connection wall 107 constituting the black drum cartridge 21K is in flush with the upper surface of the process bending portion 74 constituting the process frame 52 as illustrated in FIG. 1.

In every two adjacent drum cartridges 21 in the frontward/rearward direction, the upper surface of the second connection wall 108 constituting a front drum cartridge 21 that is disposed at the front side is in flush with the upper surface of the first connection wall 107 constituting a rear drum cartridge 21 that is disposed at the rear side.

As illustrated in FIG. 8, the cyan drum cartridge 21C, the magenta drum cartridge 21M, and the yellow drum cartridge 21Y are an example of a first drum cartridge, a second drum cartridge, and a third drum cartridge, respectively.

The cyan-drum convex portion 128C of the cyan drum cartridge 21C is an example of a first engaging part. The magenta-drum concave portion 130M of the magenta drum cartridge 21M engaged with the cyan-drum convex portion 128C is an example of a first engaged part.

The magenta-drum convex portion 128M of magenta drum cartridge 21M is an example of a second engaging part. The yellow-drum concave portion 130Y of the yellow drum cartridge 21Y engaged with the magenta-drum convex portion 128M is an example of a second engaged part.

The engagement position where the magenta-drum convex portion 128M is engaged with the yellow-drum concave portion 130Y is offset in the leftward/rightward direction from the engagement position where the cyan-drum convex portion 128C is engaged with the magenta-drum concave portion 130M.

The black-drum convex portion 128K of the forefront black drum cartridge 21K, which is disposed at the downmost stream position among the four drum cartridges 21 in a direction in which the process frame 52 moves from the internal position to the external position, is an example of a third engaging part. The process recessed portion 76 of the process frame 52 which is engaged with the black-drum convex portion 128K is an example of a third engaged part.

The engagement position where the black-drum convex portion 128K is engaged with the process recessed portion 76 is offset in the leftward/rightward direction from the engagement position where the cyan-drum convex portion 128C is engaged with the magenta-drum concave portion 130M.

4. Details of Developing Cartridge (1) Configuration of Developing Cartridge

Figure 9:
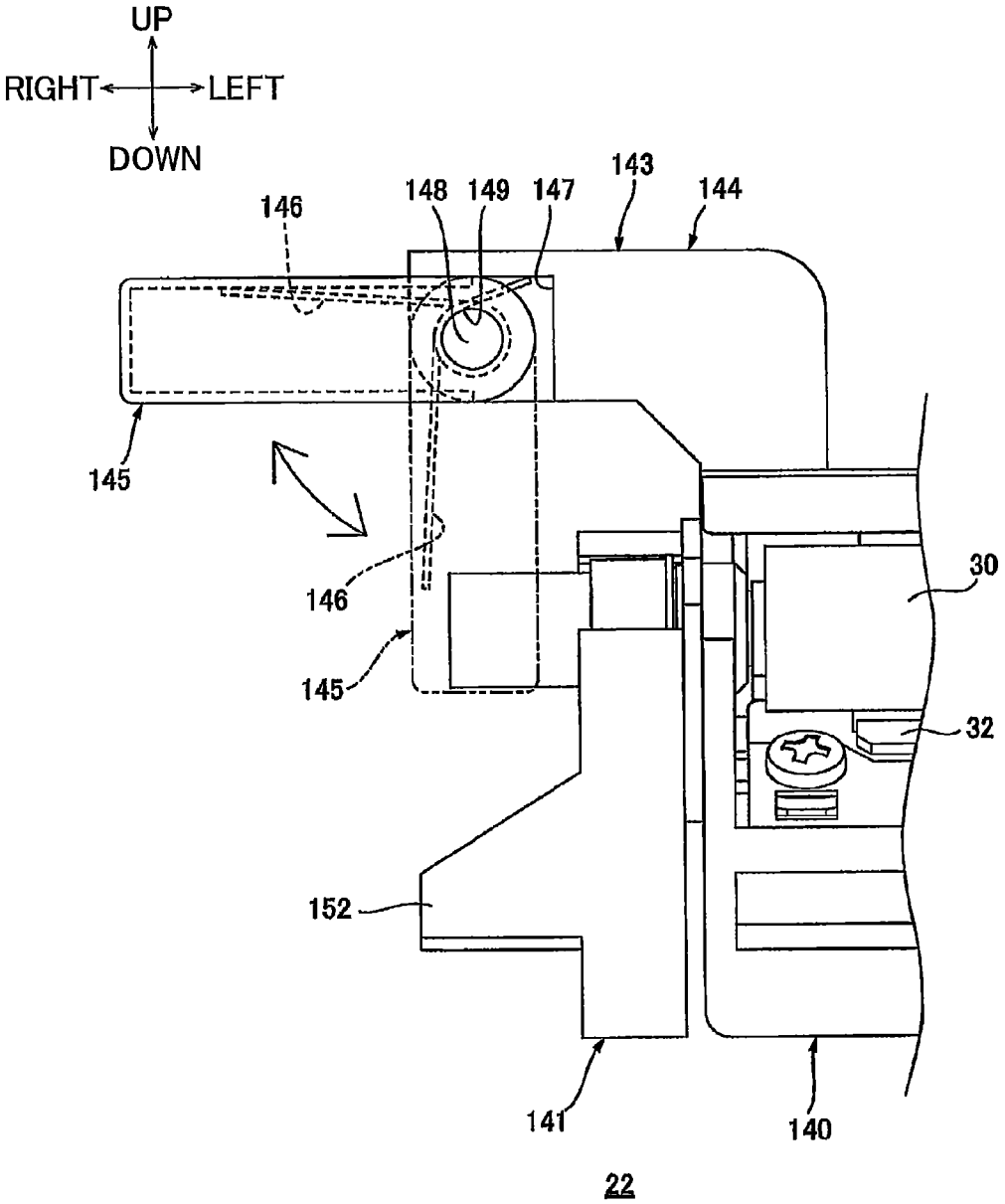
FIG. 9 is a view for description of operation of a pivot portion in the developing cartridge depicted in FIG. 2.

As illustrated in FIGS. 2 and 9, each of the developing cartridges 22 includes a developing frame 140 and a bearing member 141.

The developing frame 140 has a generally rectangular cylindrical shape extending in the leftward/rightward direction and has both left end right end portions closed. The upper rear portion of the developing frame 140 is formed with an opening elongated in the leftward/rightward direction and providing fluid communication between the interior and exterior of the developing frame 140. The upper rear end portion of the developing roller 30 is exposed through the opening of the developing frame 140. Further, the lower portion of the developing frame 140 is defined as the toner accommodating portion 33. The developing frame 140 is provided with a pair of developing grip portions 143.

The developing grip portions 143 each are provided at each left-right end portion of the developing frame 140. Each developing grip portion 143 includes a base portion 144, a pivot portion 145 serving an example of a moving portion, and a torsion spring 146 serving as an example of an urging member.

The base portion 144 has a generally rectangular columnar shape that is generally in an L shape in a front view. The base portion 144 protrudes upward from the upper surface of the developing frame 140 at its left-right end portion, and then extends outward in the leftward/rightward direction. As illustrated in FIG. 8, the distance between a right end portion of the left base portion 144 and a left end portion of the right base portion 144 is slightly larger than the left-right dimension of the projecting portion 127 constituting the drum cartridge 21. The distance between a left end portion of the left base portion 144 and a right end portion of the right base portion 144 is generally equal to the distance between the right surface of the left abutment portion 117 and the left surface of the right abutment portion 117. As illustrated in FIG. 9, the base portion 144 includes a receiving portion 147 and a shaft portion 148.

The receiving portion 147 is formed at the outward end of the base portion 144 in the leftward/rightward direction. The receiving portion 147 is recessed from the rear side to the front side, and has generally rectangular shape in a rear view.

The shaft portion 148 has generally a cylindrical shape protruding rearward from the front surface of the receiving portion 147. The rear end of the shaft portion 148 is disposed generally at a position the same as the position of the rear end of the base portion 144 in the frontward/rearward direction.

The pivot portion 145 has generally an elongated hollow rectangular column shape having its terminal end closed. The pivot portion 145 is formed with a through-hole 149.

The through-hole 149 is formed through a base end portion of the pivot portion 145 and has generally a circular shape in a rear view.

The pivot portion 145 is assembled to the base portion 144 by the shaft portion 148 being received in the through-hole 149 so as to pivot between a protruding position and an accommodated position about the shaft portion 148. In the protruding position as indicated by the solid line in FIG. 9, the pivot portion 145 extends outwardly in the leftward/rightward direction so that the terminal end of the pivot portion 145 is relatively farther away from the developing frame 140. In the accommodated position, as indicated by the two-dot chain line in FIG. 9, the pivot portion 145 extends downwardly so that a distance between developing frame 140 and the terminal end of the pivot portion 145 becomes smaller than that in the protruding position. That is, when the pivot portion 145 is at the accommodated position, the pivot portion 145 extends vertically so that the terminal end of the pivot portion 145 is relatively closer to the developing frame 140 than when the pivot portion 145 is positioned at the protruding position.

Figure 18:
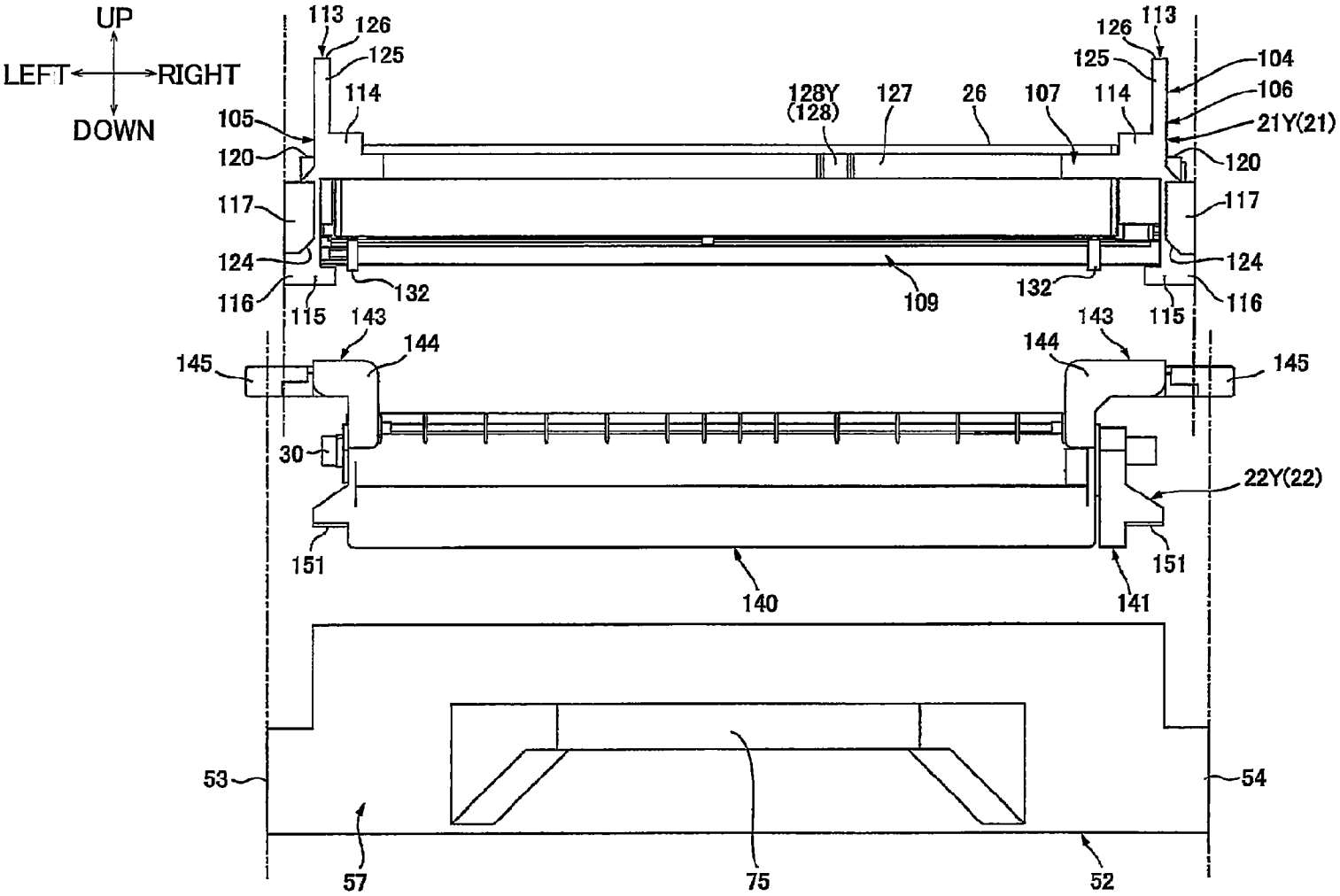
FIG. 18 is a front view of the process frame, the developing cartridge and the drum cartridge those illustrated in FIG. 2.

As illustrated in FIG. 18, when both the left pivot portion 145 and the right pivot portion 145 are at the protruding positions, a distance between a left end of the left pivot portion 145 and a right end of the right pivot portion 145 is greater than the leftward/rightward dimension of the process frame 52.

When the left and right pivot portions 145 are positioned at the protruding positions, the pivot portions 145 are located above the process left wall 53 and the process right wall 54, respectively, and the left pivot portion 145 and the right pivot portion 145 are overlapped with the process left wall 53 and the process right wall 54, respectively, when viewed from above.

As illustrated in FIG. 9, the torsion spring 146 is a wire rod spirally wound into a coil shape. The torsion spring 146 is mounted inside the pivot portion 145 such that the shaft portion 148 is inserted through the torsion spring 146, with one end of the wire rod in the torsion spring 146 connecting the top surface of the receiving portion 147 from below and an opposite end of the torsion spring 146 contacting the inner surface of the pivot portion 145 from below. According to the configuration, the torsion spring 146 urges the pivot portion 145 in a direction from the accommodated position to the protruding position.

As illustrated in FIGS. 2 and 9, the bearing member 141 is disposed at the right side of the developing frame 140. The bearing member 141 has generally a thick plate shape extending in both the frontward/rearward direction and in the vertical direction. The bearing member 141 includes a first developing engagement portion 151 and a second developing engagement portion 152.

The first developing engagement portion 151 protrudes rightward from the front lower end of the bearing member 141. The first developing engagement portion 151 is generally plate shaped having generally U-shape in a side view. The upper surface of the first developing engagement portion 151 slopes diagonally downward and rightward.

The second developing engagement portion 152 protrudes rightward from the rear lower end of the bearing member 141, and has generally a rectangular columnar shape. The upper surface of the second developing engagement portion 152 extends diagonally downward and rightward.

The developing frame 140 is further provided with the first developing engagement portion 151 and the second developing engagement portion 152 on the left side of the developing frame 140. The first developing engagement portion 151 and the second developing engagement portion 152 on the left side of the developing frame 140 are respectively symmetric with the first developing engagement portion 151 and the second developing engagement portion 152 on the right side of the bearing member 141 with respect to a generally center line that passes through the center of the developing cartridge 22 in the leftward/rightward direction in a plan view.

In other words, the developing cartridge 22 includes a pair of the first developing engagement portions 151 and a pair of the second developing engagement portions 152.

(2) Mounted State of the Developer Cartridge to the Process Frame

As illustrated in FIGS. 2 and 3, when each of the developing cartridges 22 is accommodated in the corresponding developing cartridge accommodating portion 101 of the process frame 52, the pair of first developing engagement portions 151 is fitted into the pair of first developing engagement grooves 68 from above and the pair of second developing engagement portion 152 is fitted into the pair of second developing engagement groove 69 from the above.

Accordingly, the developing cartridge 22 is accommodated in the developing cartridge accommodating portion 101 while being supported by the left bulged portion 62 and the right bulged portion 62.

Figure 17A:
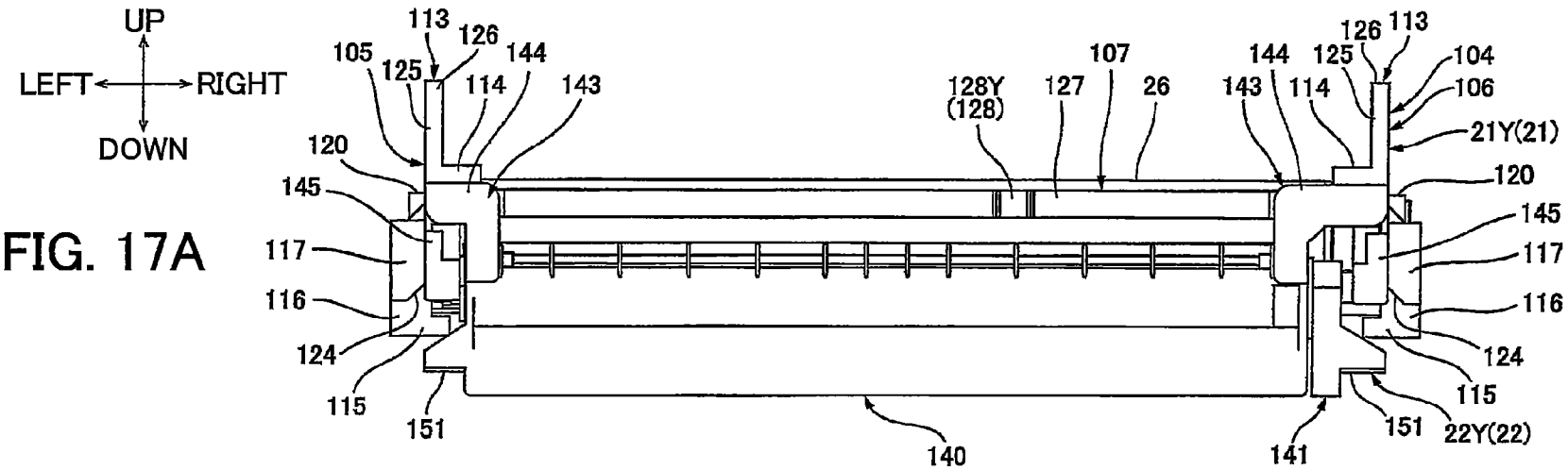
FIG. 17A is a view for description of operation of developing grip portions of the developing cartridge depicted in FIG. 2, and illustrating a state where the pivot portions are at accommodated positions.

When both of the developing cartridge 22 and the drum cartridge 21 are mounted on the process frame 52, as illustrated in FIG. 17A, the developing cartridge 22 is disposed below the drum cartridge 21, and the abutment portion 117 of the drum cartridge 21 is in abutment with the pivot portion 145 of the developing grip portion 143 provided in the developing cartridge 22.

Accordingly, in the pair of the developing grip portions 143, the pivot portions 145 are positioned at the accommodated positions against the urging force of the torsion springs 146.

5. Details of the Belt Unit

Figure 10:
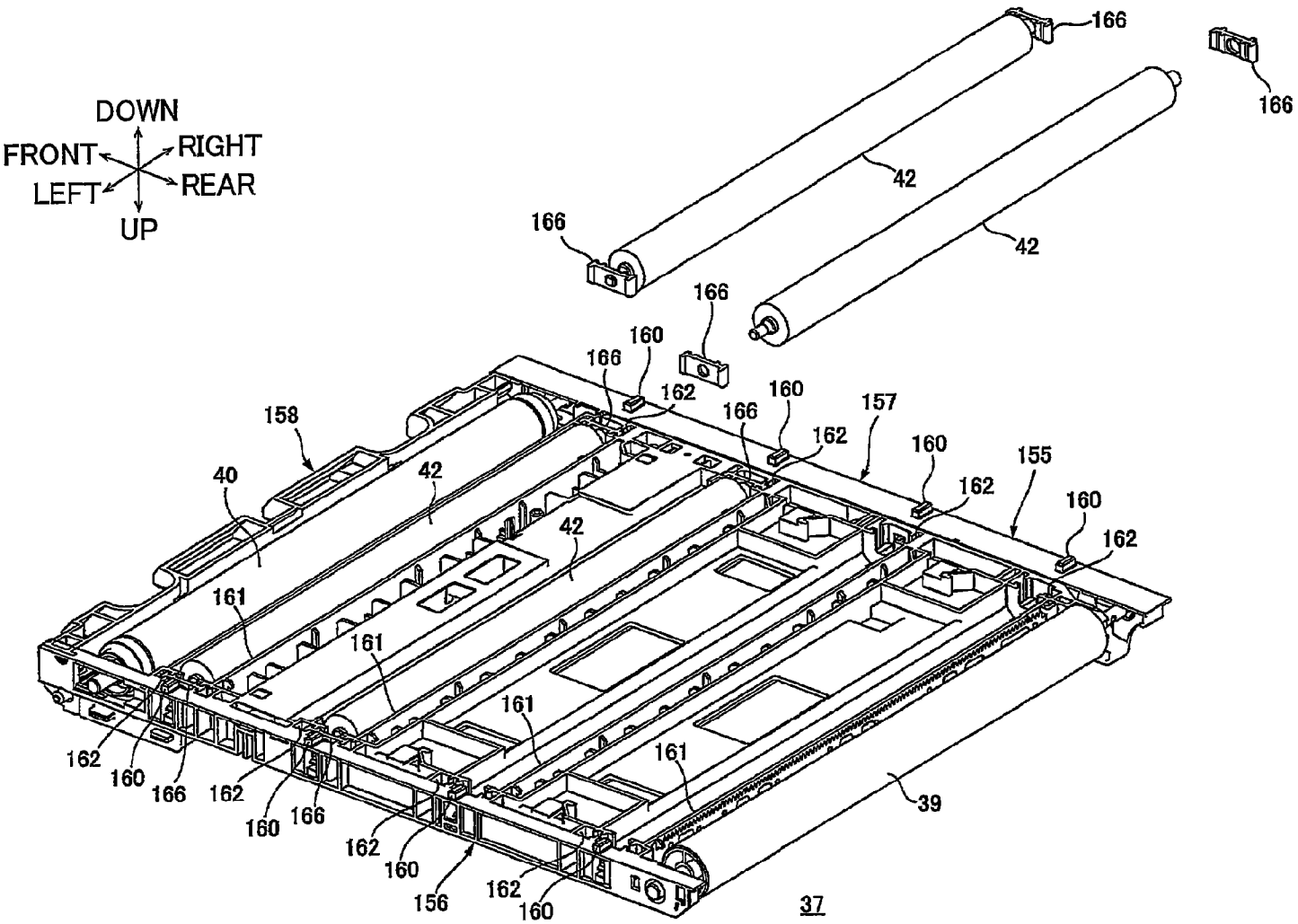
FIG. 10 is an exploded perspective view of a belt unit in the printer depicted in FIG. 1 and as viewed from rear lower side.
Figure 11:
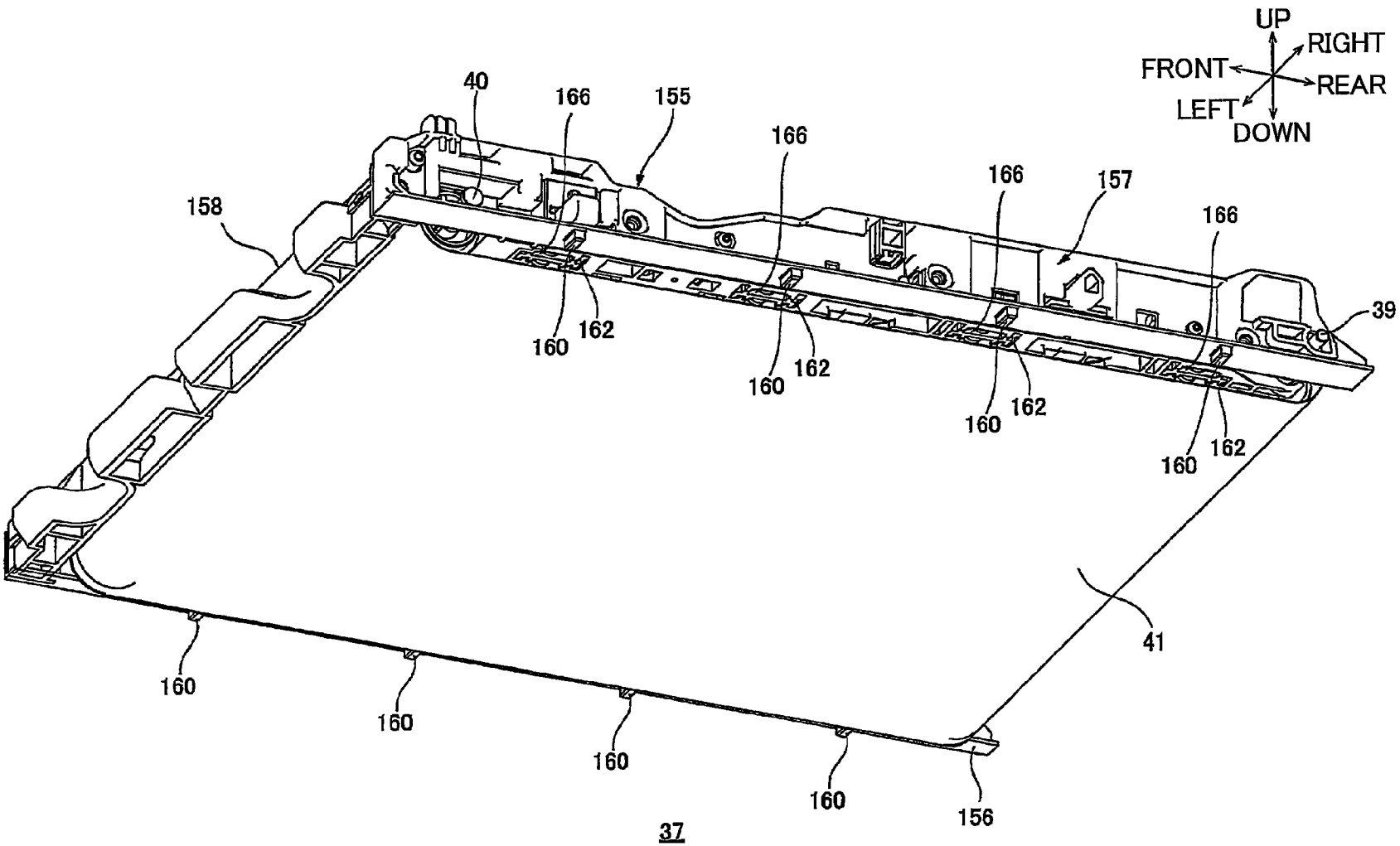
FIG. 11 is a perspective view of the belt unit as viewed from front lower side.

As illustrated in FIGS. 10 and 11, the belt unit 37 includes a belt frame 155 and four pairs of brackets 166.

The belt frame 155 integrally includes a belt left wall 156, a belt right wall 157, and a belt frame body 158.

The belt left wall 156 and the belt right wall 157 are arranged with a gap therebetween in the leftward/rightward direction. Each of the belt left wall 156 and the belt right wall 157 has generally a plate shape extending in the frontward/rearward direction and having generally rectangular shape in a side view. Each of the belt left wall 156 and the belt right wall 157 is formed with four positioning protrusions 160 as examples of positioning portions.

The four positioning protrusions 160 are arranged with gaps therebetween in the frontward/rearward direction. Each of the positioning protrusions 160 has a convex shape protruding downward from a bottom surface of corresponding one of the belt left wall 156 and the belt right wall 157, and having generally a rectangular cross-section. In other words, four pairs of the positioning protrusions 160 are arranged in the belt frame 155. When the process frame 52 with the drum cartridge 21 being mounted thereto is positioned at the internal position, the four pairs of the positioning protrusions 160 are positioned inward of the pair of drum grip portions 113 of the four drum cartridges 21 in the leftward/rightward direction.

The belt frame body 158 is bridged between the belt left wall 156 and the belt right wall 157. The belt frame body 158 has a substantial plate generally formed in a rectangular shape in the plane view. The belt frame body 158 includes four transfer roller accommodating portions 161 and four pairs of the bracket accommodating portions 162.

The four transfer roller accommodating portions 161 are arranged with gaps therebetween in the frontward/rearward direction. Each transfer roller accommodating portion 161 has generally a semi-cylindrical shape whose lower side is opened.

Each pair of the bracket accommodating portions 162 is positioned at a pair of ends of a corresponding one of the transfer roller accommodating portions 161 in the leftward/rightward direction. The bracket accommodating portion 162 is recessed upwardly from the bottom surface of the belt frame body 158, and has a generally rectangular shape in a plan view.

Each pair of the brackets 166 is positioned at a pair of ends of the primary transfer roller 42 in the leftward/rightward direction. The bracket 166 is in a generally a plate shape extending in the frontward/rearward direction and having generally a rectangular shape in a side view. The bracket 166 is accommodated in the bracket accommodating portion 162 so as to be movable relative to the belt frame 155 in the vertical direction. A through-hole is formed in the bracket 166 at the center thereof in a side view. The through-hole is generally circular in a side view.

Each pair of the brackets 166 receives a pair of opposite ends of a corresponding one of the primary transfer rollers 42 in the leftward/rightward direction, and is accommodated in the corresponding pair of bracket accommodating portion 162, whereby each of the four primary transfer rollers 42 is accommodated in the corresponding transfer roller accommodating portion 161.

Accordingly, the four primary transfer rollers 42 are arranged in the frontward/rearward direction with gaps therebetween such that the four primary transfer rollers 42 are movable relative to the belt frame 155 in the vertical direction.

The drive roller 39 is rotatably supported at a rear end portion of belt frame 155, and the follower roller 40 is rotatably supported at the front end portion of belt frame 155. The intermediate transfer belt 41 is wound and stretched around the drive roller 39 and the follower roller 40. That is, the belt frame 155 supports the intermediate transfer belt 41.

6. Mounted State of the Process Unit to the Main Casing

Figure 13:
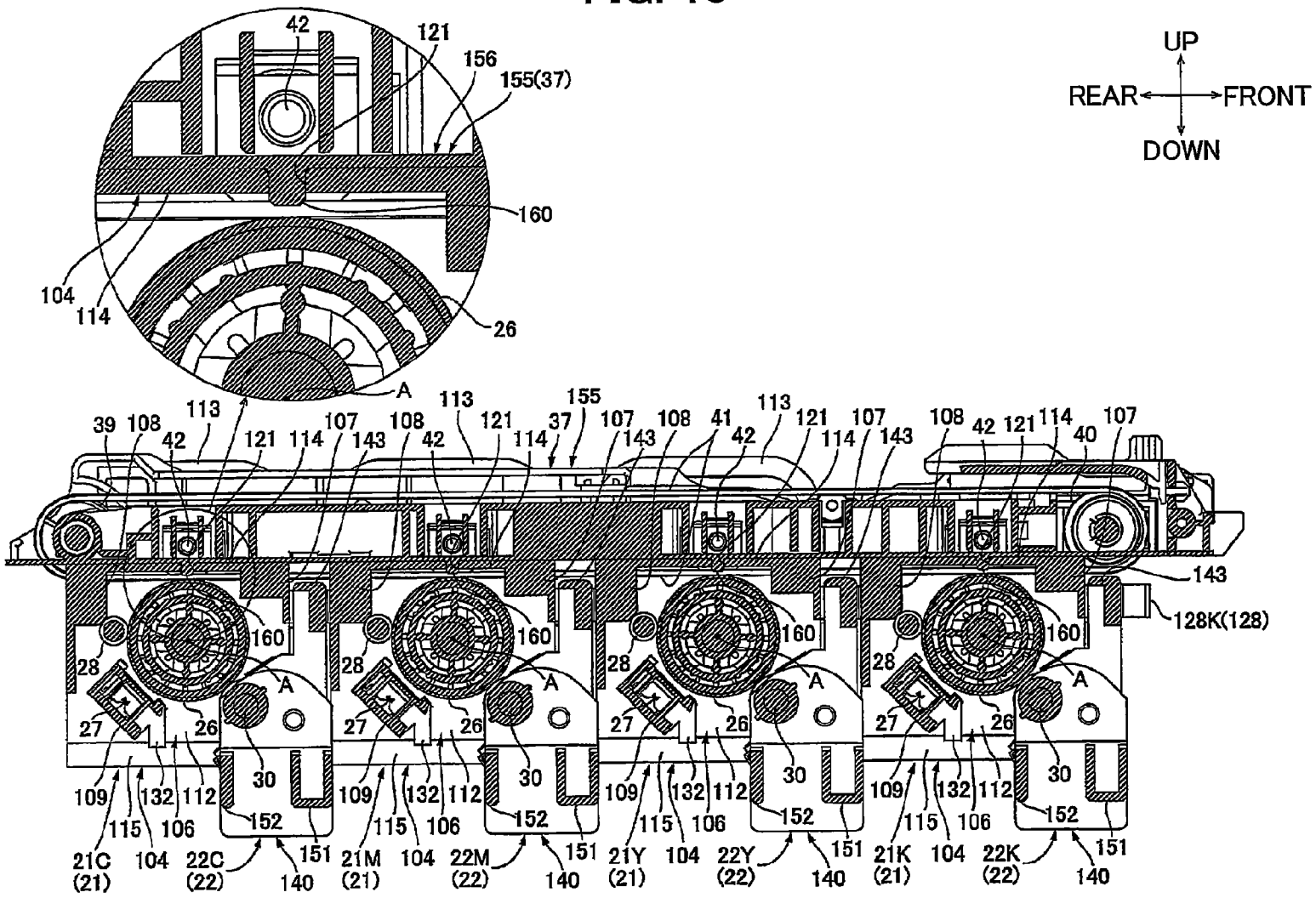
FIG. 13 is a cross-sectional view illustrating a state where the belt unit and the process frame are fixed in position relative to each other in the inside of the printer depicted in FIG. 1.

When the process frame 52 is positioned at the contact position in the internal position, as illustrated in FIGS. 12 and 13, the drum frames 104 of the four drum cartridges 21 are in abutment contact with the belt frame 155 of the belt unit 37 from below.

More specifically, the bottom surface of the belt left wall 156 and the bottom surface of the belt right wall 157 in the belt frame 155 are in contact with the top surfaces of the drum bending portion 114 of the drum frames 104. Each pair of positioning protrusions 160 is fitted to the positioning holes 121 of the corresponding drum frame 104. positioning holes 121 are positioned outward of the intermediate transfer belt 41 in the leftward/rightward direction.

Accordingly, the four drum cartridges 21 are subjected to positioning relative to the belt frame 155. The photosensitive drum 26 of the each drum cartridge 21 is opposed to the corresponding primary transfer roller 42 across the intermediate transfer belt 41 and contacts with the intermediate transfer belt 41.

When the process frame 52 is positioned at the contact position in the internal position, the drum grip portions 113 provided in the yellow drum cartridge 21Y, magenta drum cartridge 21M, and the cyan drum cartridge 21C are overlapped with the intermediate transfer belt 41 when viewed in the leftward/rightward direction. The left black-drum grip portion 134 and the right black-drum grip portion 135 of the black drum cartridge 21K are overlapped with the belt unit 37 in the leftward/rightward direction when viewed in the leftward/rightward direction.

7 Attachment and Detachment Operation of the Drum Cartridge and the Developer Cartridge (1) Detachment Operation of the Drum Cartridge and the Developer Cartridge In order to detach the drum cartridge 21 and the developing cartridge 22 from the main casing 2, the process frame 52 is pulled from the main casing 2 so that the process frame 52 is moved from the internal position to the external position.

In order to move the process frame 52 from the internal position to the external position, as illustrated in FIG. 14 the front cover 7 is pivotally moved from the closed position to the open position.

Interlocked with the pivotal movement of the front cover 7 via an interlocking mechanism (not illustrated), the process frame 52 is moved downward from the contact position in the internal position to the separated position in which the respective photosensitive drums 26 in the four drum cartridges 21 are separated away from the intermediate transfer belt 41. Concurrently, the four pairs of the positioning protrusions 160 of the belt unit 37 are disengaged from the positioning holes 121 provided in the four drum cartridges 21.

Next, as illustrated in FIG. 15, the user grips the process gripping portion 75 and slidably moves the process frame 52 so as to pull the process frame 52 frontwards.

According to the operations described above, the process frame 52 is pulled outside from the main casing 2 through the opening 6 and is positioned at the external position.

Next, the drum cartridge 21 is detached from the process frame 52. As illustrated in FIG. 19, the user grips the drum grip portions 113 and pulls the drum cartridge 21 upward in order to detach the drum cartridge 21 from the process frame 52. In FIG. 19, the yellow drum cartridge 21Y is detached among the four drum cartridges 21.

According to the operations described above, as illustrated in FIGS. 16A and 16B, the extending portions 132 of the drum frame 104 can no longer press the corresponding rollers 93 of the urging portions 87. That is, the abutment of the extending portions 132 against the rollers 93 is released. The rollers 93 are thus urged upwards due to the urging force of the compression springs 92.

Accordingly, the second guide shaft 97 are respectively moved from the lower end portion to the upper end portion in the first guide grooves 90, the first guide shaft 96 are respectively moved from the substantially center portion of the second guide grooves 91 in the frontward/rearward direction to the front upper end portion thereof, and the cover portion 88 is moved from the exposing position, at which the cover portion 88 exposes the upper portion of the LED array 82, to the covering position, at which the cover portion 88 covers the upper portion of the LED array 82.

Figure 17B:
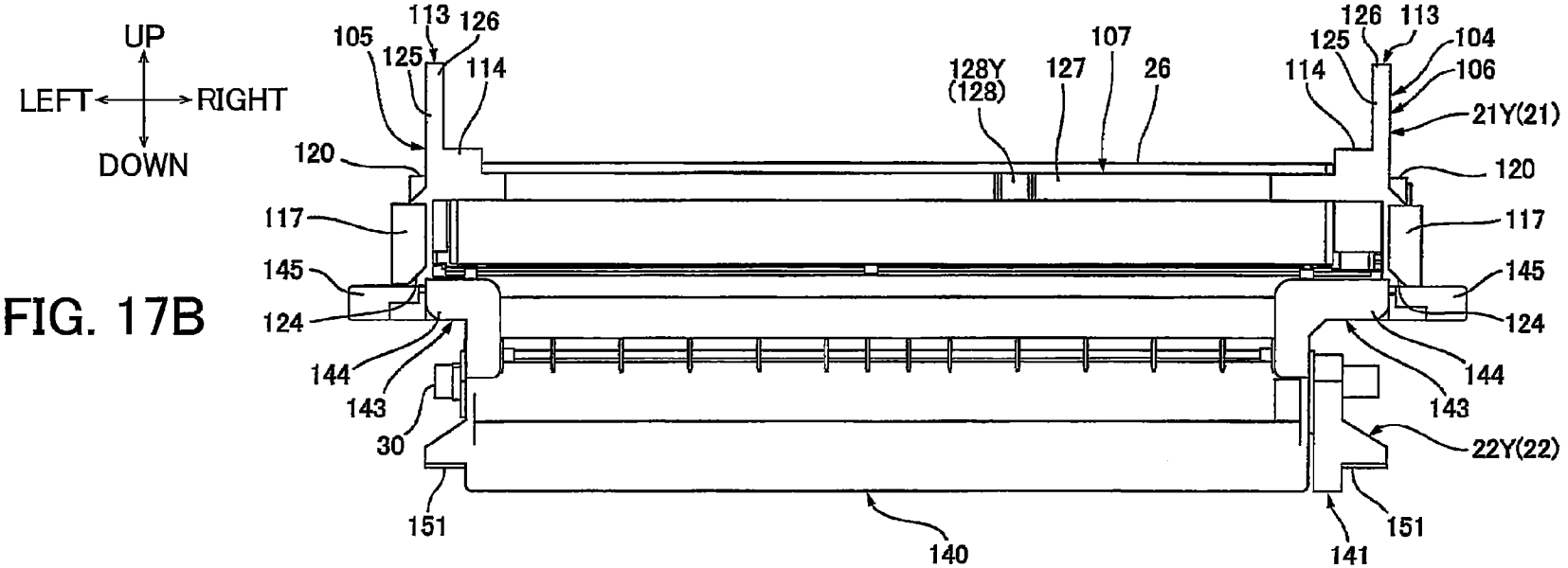
FIG. 17B is a view for description of operation of the developing grip portions of the developing cartridge depicted in FIG. 2, and illustrating a state subsequent to the state illustrated in FIG. 17A such that the pivot portions are at protruding positions.

Further, as illustrated in FIGS. 17A and 17B, when the drum cartridge 21 is moved upward to be separated from the corresponding developing cartridge 22, the abutment portions 117 of the drum frame 104 can no longer press the corresponding pivot portions 145 of the developing grip portions 143. That is, the abutment of the abutment portions 117 against the pivot portions 145 is released. The pivot portions 145 are thus moved from the accommodated position to the protruding position due to the urging force of the torsion springs 146.

Figure 20:
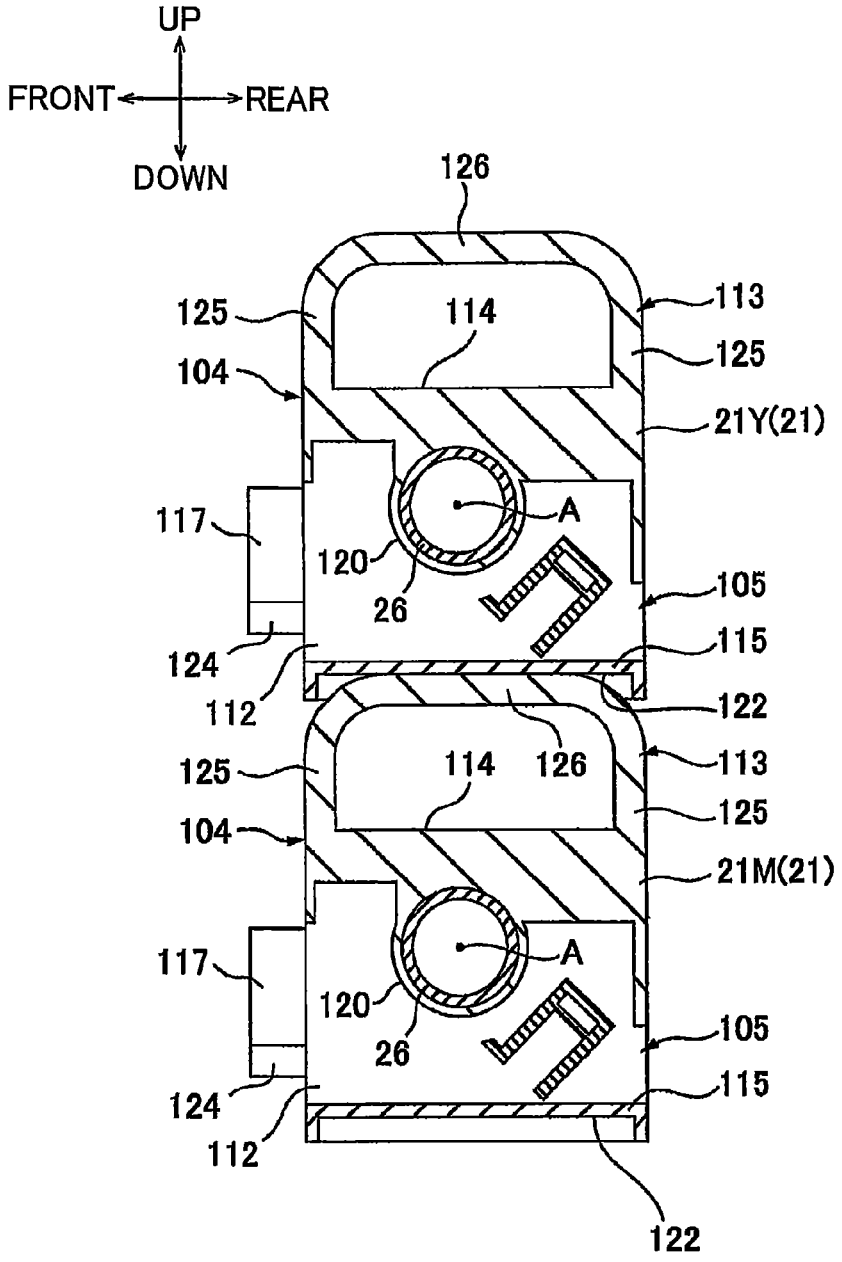
FIG. 20 is a side cross-sectional view illustrating two drum cartridges one overriding the other those illustrated in FIG. 19.

Then, as illustrated in FIGS. 19 and 20, the yellow drum cartridge 21Y detached from the process frame 52 is stacked on the magenta drum cartridge 21M. Specifically, the yellow drum cartridge 21Y is stacked on the magenta drum cartridge 21M such that the receiving grooves 122 in the mount portion 115 constituting the drum frame 104 of the yellow drum cartridge 21Y are respectively engaged with the upper end portions of the corresponding drum grip portions 113 of the magenta drum cartridge 21M.

In the black drum cartridge 21K, as illustrated in FIG. 19, the left black-drum grip portion 134 has the flat plate portion 136. Thus, the left black-drum grip portion 134 cannot be engaged with the receiving groove 122. Further, although the right black-drum grip portion 135 can be engaged with the receiving groove 122, the left black-drum grip portion 134 has a length in the vertical direction different from that of the right black-drum grip portion 135. According to this configuration, a user recognizes that if one of the yellow drum cartridge 21Y, magenta drum cartridge 21M, and cyan drum cartridge 21C is stacked on the black drum cartridge 21K, the drum cartridge 21 that is stacked on the black drum cartridge 21K will be inclined and will become off-balance. This configuration can therefore restrict a user from stacking either one of the yellow drum cartridge 21Y, magenta drum cartridge 21M, and cyan drum cartridge 21C on the black drum cartridge 21K.

After the corresponding yellow drum cartridge 21Y is detached from the yellow developing cartridge 22Y, as illustrated in FIG. 18, the user can grip the right and left pivot portions 145 to pull the yellow developing cartridge 22Y upward from the process frame 52.

According to the operations described above, the operation for detaching the drum cartridge 21 and the developing cartridge 22 from the main casing 2 is completed.

(2) Operation for Attaching the Drum Cartridge and Developing Cartridge

For mounting the drum cartridge 21 and developing cartridge 22 to the main casing 2, the developing cartridge 22 is first attached to the process frame 52.

For attaching the developing cartridge 22 to the process frame 52, as illustrated in FIG. 2, the developing cartridge 22 is moved downward onto the corresponding developing cartridge accommodating portion 101 in the process frame 52, from which the drum cartridge 21 corresponding to the developing cartridge 22 has been detached. Specifically, the pair of first developing engagement grooves 68 guides the pair of first developing engagement portion 151 downward and the pair of second developing engagement grooves 69 guides the pair of second developing engagement portion 152 downward. Accordingly, the developing cartridge 22 is attached to the corresponding developing cartridge accommodating portion 101.

Next, the drum cartridge 21 is moved downward onto the corresponding drum cartridge accommodating portion 100 in the process frame 52, in which the developing cartridge 22 corresponding to the drum cartridge 21 has been attached. Specifically, the first drum engagement groove 70 guides the first drum engagement portion 116 downward and the second drum engagement groove 71 guides the second drum engagement portion 118 downward respectively in the left side of the drum cartridge 21, whereas the first drum engagement groove 70 guides the first drum engagement portion 116 downward in the right side of the drum cartridge 21. Accordingly, the drum cartridge 21 is attached to the corresponding drum cartridge accommodating portion 100.

According to the operations described above, as illustrated in FIG. 17B, the abutment portions 117 of the drum cartridge 21 are respectively brought into abutment contact with the corresponding pivot portions 145 of the developing cartridge 22 from above. As a result, as illustrated in FIG. 17A, the pivot portions 145 of the developing cartridge 22 are respectively moved from the protruding position to the accommodated position against the urging force of the torsion springs 146.

Next, as illustrated in FIGS. 12 and 15, the process frame 52 is moved from the external position to the contact position in the internal position according to the procedure reverse to the procedure described above.

According to the operations described above, the operation for attaching the drum cartridge 21 and the developing cartridge 22 to the main casing 2 is completed.

8. Operational and Technical Advantages

As illustrated in FIGS. 17A and 18, according to the above-described printer 1, the pivot portion 145 can be positioned at the accommodated position upon abutment of the abutment portion 117 with the pivot portion 145 of the developing grip portion 143 when the drum cartridge 21 and developing cartridge 22 are mounted on the process frame 52 such that the drum cartridge 21 is positioned above the developing cartridge 22. Further, the pivot portion 145 can be positioned at the protruding position by removing the drum cartridge 21 from the position above the developing cartridge 22 to release the abutment of the abutment portion 117 against the pivot portion 145.

Therefore, the pivot portion 145 can be positioned at either one of the accommodated position and the protruding position with a simple construction by attaching and detaching the drum cartridge 21 to and from the process frame 52 at the position above the developing cartridge 22, and by abutting and releasing the abutment portion 117 to and from the pivot portion 145.

Further, as illustrated in FIGS. 17A and 19, when the drum cartridge 21 is mounted on the process frame 52, detachment of the developing cartridge 22 from the process frame 52 is difficult to achieve, because the pivot portion 145 of the developing grip portion 143 is positioned at the accommodated position. Further, as illustrated in FIGS. 18 and 19, after the drum cartridge 21 has been detached from the process frame 52, the developing cartridge 22 can be easily detached from the process frame 52 by the user gripping the pivot portion 145 of the developing grip portion 143 because the pivot portion 145 is at the protruding position.

As a result, the developing cartridge 22 can be detached after the drum cartridge 21 has been completely detached from the process frame 52.

Further, as illustrated in FIGS. 9 and 17A, according to the printer 1, while the drum cartridge 21 is mounted on the process frame 52, the pivot portion 145 can be positioned at the accommodated position as indicated by the two-dot chain line shown in FIG. 9 against urging force of the torsion spring 146 due to abutment of the abutment portion 117 against the pivot portion 145 of the developing cartridge 22.

Further, when the drum cartridge 21 is detached from the process frame 52, the pivot portion 145 can be positioned at the protruding position as indicated by the solid line in FIG. 9 due to the urging force of the torsion spring 146 by releasing abutment of the abutment portion 117 against the pivot portion 145 of the developing cartridge 22.

Thus, the user can surely grip the pivot portion 145 of the developing grip portion 143 to detach the developing cartridge 22 from the process frame 52, after having removed the drum cartridge 21.

Further, as illustrated in FIG. 9 according to the printer 1, the pivot portion 145 can be moved from the protruding position to the accommodated position and vice versa by the simple pivotal movement of the pivot portion 145.

Further, as illustrated in FIGS. 9 and 18 according to the printer 1, when the pivot portion 145 of the developing grip portion 143 is at the protruding position, the user can easily recognize the pivot portion 145 of the developing grip portion 143, the pivot portion 145 protruding leftward/rightward direction if the user views the developing cartridge 22 from above.

Therefore, the user can surely grip the pivot portion 145 of the developing grip portion 143 for detaching the developing cartridge 22 from the process frame 52.

Further, when the pivot portion 145 is at the accommodated position, as illustrated in FIGS. 9 and 17A, the user cannot easily recognize the pivot portion 145 of the developing grip portion 143. Thus, difficulty in detachment of the developing cartridge 22 can be provided.

Further, as illustrated in FIG. 18 according to the printer 1, when the pivot portion 145 of the developing grip portion 143 is at the protruding position, the pivot portion 145 is positioned above the process left wall 53 and process right wall 54, and is overlapped with the process left wall 53 and process right wall 54 when viewed in the vertical direction. Therefore, the user can easily recognize the pivot portion 145 at its protruding position.

Further, as illustrated in FIG. 18 according to the printer 1, the tip end of the pivot portion 145 at its protruding position is positioned outward of the drum frame 104 in leftward/rightward direction. This further facilitates user's recognition to the pivot portion 145.

With this structure, the developing cartridge 22 can be easily detached from the process frame 52 by gripping the pivot portion 145 of the developing grip portion 143 after the drum cartridge 21 is detached from the process frame 52.

Further, as illustrated in FIG. 2, in the process frame 52, the pair of the first drum engagement groove 70 is positioned outward of the pair of first developing engagement groove 68 and the pair of second developing engagement groove 69 in leftward/rightward direction.

With this structure, as illustrated in FIGS. 17A and 19, the developing frame 140 is positioned inward of the drum frame 104 in the leftward/rightward direction. Therefore, user's access to the developing cartridge 22 becomes difficult when both of the developing cartridge 22 and the drum cartridge 21 are assembled to the process frame 52

As a result, for taking out the developing cartridge 22 from the process frame 52, first, the drum cartridge 21 is detached from the process frame 52 to cause the pivot portion 145 of the developing grip portion 143 in the developing cartridge 22 to move to the protruding position. Then, the developing cartridge 22 can be detached from the process frame 52 by gripping the pivot portion 145.

Accordingly, simultaneous detachment of the drum cartridge 21 and the developing cartridge 22 from the process frame 52 can be restrained.

Further, according to the printer 1, as illustrated in FIGS. 2 and 19, a user can perform replacement or a maintenance operation onto four photosensitive drums 26 and four developing cartridges 22 individually even when their frequencies of use are different from one another.

Further, according to the printer 1, as illustrated in FIGS. 2 and 19, the four drum cartridges 21 and the four developing cartridges 22 can be individually moved upward relative to the process frame 52 at the external position so as to be removed from the process frame 52.

At this time, the developing cartridges 22 are disposed below the corresponding drum cartridges 21, so that only the drum cartridges 21 can be removed from the process frame 52 while the corresponding developing cartridges 22 remain in the process frame 52.

Further, according to the printer 1, as illustrated in FIGS. 19 and 20, when one of the four drum cartridges 21 is removed from the process frame 52, the removed drum cartridge 21 can be stacked on one of the remaining drum cartridges 21 that is other than the black drum cartridge 21K.

Thus, space required when exchanging the developing cartridge 22 or performing a maintenance operation can be reduced, because no space is required for placing the drum cartridge 21 that has been detached for subsequent detachment of the developing cartridge 22.

In addition, because no particular space is required for placing the removed drum cartridge 21, space required when replacing the photosensitive drum 26 or performing a maintenance operation can also be reduced.

According to the printer 1 as illustrated in FIG. 1, four photosensitive drums 26 are supported by the process frame 52 such that the photosensitive drums 26 are arrayed side by side in frontward/rearward direction.

When the process frame 52 is at the contact position in the internal position as illustrated in FIG. 13, the four drum frames 104 can be subjected to positioning relative to the belt frame 155 upon engagement of respective positioning holes 121 of the respective drum frames 104 with the corresponding one of the positioning protrusions 160 of the belt frame 155. Respective drum frames 104 each support the photosensitive drum 26, and the belt frame 155 supports the intermediate transfer belt 41.

As a result, precise positioning of the four photosensitive drums 26 relative to the intermediate transfer belt 41 can be realized.

Further, the drum frame 104 supported by the process frame 52 movable between the internal position and the external position relative to the main casing 2 is formed with the positioning hole 121 having recessed configuration. Therefore, damage to the positioning hole 121 can be restrained, and the positioning protrusion 160 of the belt frame 155 can be protected, the positioning protrusion 160 being engaged with the positioning hole 121.

Further, engagement between the positioning hole 121 and the positioning protrusion 160 can be provided by the simple structure such as engagement between a projecting configuration and a recessed configuration as shown in FIG. 13.

Further, mechanical interference of an external component with the positioning hole 121 can be restrained when the process frame 52 supporting the drum frame 104 is at the external position, because the positioning hole 121 is not a projection shape but a recessed shape as illustrated in FIG. 2.

Further, mechanical interference of an external component with the positioning protrusion 160 can be restrained, because the positioning protrusion 160 having the projecting configuration is provided at the belt frame 155 of the belt unit 37 that is configured to be accommodated in the main casing 2 as illustrated in FIGS. 11 and 13.

Further, according to the printer 1, stabilized surface contact of the peripheral surface of the positioning protrusion 160 with the inner peripheral surface of the positioning hole 121 can be provided, because the positioning protrusion 160 and the positioning hole 121 have generally rectangular cross-sections as illustrated in FIGS. 11 and 13.

With this structure, precise positioning of the four drum frames 104 relative to the belt frame 155 can be obtained.

Further, according to the printer 1, positioning of the four drum frames 104 relative to the belt frame 155 can be performed upon engagement of respective positioning hole 121 of the respective four drum frames 104 with the positioning protrusion 160 of the belt frame 155 at the positions outward of the intermediate transfer belt 41 in leftward/rightward direction without inhibiting the driving operation of the intermediate transfer belt 41 as illustrated in FIGS. 11 and 19.

Further, according to the printer 1, precise positioning of the four photosensitive drums 26 relative to the intermediate transfer belt 41 can be performed in spite of the fact that the drum cartridge 21 is attachable to and detachable from the process frame 52, because positioning of the four drum cartridges 21 relative to the belt frame 155 can be made as illustrated in FIG. 13.

Further, according to the printer 1, the positioning hole 121 can be protected by the drum grip portion 113 as illustrated in FIGS. 2 and 7A.

As a result, accurate engagement between the positioning hole 121 and the positioning protrusion 160 can be provided as illustrated in FIGS. 13.

Further, according to the printer 1, an increase in size of the main casing 2 can be restrained in spite of the fact that the drum cartridge 21 is provided with the drum grip portion 113, because the drum cartridge 21 is positioned relative to the belt frame 155 in the inside of the main casing 2 such that the drum grip portion 113 is aligned with the intermediate transfer belt 41 in the side view as illustrated in FIGS. 12 and 14.

Further, according to the printer 1, the photosensitive drum 26 can be made in contact with the intermediate transfer belt 41 from below by engaging the positioning hole 121 of the drum frame 104 with the positioning protrusion 160 of the belt frame 155 from below as illustrated in FIG. 13.

Further, according to the printer 1, each photosensitive drum 26 is exposed to light by each LED unit 23.

Therefore, the surface of the photosensitive drum 26 can be exposed to light at high accuracy in comparison with a case where light exposure with respect to the plurality of photosensitive drums is performed by a single LED unit.

Further, according to the printer 1, the four primary transfer rollers 42 are movable relative to the belt frame 155, and the photosensitive drum 26 is subjected to positioning not relative to the primary transfer roller 42, but relative to the intermediate transfer belt 41 as illustrated in FIGS. 10 and 11.

With this arrangement, the printer 1 can perform image forming operation while supporting the primary transfer roller 42 so that the primary transfer roller 42 is movable relative to the belt frame 155 in the vertical direction.

Further, according to the printer 1, downsizing can be realized because gaps between neighboring photosensitive drums 26 can be small as illustrated in FIG. 8.

Further, a constant pitch between the four photosensitive drums 26 can be maintained to provide accurate image formation because the four drum frames 104 are subjected to positioning relative to the belt frame 155.

According to the above described printer 1, as illustrated in FIGS. 1 and 12, the photosensitive drums 26 are disposed in confrontation with the intermediate transfer belt 41 from below by positioning the process frame 52 at the contact position in the internal position. Accordingly, the printer 1 becomes capable of forming images.

Further, as illustrated in FIGS. 15 and 19, the drum cartridges 21 can be moved from the position below the intermediate transfer belt 41 by locating the process frame 52 at the external position. Accordingly, the drum cartridges 21 become respectively detachable from the process frame 52.

In a state that the drum cartridge 21 is detachable, the corresponding photosensitive drum 26 is offset from the position below the intermediate transfer belt 41 and the upper portion of the photosensitive drum 26 is therefore exposed. However, because the drum frame 104 has the drum grip portions 113, the user can easily access to the drum cartridge 21 without touching the photosensitive drum 26 and can easily perform replacement of the drum cartridge 21.

Further, only the drum cartridge 21 can be detached from the process frame 52 while the corresponding developing cartridge 22 remains in the process frame 52. Therefore, a user can perform replacement of the photosensitive drum 26 or a maintenance operation without detaching the developing cartridge 22 from the process frame 52.

As a result, only the drum cartridges 21 can be easily detached from the process frame 52 while preventing the user from touching the photosensitive drums 26.

Further, according to the printer 1, as illustrated in FIGS. 2 and 7A, the drum grip portions 113 are provided in both the right and left end portions of the drum frame 104. Accordingly, the user can certainly recognize the drum grip portions 113.

Therefore, this configuration can further prevent the user from touching the photosensitive drums 26.

Further, the user can stably attach and detach the drum frame 104 to and from the process frame 52 by gripping both of the right and left end portions of the drum frame 104, in comparison with a case where the drum grip portion 113 is provided only in one left-right end portion of the drum frame 104.

Further, according to the printer 1, as illustrated in FIGS. 12 and 14, when the process frame 52 is positioned at the internal position, the drum grip portions 113 are overlapped with the intermediate transfer belt 41 in a side view and located above the corresponding photosensitive drums 26 respectively.

Therefore, as illustrated in FIGS. 15 and 19, the user, when accessing the drum cartridge 21, can easily recognize the drum grip portions 113. Accordingly, the user can certainly grip the drum grip portions 113 rather than the photosensitive drum 26 whose upper portion is exposed.

As a result, the user can detach the drum cartridge 21 from the process frame 52 by certainly gripping the drum grip portions 113 without touching the photosensitive drums 26.

Further, according to the printer 1, as illustrated in FIGS. 2 and 7A, each drum grip portion 113 has the pair of grip protruding portions 125 and the grip connecting portion 126. Therefore, the user can attach and detach the drum cartridge 21 to and from the process frame 52 stably by gripping the grip connecting portions 126 of the drum grip portions 113.

Further, according to the printer 1, as illustrated in FIGS. 1 and 6B, the photosensitive drum 26 is in confrontation with the corresponding LED array 82 of the LED unit 23 from above when the corresponding drum cartridge 21 is attached to the process frame 52. Accordingly, the LED array 82 of the LED unit 23 can be protected by the corresponding photosensitive drum 26.

Further, as illustrated in FIGS. 4A and 4B, when the drum cartridge 21 has been detached from the process frame 52, the corresponding LED array 82 of the LED unit 23 can be protected by the corresponding cover portion 88 instead of the photosensitive drum 26.

As a result, this configuration can extend the lifetime of the LED unit 23.

Further, according to printer 1, as illustrated in FIGS. 1 and 8, the lengths of the gaps between the neighboring drum frames 104 are set to be longer than or equal to 0.5 mm and shorter than or equal to 8 mm. Accordingly, when the user chooses one of the drum cartridges 21 and attempts to detach his/her chosen drum cartridge 21 from the process frame 52, this configuration can prevent the user from inserting his/her hand(s) into the gap between the drum frame 104 of the chosen drum cartridge 21 and another drum frame 104 next to the drum frame 104 of the chosen drum cartridge 21 to detach the chosen drum cartridge 21 from the process frame 52.

This configuration ensures that the user recognizes the drum grip portions 113 and grips the drum grip portions 113 when detaching the drum cartridge 21.

Further, according to the printer 1, as illustrated in FIGS. 1 and 8, the upper surfaces of the neighboring drum frames 104 are in flush with one another. That is, there is no difference in level between the upper surfaces of neighboring drum frames 104. Accordingly, the user can easily recognize that there is no gap between the neighboring drum frames 104.

Hence, this configuration can further prevent the user from inserting his/her hand(s) into the gap between the neighboring drum frames 104 to remove the drum cartridge 21 from the process frame 52.

Further, according to the printer 1, as illustrated in FIG. 8, the order, in which the four drum cartridges 21 are arranged in the frontward/rearward direction, is fixed and cannot be changed. Hence, when the four drum cartridges 21 are respectively mounted in the process frame 52 after all of the four drum cartridges 21 have been removed from the process frame 52, each of the four drum cartridges 21 can be reliably mounted above the corresponding developing cartridge 22.

Further, according to the printer 1, as illustrated in FIGS. 8 and 19, through a simple configuration such that the cyan-drum convex portion 128C engages with the magenta-drum concave portion 130M, the cyan drum cartridge 21C can engage with the magenta drum cartridge 21M.

Therefore, the pitch between the cyan drum cartridge 21C and the magenta drum cartridge 21M can be fixed, thereby improving the accuracy in the image forming operation.

Further, according to the printer 1, as illustrated in FIGS. 8 and 19, the cyan-drum convex portion 128C has a convex shape while the magenta-drum concave portion 130M has a concave shape. Hence, the cyan-drum convex portion 128C can easily engage with the magenta-drum concave portion 130M.

Further, according to the printer 1, as illustrated in FIG. 8, the left-right position of the magenta-drum convex portion 128M and the yellow-drum concave portion 130Y is offset from the left-right position of the cyan-drum convex portion 128C and the magenta-drum concave portion 130M. Through this simple arrangement, the order, in which the yellow drum cartridge 21Y, the magenta drum cartridge 21M and the cyan drum cartridge 21C are arranged in the frontward/rearward direction, can be made fixed and unchangeable.

Hence, the yellow drum cartridge 21Y, the magenta drum cartridge 21M, and the cyan drum cartridge 21C can be reliably mounted above the corresponding developing cartridges 22.

Further, according to the printer 1, as illustrated in FIG. 8, the magenta-drum convex portion 128M has a convex shape while the yellow-drum concave portion 130Y has a concave shape. Hence, the magenta-drum convex portion 128M can easily engage with the yellow-drum concave portion 130Y.

Further, according to the printer 1, as illustrated in FIGS. 8 and 19, through a simple configuration such that the black-drum convex portion 128K engages with the process recessed portion 76, the black drum cartridge 21K positioned at the downmost stream in the direction from the internal position toward the external position can be mounted in the process frame 52.

Further, the left-right position of the black-drum convex portion 128K and the process recessed portion 76 is offset from the left-right position of the cyan-drum convex portion 128C and the magenta-drum concave portion 130M. Through this simple arrangement, the black drum cartridge 21K can be mounted in the forefront drum cartridge accommodating portion 100 in the process frame 52.

Further, according to the printer 1, as illustrated in FIGS. 8 and 19, the black-drum convex portion 128K has a convex shape while the process recessed portion 76 has a concave shape. Hence, the black-drum convex portion 128K can easily engage with the process recessed portion 76.

In addition, the user can remove each drum cartridge 21 from the process frame 52 through a simple operation such that the user grips the drum grip portions 113 and pulls the drum cartridge 21 upward.

Further, according to the printer 1, as illustrated in FIGS. 19 and 20, when one of the four drum frames 104 is stacked on one of the remaining drum frames 104, it is only necessary to place the mount portions 115 of the one of the four drum frames 104 on the drum grip portions 113 of the one of the remaining drum frames 104.

Hence, the four drum cartridges 21 can be easily and reliably stacked.

Further, according to the printer 1, as illustrated in FIG. 19, the black drum cartridge 21K has the left black-drum grip portion 134 and the right black-drum grip portion 135, unlike the other drum cartridges 21. Thus, the cyan drum cartridges 21C, 21M, and 21Y cannot be stacked on the black drum cartridge 21K.

Assuming that the cyan drum cartridges 21C, 21M, and 21Y can be stacked on the black drum cartridge 21K when the process frame 52 is at the external position, the process frame 52 may become overweighted at its farthest portion from the main casing 2 when the cyan drum cartridge 21C, 21M, or 21Y is stacked on the black drum cartridge 21K. However, since the cyan drum cartridges 21C, 21M, and 21Y cannot be stacked on the black drum cartridge 21K, the farthest portion of the process frame 52 can be suppressed from being overweighted. Hence, tilting of the main casing 2 can also be suppressed.

As a result, the main casing 2 can rest stably even when the process frame 52 is placed at the external position for replacement of the drum cartridge 21 or a maintenance operation.

Further, according to the printer 1, as illustrated in FIGS. 11 and 12, the belt unit 37 and the four drum frames 104 can be fixed in position relative to each other within an area inward of the drum grip portions 113 in the leftward/rightward direction.

Hence, damages to the positioning protrusions 160 caused by the drum grip portions 113 can be suppressed.

As a result, the four drum frames 104 can be reliably fixed in position relative to the belt unit 37, and accordingly, the four photosensitive drums 26 can contact the intermediate transfer belt 41 at regular pitches.

9. Second Embodiment

Next, a printer according to a second embodiment will be described with reference to FIGS. 21A and 21B wherein like parts and components are designated by the same reference numerals as those illustrated in the first embodiment to avoid duplicating description.

(1) Structure of Drum Cartridge According to Second Embodiment

In the first embodiment, the drum cartridge 21 includes the pair of drum grip portions 113 and the pair of abutment portions 117. However, in the second embodiment, the drum cartridge 21 includes a drum single-side grip portion 170 as an example of drum gripping portion, and a pair of pressing portions 171, in place of the pair of drum grip portions 113 and the pair of abutment portions 117.

The drum single-side grip portion 170 is provided at a left end portion of the drum cartridge 21. The drum single-side grip portion 170 includes a base portion 174, a first portion 175 and a second portion 176.

The base portion 174 protrudes leftward from a left surface of the drum side wall body 112 constituting the drum-frame left wall 105 at an upper rear end portion thereof.

The first portion 175 has a general rectangular columnar shape that extends upward from a top surface of the base portion 174.

The second portion 176 has a general rectangular columnar shape that extends frontward from an upper end portion of the first portion 175. The second portion 176 has a plurality of projections and depressions aligned in the frontward/rearward direction so that the user easily grips the second portion 176. Incidentally, the second portion 176 is disposed leftward of the positioning hole 121.

The pressing portion 171 has a general plate shape that is substantially rectangular in a plan view and extends frontward continuously from a front end portion of the drum bending portion 114.

(2) Structure of Developing Cartridge According to Second Embodiment

In the first embodiment, the developing cartridge 22 includes the pair of developing grip portions 143. However, in the second embodiment, the developing cartridge 22 includes a pair of developing slide grip portions 179 as an example of a pair of developer gripping portion in place of the pair of developing grip portions 143.

The developing slide grip portions 179 are each provided at each left-right end portion of the developing frame 140. Each developing slide grip portion 179 includes a base portion 180, and a slide portion 181 as an example of a moving portion.

The base portion 180 has a general rectangular columnar shape that extends upward from an upper surface of the developing frame 140 at its left-right end portion. Incidentally, the distance between a right end of the left base portion 180 and a left end of the right base portion 180 is slightly greater than the left-right dimension of the projecting portion 127 of the drum cartridge 21. The base portion 180 has a slide guide 183.

The slide guide 183 protrudes rearward from a rear surface of the base portion 180 at a substantially left-right center region thereof. The slide guide 183 has a general rectangular columnar shape that extends across the base portion 180 in its entirety in the vertical direction.

The slide portion 181 includes a post portion 185, an extension portion 186, and a reinforcing portion 187.

The post portion 185 has a general rectangular columnar shape that extends in the vertical direction. The post portion 185 has a guide groove 188.

The guide groove 188 is recessed rearward in a front surface of the post portion 185 at its substantially left-right center region. The guide groove 188 extends across the post portion 185 in its entirety in the vertical direction.

The extension portion 186 has a general rectangular columnar shape that extends outward in the leftward/rightward direction from a top end portion of the post portion 185.

The reinforcing portion 187 connects a left-right outer surface of the post portion 185 and a bottom surface of the extension portion 186. The reinforcing portion 187 has a general plate shape that is substantially triangular in a front view. More specifically, the reinforcing portion 187 has a lower surface that slopes diagonally upward toward the outer left-right side thereof.

Figure 21A:
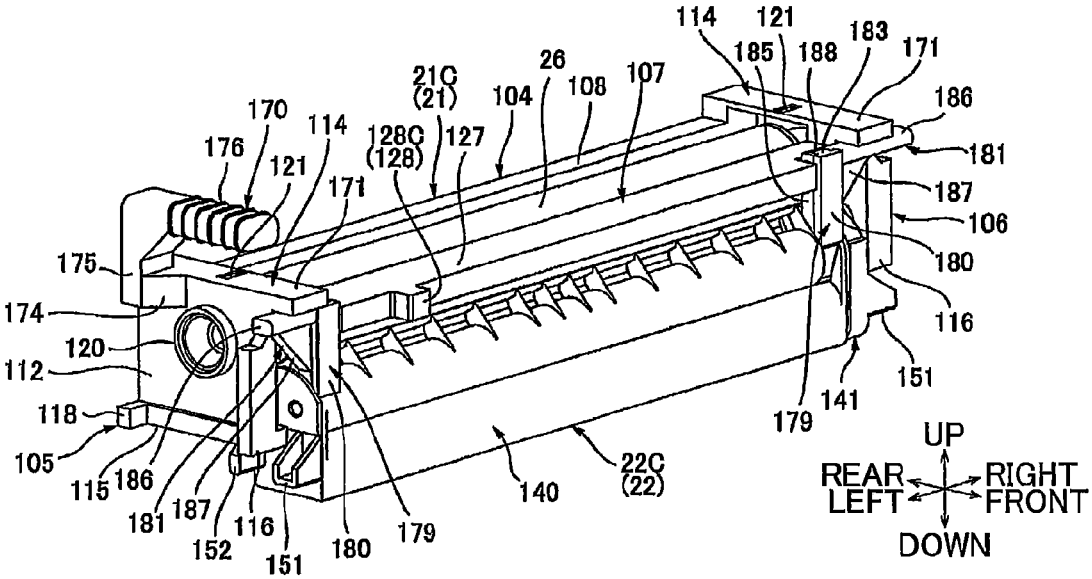
FIG. 21A is a view for description of operation of developing slide grip portions of a developing cartridge in a printer according to a second embodiment, and illustrating a state where slide portions are at accommodated positions.

The slide portion 181 is attached to the base portion 180 so that engagement of the slide guide 183 of the base portion 180 with the guide groove 188 of the post portion 185 allows the slide portion 181 to be slidably movable between a protruding position (FIG. 21B) and an accommodated position (FIG. 21A). In the protruding position, the slide portion 181 protrudes upward so that a top end of the slide portion 181 is relatively farther away from the developing frame 140. In the accommodated position, the distance between the top end of the slide portion 181 and the developing frame 140 becomes smaller than that in the protruding position, and the top end of the slide portion 181 is relatively closer to the developing frame 140.

Figure 21B:
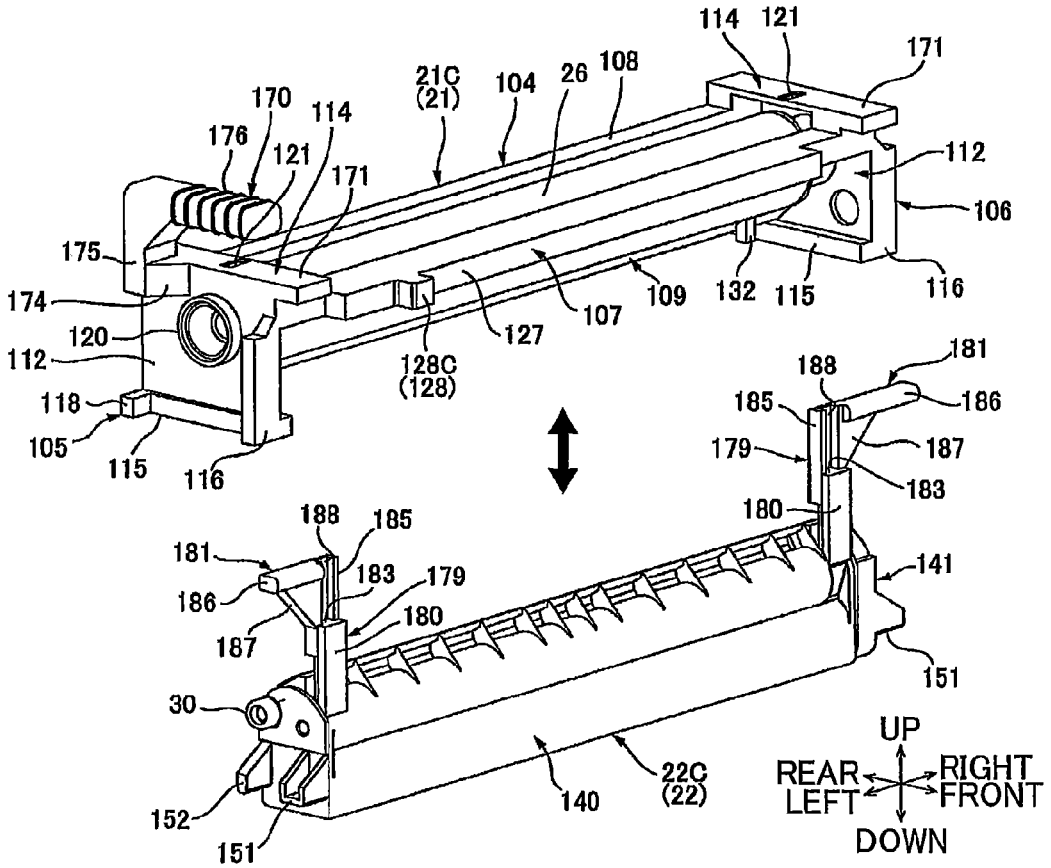
FIG. 21B is a view for description of operation of the developing slide grip portions of the developing cartridge in the printer according to the second embodiment, and illustrating a state subsequent to the state depicted in FIG. 21A such that the slide portions are at protruding positions.

The slide portion 181 is urged in a direction toward the protruding position from the accommodated position due to an urging force of an urging member (not shown), as shown in FIG. 21B.

(3) Attachment and Detachment of the Drum Cartridge and Developing Cartridge Relative to the Process Frame In the second embodiment, although not shown in the drawings, the four drum cartridges 21 and four developing cartridges 22 are configured to be accommodated in the four drum cartridge accommodating portions 100 and four developing cartridge accommodating portions 101, respectively, as in the first embodiment.

When the drum cartridges 21 and developing cartridges 22 are both attached to the process frame 52, as shown in FIG. 21A, the pressing portions 171 of each drum cartridge 21 are respectively in abutment contact with upper surfaces of the extension portions 186 constituting the developing slide grip portions 179 of the corresponding developing cartridge 22.

The slide portion 181 of each developing slide grip portion 179 is thus placed in the accommodated position against the urging force of the urging member (not shown).

When the drum cartridge 21 is moved upward to be separated from the corresponding developing cartridge 22, the pressing portions 171 of the drum frame 104 can no longer press the extension portions 186 of the respective developing slide grip portions 179 of the developing frame 140 from above. That is, abutment of the pressing portions 171 against the extension portions 186 is released. The developing slide grip portions 179 of the corresponding developing cartridge 22 are thus moved from the accommodated position to the protruding position due to the urging force of the non-illustrated urging member.

After the drum cartridge 21 has been detached from the process frame 52, the user can then hold the left and right extension portions 186 to move the developing cartridge 22 upward to detach the developing cartridge 22 from the process frame 52.

For attaching the drum cartridge 21 to the process frame 52 on which the corresponding developing cartridge 22 has been attached, the drum cartridge 21 is moved downward onto the process frame 52. The pressing portions 171 of the drum cartridge 21 are brought into abutment contact with the extension portions 186 of the respective slide portions 181 of the corresponding developing cartridge 22 from above.

The slide portions 181 of the developing cartridge 22 are accordingly displaced to the accommodated position from the protruding position against the urging force of the non-illustrated spring member, as shown in FIG. 21A.

In this way, the drum cartridges 21 and developing cartridges 22 are attached to and detached from the process frame 52.

(4) Operational and Technical Advantages of the Second Embodiment

In the printer 1 according to the second embodiment, the slide portion 181 can be moved from the protruding position to the accommodated position and vice versa with the simple sliding movement of the slide portion 181 as illustrated in FIGS. 21A and 21B.

Further, in the printer 1 according to the second embodiment, the user can easily recognize the slide portion 181 protruding upward from the developing frame 140 when the slide portion 181 of the developing slide grip portion 179 is at the protruding position.

With this structure, the user can easily grip the slide portion 181 of the developing slide grip portion 179, facilitating removal of the developing cartridge 22 from the process frame 52.

Further, the slide portion 181 of the developing slide grip portion 179 is positioned in proximity to the developing frame 140 when the slide portion 181 is at the accommodated position. This structure will provide difficulty in user's grip to the slide portion 181, thereby preventing easy removal of the developing cartridge 22.

According to the printer 1 of the second embodiment, as shown in FIGS. 21A and 21B, the drum cartridge 21 is provided with the drum single-side grip portion 170. The drum single-side grip portion 170 has a generally L shape in a side view, and includes the first portion 175 extending upward and second portion 176 extending frontward from the upper end portion of the first portion 175.

In the drum single-side grip portion 170, an open space is provided frontward of the second portion 176 and above the pressing portion 171. This provision of the open space facilitates user's access to the second portion 176 as well as user's gripping of the drum single-side grip portion 170.

Further, the second embodiment provides function and effect similar to those of the first embodiment.

10. Third Embodiment

A printer 1 according to a third embodiment will be described while referring to FIG. 22, wherein like parts and components are designated by the same reference numerals as the first embodiment to avoid duplicating description.

(1) Configuration of the Drum Cartridge According to the Third Embodiment

In the depicted first embodiment, the second drum engagement portion 118 of each drum cartridge 21 is provided at the same position as one another in the frontward/rearward direction. In contrast, in the third embodiment, the second drum engagement portion 118 of each drum cartridge 21 is provided at different positions from one another in the frontward/rearward direction.

Specifically, as the second drum engagement portion 118, the black drum cartridge 21K is provided with a second black-drum engagement portion 118K, the yellow drum cartridge 21Y is provided with a second yellow-drum engagement portion 118Y, the magenta drum cartridge 21M is provided with a second magenta-drum engagement portion 118M, and the cyan drum cartridge 21C is provided with a second cyan-drum engagement portion 118C.

The second black-drum engagement portion 118K is positioned slightly rearward of a generally front-rear center portion of the mount portion 115 of the drum-frame left wall 105 in the black drum cartridge 21K.

The second yellow-drum engagement portion 118Y is positioned on a rear portion of the mount portion 115 of the drum-frame left wall 105 in the yellow drum cartridge 21Y. The second yellow-drum engagement portion 118Y is positioned rearward of the second black-drum engagement portion 118K.

The second magenta-drum engagement portion 118M is positioned slightly frontward of a rear end portion of the mount portion 115 of the drum-frame left wall 105 in the magenta drum cartridge 21M. The second magenta-drum engagement portion 118M is positioned rearward of the second yellow-drum engagement portion 118Y.

The second cyan-drum engagement portion 118C is positioned on a rear end portion of the mount portion 115 of the drum-frame left wall 105 in the cyan drum cartridge 21C. The second cyan-drum engagement portion 118C is positioned rearward of the second magenta-drum engagement portion 118M.

Although not shown in the drawings, in the four drum cartridge accommodating portions 100 configured to receive the respective four drum cartridges 21, the respective second drum engagement grooves 71 are arranged at positions corresponding to the respective second drum engagement portions 118 of the drum cartridges 21 in the frontward/rearward direction. That is, the second drum engagement grooves 71 are formed at positions different from one another in the frontward/rearward direction.

With this structure, the respective one of four drum cartridges 21 can be accommodated only in the corresponding one of the four drum cartridge accommodating portions 100. In other words, the four drum cartridges 21 are configured to be arranged in a fixed order in the frontward/rearward direction.

The black drum cartridge 21K of the first embodiment is provided with the left black-drum grip portion 134 and right black-drum grip portion 135. In contrast, the black drum cartridge 21K of the third embodiment is provided with the pair of drum grip portions 113, as in the other three drum cartridges 21.

(2) Configuration of the Developing Cartridge According to the Third Embodiment

In the first embodiment, the second developing engagement portion 152 in each of the developing cartridges 22 is positioned at the same positions as one another. However, in the developing cartridges 22 of the third embodiment, the second developing engagement portions 152 are arranged at positions different from one another. Specifically, as the second developing engagement portion 152, the black developing cartridge 22K is provided with a second black-developing engagement portion 152K, the yellow developing cartridge 22Y is provided with a second yellow-developing engagement portion 152Y, the magenta developing cartridge 22M is provided with a second magenta-developing engagement portion 152M, and the cyan developing cartridge 22C is provided with a second cyan-developing engagement portion 152C.

The second black-developing engagement portion 152K is positioned at a generally front-rear center portion of the bearing member 141 (generally front-rear center portion of the developing frame 140) in the black developing cartridge 22K.

The second yellow-developing engagement portion 152Y is provided slightly rearward of a generally front-rear center portion of the bearing member 141 (generally front-rear center portion of the developing frame 140) in the yellow developing cartridge 22Y. The second yellow-developing engagement portion 152Y is positioned rearward of the second black-developing engagement portion 152K.

The second magenta-developing engagement portion 152M is positioned slightly frontward of a rear end portion of the bearing member 141 (rear end portion of the developing frame 140) in the magenta developing cartridge 22M. The second magenta-developing engagement portion 152M is arranged rearward of the second yellow-developing engagement portion 152Y.

The second cyan-developing engagement portion 152C is arranged on a rear end portion of the bearing member 141 (rear end portion of the developing frame 140) in the cyan developing cartridge 22C. The second cyan-developing engagement portion 152C is positioned rearward of the second magenta-developing engagement portion 152M.

Although not shown in the drawings, in each of the four developing cartridge accommodating portions 101 configured to accommodate the four developing cartridges 22, the second developing engagement groove 69 is arranged at a position corresponding to the second developing engagement portion 152 of the corresponding developing cartridge 22 in the frontward/rearward direction. Thus, positions of the second developing engagement grooves 69 formed in the respective developing cartridge accommodating portions 101 are offset from one another in the frontward/rearward direction.

With this structure, the respective one of the four developing cartridges 22 is configured to be accommodated only in the corresponding one of the developing cartridge accommodating portions 101. The order in which the four developing cartridges 22 are arranged in the frontward/rearward direction is therefore fixed and cannot be changed.

(3) Operational and Technical Advantages of the Third Embodiment

In the printer 1 according to the third embodiment, alignment sequence of the four drum cartridges 21 can be maintained without disorder by the simple construction in which positions of four second drum engagement portions 118 of the four drum cartridges 21 are different from one another and positions of four second drum engagement grooves 71 in the four drum cartridge accommodating portions 100 are different from one another.

Figure 22:
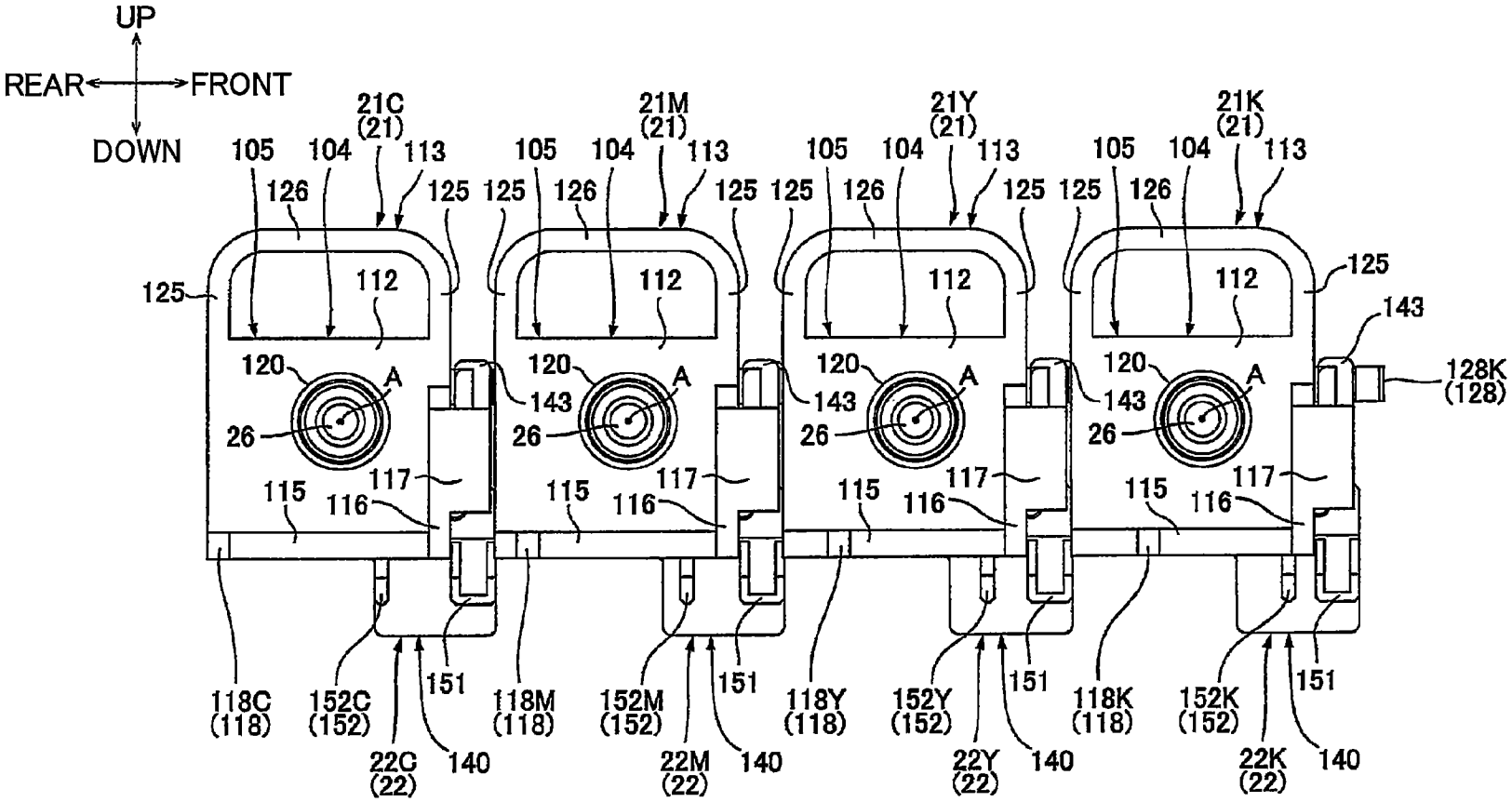
FIG. 22 is a side view of drum cartridges and developing cartridges those accommodated in a process frame in a printer according to a third embodiment.

According to the printer 1 of the third embodiment, as shown in FIG. 22, the second drum engagement portions 118 of the respective drum cartridges 21 are arranged at positions different from one another. Through such a simple structure, the drum cartridges 21 can be arranged in a fixed order in the frontward/rearward direction.

Further, the third embodiment provides function and effect similar to those of the first embodiment.

11. Fourth Embodiment

A printer 1 according to a fourth embodiment will be described while referring to FIGS. 23A and 23B, wherein like parts and components are designated by the same reference numerals as the first embodiment to avoid duplicating description.

In the fourth embodiment, the image forming unit 4 is provided with four process cartridges 200, instead of the four drum cartridges 21 and four developing cartridges 22. Further, the front cover 7 includes a process cartridge accommodating portion 214, and the belt unit 37 includes four pairs of positioning holes 218.

In the following description, directions relating to the process cartridge 200 will reference the state of the process cartridge 200 when the process cartridge 200 is detached from and attached to the front cover 7 at the open position. Specific directions are shown by arrows in each drawing.

(1) Process Cartridge

Each process cartridge 200 includes a drum unit 201 as an example of a drum cartridge and a developing agent unit 202 as an example of a developer cartridge.

The drum unit 201 includes the photosensitive drum 26 and Scorotron charger 27. The drum unit 201 constitutes an upper portion of the process cartridge 200. The drum unit 201 includes a drum frame 204.

The drum frame 204 has a generally rectangular cylindrical shape that extends in the leftward/rightward direction and that has right and left end portions closed. The drum frame 204 has an upper wall formed with an opening that is elongated in the leftward/rightward direction and that provides fluid communication between the interior and exterior of the drum frame 204. The upper end portion of the photosensitive drum 26 is exposed through the opening in the upper wall of the drum frame 204. The upper end portion of the photosensitive drum 26 protrudes upwardly above the upper surface of the drum frame 204. Although not shown in the drawings, the lower wall of the drum frame 204 is formed with an opening that is elongated in the leftward/rightward direction and that provides fluid communication between the interior and exterior of the drum frame 204. The lower end portion of the photosensitive drum 26 is exposed through the opening in the lower wall of the drum frame 204. The drum frame 204 has: a pair of drum-unit grip portions 205; and a pair of positioning protrusions 206 as an example of an engagement portion.

The drum-unit grip portions 205 are each provided at each left-right end portion of the 204. Each drum-unit grip portion 205 has a general plate shape that is substantially in an L-shape in a front view. More specifically, the drum-unit grip portion 205 extends upward from the upper surface of the drum frame 204 at its left-right end portion, and then extends outward in the leftward/rightward direction.

The pair of positioning protrusions 206 is positioned adjacent to and inward of the pair of drum-unit grip portions 205 in the leftward/rightward direction. Each positioning protrusion 206 has a convex shape protruding upward from the upper surface of the drum frame 204 and having a substantially rectangular cross section. The outer end portion of the positioning protrusion 206 in the leftward/rightward direction is continuous with the inner surface of the 205 in the leftward/rightward direction.

The developing agent unit 202 has the developing roller 30, the supply roller 31, the thickness regulation blade 32, and the toner accommodating portion 33, and constitutes the lower portion of the process cartridge 200. The developing agent unit 202 is provided with a developing frame 209.

The developing frame 209 has a generally rectangular cylindrical shape that extends in the leftward/rightward direction and that has right and left end portions closed. Although not shown in the drawings, the developing frame 209 has an upper wall formed with an opening that is elongated in the leftward/rightward direction and that provides fluid communication between the interior and exterior of the developing frame 209. The upper end portion of the developing roller 30 is exposed through the opening in the upper wall of the developing frame 209. The developing roller 30 is in contact with the lower end portion of the photosensitive drum 26.

The developing frame 209 has a pair of first engagement portions 210 and a pair of second engagement portions 211.

The first engagement portions 210 are provided at the front-lower portion of the developing frame 209. Each first engagement portion 210 has a substantially circular columnar shape that protrudes outward in the leftward/rightward direction from the outer surface of the left-right side wall of the developing frame 209.

The second engagement portions 211 are provided at the rear-lower portion of the developing frame 209. Each 211 has a substantially circular columnar shape that protrudes outward in the leftward/rightward direction from the outer surface of the left-right side wall of the developing frame 209.

(2) Front Cover

As described above, the front cover 7 is pivotally movable about the lower end portion thereof between a closed position where the front cover 7 closes the opening 6 and an open position where the front cover 7 opens the opening 6. At the closed position, the front cover 7 extends in the vertical direction. At the open position, the front cover 7 extends in the frontward/rearward direction. The front cover 7 has a frame plate shape that has a closed bottom and is substantially rectangular in a plan view when the front cover 7 is placed at the open position.

The process cartridge accommodating portion 214 is recessed toward downward from an upper surface of the front cover 7 and is substantially rectangular in a plan view when the front cover 7 is at the open position. The process cartridge accommodating portion 214 is configured to accommodate four process cartridges 200 therein such that the four process cartridges 200 are arrayed side by side in the frontward/rearward direction when the front cover 7 is at the open position. Although not shown in the drawings, the process cartridge accommodating portion 214 is formed with engaging holes that are engageable with the pairs of first engagement portions 210 and the pairs of second engagement portions 211 of the four process cartridges 200.

(3) Belt Unit

According to the fourth embodiment, the belt unit 37 is arranged in the rear portion of the main casing 2 and is oriented in the vertical direction. Thus, according to the fourth embodiment, the belt unit 37 is arranged in the main casing 2 differently in terms of the position and the orientation from that in the first embodiment. Although not shown, the belt unit 37 has the drive roller 39 disposed in the lower portion thereof and the follower roller 40 disposed in the upper portion thereof. The intermediate transfer belt 41 is worn and stretched around the drive roller 39 and the follower roller 40. Although not shown, the four primary transfer rollers 42 are disposed between the drive roller 39 and the follower roller 40 such that the primary transfer rollers 42 are arrayed side by side at intervals in the vertical direction with gaps formed therebetween.

According to the present embodiment, the belt frame 155 of the belt unit 37 is not provided with four pairs of positioning protrusions 160. However, the belt frame 155 is provided with four pairs of positioning holes 218 as one example of the positioning portions, in place of the four pairs of positioning protrusions 160.

The four pairs of positioning holes 218 are arranged at intervals in the vertical direction with gaps formed therebetween such that the positioning holes 218 constituting each pair are each provided at each left-right end portion of the belt frame 155. Each positioning hole 218 has a concave shape recessed rearward from the front surface of the belt frame 155 and has a general rectangular shape in a front view.

(4) Mounting and Removal of Process Cartridge to Main Casing

When the front cover 7 is at the open position, a user holds the pair of drum-unit grip portions 205 of one process cartridge 200, and inserts the process cartridge 200 into the process cartridge accommodating portion 214 from above, thereby attaching the process cartridge 200 on the process cartridge accommodating portion 214.

By displacing the front cover 7, which is now attached with four process cartridges 200, from the open position to the closed position, the pair of positioning protrusions 206 on each of the four process cartridges 200 is inserted in the corresponding pair of positioning holes 218 on the belt frame 155.

As a result, the four process cartridges 200 are arranged in the vertical direction in the inside of the main casing 2 such that each of the four photosensitive drums 26 is opposed to the corresponding one of the four primary transfer roller 42 (not shown), with the intermediate transfer belt 41 being disposed therebetween.

In this manner, the operation of mounting the process cartridges 200 in the main casing 2 is completed.

In order to remove one of the four process cartridges 200 from the main casing 2, the front cover 7 is first displaced from the closed position to the open position in the procedure reverse to the procedure of mounting the process cartridges 200 in the main casing 2.

The user then holds the pair of drum-unit grip portions 205 of one of the process cartridges 200, and removes the process cartridge 200 from the process cartridge accommodating portion 214.

Consequently, the operation of removing the process cartridge 200 from the main casing 2 is completed.

(5) Advantages of the Fourth Embodiment

Figure 23A:
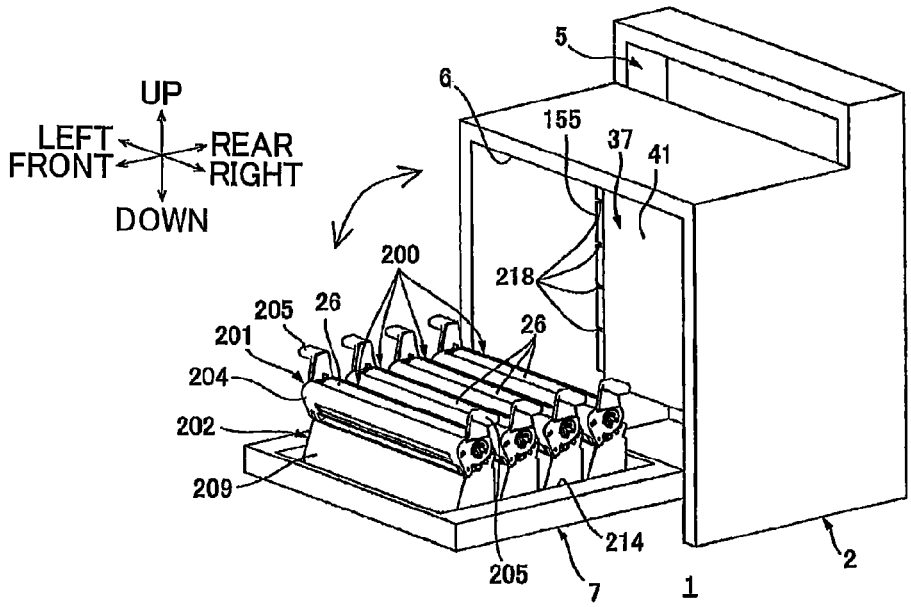
FIG. 23A is view for description of attachment and detachment of process cartridges in a printer according to a fourth embodiment, and illustrating a state where a front cover is at an open position and four process cartridges are accommodated in a process cartridge accommodating portion.
Figure 23B:
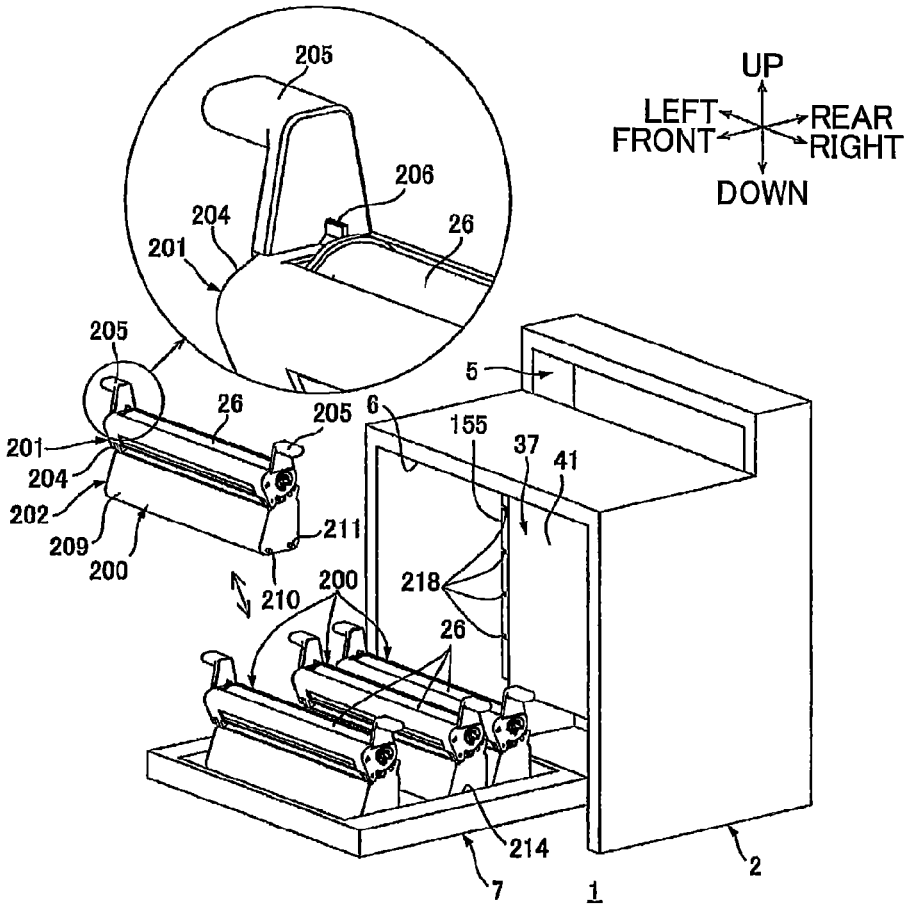
FIG. 23B is view for description of attachment and detachment of the process cartridges in the printer according to the fourth embodiment, and illustrating a state subsequent to the state illustrated in FIG. 23A such that the front cover is at the open position and one of the four process cartridges is released from the process cartridge accommodating portion.

In the printer 1 according to the fourth embodiment, positioning of four process cartridge 200 relative to the belt frame 155 can be made by the engagement of the pair of positioning protrusions 206 of each process cartridge 200 supporting each photosensitive drum 26 with the positioning hole 218 of the belt frame 155 supporting the intermediate transfer belt 41 as illustrated in FIGS. 23A and 23B.

As a result, precise positioning of the four photosensitive drums 26 relative to the intermediate transfer belt 41 can be obtained.

According to the printer 1 of the fourth embodiment, as shown in FIGS. 23A and 23B, in the state that the process cartridge 200 is removable from the main casing 2, the upper portion of the photosensitive drum 26 is exposed because the intermediate transfer belt 41 no longer confronts the photosensitive drum 26. However, because the drum unit 201 has the pair of drum-unit grip portions 205, a user can easily access to the process cartridge 200 without touching the photosensitive drum 26, and can easily perform a replacement of the process cartridge 200.

The fourth embodiment provides function and effect similar to those of the first embodiment.

12. Modifications

The printer 1 described above corresponds to embodiments of the image forming apparatus according to the present disclosure.

While the description has been made in detail with reference to the above-described embodiments, it would be apparent to those skilled in the art that various changes and modifications may be made therein without departing from the spirit and scope of the above described embodiments.

For example, in the embodiments described above, the cyan drum cartridge 21C is one example of the first drum cartridge, the magenta drum cartridge 21M is one example of the second drum cartridge, and the yellow drum cartridge 21Y is one example of the third drum cartridge.

However, in another embodiment, among four drum cartridges 21, the magenta drum cartridge 21M can be one example of the first drum cartridge, the yellow drum cartridge 21Y can be one example of the second drum cartridge, and the black drum cartridge 21K can be one example of the third drum cartridge.

In this modification, the magenta-drum convex portion 128M of the magenta drum cartridge 21M is one example of the first engaging part, and the yellow-drum concave portion 130Y engaged with the magenta-drum convex portion 128M is one example of the first engaged part. The yellow-drum convex portion 128Y is one example of the second engaging part, and the black-drum concave portion 130K engaged with the yellow-drum convex portion 128Y is one example of the second engaged part.

In the first embodiment described above, the drum convex portions 128 are formed on the four drum cartridges 21 at positions different from one another in the leftward/rightward direction. By arranging the process recessed portion 76 of the process frame 52 and the drum concave portions 130 of the three drum cartridges 21 other than the black drum cartridge 21K at positions corresponding to those of the drum convex portions 128, the order in which the four drum cartridges 21 are arranged in the process frame 52 is fixed and cannot be changed.

However, at least one of the number, the shape, and the size of the drum convex portions 128 in the four respective drum cartridges 21 may be set different from one another. By providing the process recessed portion 76 of the process frame 52 and the drum concave portions 130 of the three drum cartridges 21 other than the black drum cartridge 21K in correspondence with the drum convex portions 128 of the four drum cartridges 21, the order in which the four drum cartridges 21 are arranged in the process frame 52 can be made fixed and unchangeable.

In the third embodiment described above, the second drum engagement portions 118 are provided on the four respective drum cartridges 21 at different positions from one another in the frontward/rearward direction. The second drum engagement grooves 71 are formed in the four drum cartridge accommodating portions 100 at positions corresponding to the second drum engagement portions 118 of the four drum cartridges 21, respectively. The order in which the four drum cartridges 21 are arranged in the process frame 52 is fixed and cannot be changed.

However, at least one of the number, the shape, and the size of the second drum engagement portions 118 on the four respective drum cartridges 21 may be set different from one another. By forming the second drum engagement grooves 71 in the four drum cartridge accommodating portions 100 in correspondence with the second drum engagement portions 118 of the four drum cartridges 21, the order in which the four drum cartridges 21 are arranged in the process frame 52 can be made unchangeable.

In the third embodiment described above, the second developing engagement portions 152 are provided on the four respective developing cartridges 22 at different positions from one another in the frontward/rearward direction. The second developing engagement grooves 69 are formed in the four developing cartridge accommodating portions 101 at positions corresponding to the second developing engagement portions 152 of the four developing cartridges 22, respectively. The order in which the four developing cartridges 22 are arranged in the process frame 52 is fixed and cannot be changed.

However, at least one of the number, the shape, and the size of the second developing engagement portions 152 on the four respective developing cartridges 22 may be set different from one another. By forming the second developing engagement grooves 69 in the four developing cartridge accommodating portions 101 in correspondence with the second developing engagement portions 152 of the four developing cartridges 22, the order in which the four developing cartridges 22 are arranged in the process frame 52 can be made unchangeable.

What is claimed is:

1. An image forming apparatus comprising:

a main casing;

a belt unit accommodated in the main casing and including a belt;

a supporting member configured to move in a supporting-member-moving direction between an internal position inside the main casing and an external position outside the main casing;

a drum cartridge detachably supported by the supporting member and including a photosensitive drum and a drum frame supporting the photosensitive drum, the photosensitive drum being disposed below the belt when the supporting member is at the internal position, the photosensitive drum extending in a drum-extending direction orthogonal to the supporting-member-moving direction, the drum cartridge further having an abutment portion; and a developer cartridge detachably supported by the supporting member such that the developer cartridge is disposed below the drum cartridge when both the drum cartridge and the developer cartridge are mounted to the supporting member, the developer cartridge including a developer frame configured to store developer therein and a developer gripping portion, the developer gripping portion having a moving portion configured to move between a protruding position and an accommodated position, the protruding position being such a position that the moving portion protrudes with a distal end portion thereof being apart from the developer frame, the accommodated position being such a position that a distance between the distal end portion of the moving portion and the developer frame when the moving portion is at the accommodated position is shorter than a distance therebetween when the moving portion is at the protruding position, the abutment portion being configured such that when the drum cartridge is mounted to the supporting member, the abutment portion abuts against the moving portion to cause the moving portion to move to the accommodated position and such that when the drum cartridge is removed from the supporting member, abutment of the abutment portion against the moving portion is released to cause the moving portion to move to the protruding position.

2. The image forming apparatus according to claim 1, wherein the developer cartridge further includes an urging member configured to urge the moving portion to move from the accommodated position to the protruding position.

3. The image forming apparatus according to claim 1, wherein the moving portion is configured to pivotally move between the protruding position and the accommodated position.

4. The image forming apparatus according to claim 3, wherein the moving portion protrudes in the drum-extending direction when the moving portion is at the protruding position, and the moving portion extends in a vertical direction when the moving portion is at the accommodated position.

5. The image forming apparatus according to claim 4, wherein the supporting member includes a side plate having a shape extending in the supporting-member-moving direction, and wherein in a state that the moving portion is at the protruding position, the moving portion is disposed above the side plate and is overlapped with the side plate when viewed in the vertical direction.

6. The image forming apparatus according to claim 4, wherein the moving portion protrudes such that the distal end portion of the moving portion is disposed outward in the drum-extending direction from the drum frame when the moving portion is at the protruding position.

7. The image forming apparatus according to claim 1, wherein the moving portion is configured to slidingly move between the protruding position and the accommodated position.

8. The image forming apparatus according to claim 7, wherein the moving portion protrudes upward from the developer frame when the moving portion is at the protruding position, and the moving portion is positioned in proximity to the developer frame when the moving portion is at the accommodated position.

9. The image forming apparatus according to claim 1, wherein the supporting member includes:

a pair of drum guide portions, each being configured to guide a corresponding one of a pair of opposite ends in the drum-extending direction of the drum frame; and a pair of developer guide portions, each being configured to guide a corresponding one of a pair of opposite ends in the drum-extending direction of the developer frame, wherein the pair of drum guide portions is disposed outward of the pair of developer guide portions in the drum-extending direction.

10. The image forming apparatus according to claim 1, wherein the supporting member is configured to support a plurality of the drum cartridges and a plurality of the developer cartridges, the plurality of drum cartridges being configured such that the drum cartridges are arrayed side by side in the supporting-member-moving direction when the drum cartridges are supported by the supporting member, the plurality of developer cartridges being configured such that the developer cartridges are arrayed side by side in the supporting-member-moving direction when the developer cartridge are supported by the supporting member.

11. The image forming apparatus according to claim 10, wherein the plurality of drum cartridges and the plurality of developer cartridges are configured to be removable upwardly from the supporting member when the supporting member is at the external position.

12. The image forming apparatus according to claim 10, wherein at least one of the plurality of drum cartridges is configured to be stacked from above on one of remaining drum cartridges.

13. An image forming apparatus comprising:

a main casing;

a belt unit accommodated in the main casing and including a belt and a belt frame supporting the belt;

a supporting member configured to move between an internal position inside the main casing and an external position outside the main casing; and a plurality of drum units supported by the supporting member such that the drum units are arrayed side by side in a drum-unit-arrayed direction, each of the plurality of drum units including:

a photosensitive drum extending in a drum-extending direction orthogonal to the drum-unit-arrayed direction; and a drum frame supporting the photosensitive drum, the drum frame of each drum unit having an engagement portion, the belt frame having positioning portions, each positioning portion being configured to be engaged with a corresponding one of a plurality of engagement portions of the plurality of drum frames, thereby fixing the plurality of drum frames in positions relative to the belt frame, and wherein either one of each engagement portion and a corresponding positioning portion has a convex shape, and another one of the each engagement portion and the corresponding positioning portion has a concave shape.

14. The image forming apparatus according to claim 13, wherein each of the positioning portions has a convex shape protruding toward a corresponding one of the plurality of drum frames, and each of the plurality of engagement portions has a concave shape engageable with the corresponding positioning portion.

15. The image forming apparatus according to claim 14, wherein each positioning portion has a convex shape with a substantially rectangular cross-section, and each engagement portion has a concave shape with a substantially rectangular cross-section.

16. The image forming apparatus according to claim 13, wherein the plurality of engagement portions is positioned outward of the belt in the drum-extending direction when the supporting member is at the internal position.

17. The image forming apparatus according to claim 13, wherein the plurality of drum units are configured to be attachable to and detachable from the supporting member.

18. The image forming apparatus according to claim 17, wherein each of the plurality of drum frames has a pair of opposite ends in the drum-extending direction, at least one of the pair of opposite ends being provided with a drum gripping portion such that the drum gripping portion is positioned outward relative to the engagement portion in the drum-extending direction.

19. The image forming apparatus according to claim 18, wherein in a state that the supporting member is at the internal position, the drum gripping portion is overlapped with the belt when viewed in the drum-extending direction.

20. The image forming apparatus according to claim 17, wherein the plurality of drum units is disposed below the belt when the supporting member is at the internal position.

21. The image forming apparatus according to claim 13, wherein the supporting member includes a plurality of exposure members corresponding to the respective ones of the plurality of photosensitive drums individually, each of the plurality of exposure members being disposed beneath the corresponding photosensitive drum and configured to expose the corresponding photosensitive drum to light.

22. The image forming apparatus according to claim 13, wherein the belt unit further includes a plurality of transfer rollers corresponding to respective ones of the plurality of photosensitive drums individually, the plurality of transfer rollers being movable relative to the belt frame.

23. The image forming apparatus according to claim 13, wherein a gap between every two adjacent drum frames in the drum-unit-arrayed direction has a size equal to or more than 0.5 mm but equal to or less than 8 mm.

24. An image forming apparatus comprising:

a main casing;

a belt unit including a belt;

a drum cartridge including a photosensitive drum having an axis extending in a drum-extending direction and a drum frame supporting the photosensitive drum;

a developer cartridge configured to store developer therein; and a supporting member configured to move in a supporting-member-moving direction between an internal position inside the main casing and an external position outside the main casing, the supporting-member-moving direction being orthogonal to the drum-extending direction, the supporting member being configured to support the drum cartridge and the developer cartridge such that the drum cartridge and the developer cartridge are attachable to and detachable from the supporting member, the drum cartridge being disposed below the belt unit and the developer cartridge being disposed below the drum cartridge when the supporting member is at the internal position in a state that the supporting member supports the drum cartridge and the developer cartridge, the drum frame having a drum gripping portion at one end portion of the drum frame in the drum-extending direction, and wherein the drum frame has a pair of the drum gripping portions at a pair of opposite end portions of the drum frame in the drum-extending direction such that each drum gripping portion is provided at a corresponding one of the pair of opposite end portions of the drum frame in the drum-extending direction.

25. The image forming apparatus according to claim 24, wherein in a state that the supporting member is at the internal position, the drum gripping portion is overlapped with the belt when viewed in the drum-extending direction.

26. The image forming apparatus according to claim 24, wherein the drum gripping portion includes:

a pair of protruding parts disposed apart from each other in the supporting-member-moving direction; and a connecting part connecting the pair of protruding parts with each other.

27. The image forming apparatus according to claim 24, wherein the drum gripping portion includes:

a first portion extending upward; and a second portion extending from the first portion in the supporting-member-moving direction.

28. The image forming apparatus according to claim 24, wherein the supporting member includes:

an exposure member configured to expose the photosensitive drum to light, the exposure member being disposed below the photosensitive drum in a state that the drum cartridge is supported by the supporting member; and a cover member configured to move between an exposing position and a covering position, wherein when the drum cartridge is attached to the supporting member, the cover member is brought to the exposing position where the cover member exposes the exposure member such that the exposure member confronts the photosensitive drum, whereas when the drum cartridge is detached from the supporting member, the cover member is brought to the coving position where the cover member covers the exposure member.

29. The image forming apparatus according to claim 24, wherein the supporting member is configured to support a plurality of the drum cartridges and a plurality of the developer cartridges, the plurality of drum cartridges being configured such that the drum cartridges are arrayed side by side in the supporting-member-moving direction when the drum cartridges are supported by the supporting member, the plurality of developer cartridges being configured such that the developer cartridges are arrayed side by side in the supporting-member-moving direction when the developer cartridge are supported by the supporting member.

30. The image forming apparatus according to claim 29, wherein a gap between every two adjacent drum frames in the supporting-member-moving direction has a size equal to or more than 0.5 mm but equal to or less than 8 mm.

31. The image forming apparatus according to claim 29, wherein each of the plurality of drum frames has an upper surface, upper surfaces of neighboring drum frames that are arranged in the supporting-member-moving direction being flush with one another.

32. The image forming apparatus according to claim 29, wherein the plurality of drum cartridges are configured such that an order in which the drum cartridges are arranged in the supporting-member-moving direction when the drum cartridges are supported by the supporting member is fixed and unchangeable.

33. The image forming apparatus according to claim 29, wherein the plurality of drum cartridges includes:

a first drum cartridge; and a second drum cartridge disposed adjacent to the first drum cartridge in the supporting-member-moving direction, the first drum cartridge having a first engaging part, and the second drum cartridge having a first engaged part engageable with the first engaging part.

34. The image forming apparatus according to claim 33, wherein the first engaging part has a convex shape protruding toward the second drum cartridge, and the first engaged part has a concave shape engageable with the first engaging part.

35. The image forming apparatus according to claim 33, wherein the plurality of drum cartridges further includes a third drum cartridge which is disposed adjacent to the second drum cartridge, the second drum cartridge having a second engaging part, the third drum cartridge having a second engaged part engageable with the second engaging part, and a position of the second engaging part and the second engaged part in the drum-extending direction is offset from a position of the first engaging part and the first engaged part in the drum-extending direction when viewed in the supporting-member-moving direction.

36. The image forming apparatus according to claim 35, wherein the second engaging part has a convex shape protruding toward the third drum cartridge, and the second engaged part has a concave shape engageable with the second engaging part.

37. The image forming apparatus according to claim 33, wherein the plurality of drum cartridges includes a downstream-most drum cartridge which is disposed at a downstream-most position among the plurality of drum cartridges in a direction from the internal position to the external position, the downstream-most drum cartridge having a third engaging part, the supporting member has a third engaged part engageable with the third engaging part, a position of the third engaging part and the third engaged part in the drum-extending direction is offset from a position of the first engaging part and the first engaged part in the drum-extending direction when viewed in the supporting-member-moving direction.

38. The image forming apparatus according to claim 37, wherein the third engaging part has a convex shape protruding toward the supporting member, and the third engaged part has a concave shape engageable with the third engaging part.

39. The image forming apparatus according to claim 29, wherein the supporting member includes a plurality of accommodating portions each configured to accommodate therein a corresponding one of the plurality of drum cartridges, the plurality of accommodating portions having a plurality of guide portions each configured to guide the corresponding drum cartridge, positions of the guide portions relative to the corresponding accommodating portions are offset from one another.

40. The image forming apparatus according to claim 29, wherein the plurality of drum cartridges and the plurality of developer cartridges are configured to be removable upwardly from the supporting member when the supporting member is at the external position.

41. The image forming apparatus according to claim 29, wherein at least one drum cartridge among the plurality of drum cartridges has a mount portion that is configured to be mounted on another drum cartridge, thereby enabling the at least one drum cartridge to be stacked on the another drum cartridge from above.

42. The image forming apparatus according to claim 41, wherein the mount portion of the at least one drum cartridge is engageable with the drum gripping portion of the another drum cartridge.

43. The image forming apparatus according to claim 42, wherein the plurality of drum cartridges includes a downstream-most drum cartridge which is disposed at a downstream-most position among the plurality of drum cartridges in a direction from the internal position to the external position, the drum gripping portion of the downstream-most drum cartridge is configured so as to be unengageable with the mount portions of other remaining drum cartridges.

44. The image forming apparatus according to claim 29, wherein the belt unit has a positioning portion configured to fix the plurality of drum cartridges in positions relative to the belt unit, the positioning portion being disposed inward of the drum gripping portion in the drum-extending direction.

* * * * *